US007845640B2

(12) United States Patent
Motegi et al.

(10) Patent No.: US 7,845,640 B2
(45) Date of Patent: Dec. 7, 2010

(54) CHUCKER WITH SLITS AND MEDAL GAME DEVICE

(75) Inventors: Akira Motegi, Tokyo (JP); Osamu Kuwano, Tokyo (JP)

(73) Assignee: Kabushiki Kaisha Sega, Tokyo (JP)

( * ) Notice: Subject to any disclaimer, the term of this patent is extended or adjusted under 35 U.S.C. 154(b) by 87 days.

(21) Appl. No.: 12/300,268

(22) PCT Filed: Apr. 13, 2007

(86) PCT No.: PCT/JP2007/058174

§ 371 (c)(1),
(2), (4) Date: Mar. 11, 2009

(87) PCT Pub. No.: WO2007/129529

PCT Pub. Date: Nov. 15, 2007

(65) Prior Publication Data

US 2009/0224473 A1 Sep. 10, 2009

(30) Foreign Application Priority Data

May 10, 2006 (JP) ..... 2006-132030

(51) Int. Cl.
*A63B 71/00* (2006.01)

(52) U.S. Cl. ..... 273/138.1

(58) Field of Classification Search ..... None
See application file for complete search history.

(56) References Cited

U.S. PATENT DOCUMENTS 1,496,794 A * 6/1924 Van Hamersveld ..... 29/38 A
5,701,385 A * 12/1997 Katsuyama et al. ..... 386/106
6,029,973 A * 2/2000 Takemoto ..... 273/121 B
6,452,298 B1 * 9/2002 Fukuda et al. ..... 310/89

(Continued)

FOREIGN PATENT DOCUMENTS

JP 10-179922 A 6/1998

(Continued)

*Primary Examiner*—Alvin A Hunter
*Assistant Examiner*—Dolores Collins
(74) *Attorney, Agent, or Firm*—Drinker Biddle & Reath LLP

(57) ABSTRACT

A chucker with slits, capable of reducing the scale of a device with a simple configuration and allowing the degree of difficulty of medal passage to be adjusted properly and conveniently according to the situation of a game, and a medal game device using the chucker with slits, are provided. The medal game device according to the present invention is provided with a medal inserting portion into which a medal is inserted, and a winning prize port formed to be able to receive the inserted medal, and is configured so as to give a prescribed privilege to a player at least on the condition that the medal has entered the winning prize port. The medal game device is further provided with a chucker with slits which has a disk-shaped bottom portion 35*a* having in a central portion thereof an opening communicating with the winning prize port and formed to allow insertion of the medal, a first region having first slits SL1 having a first width larger than the thickness of the medal and formed along the peripheral edge of the disk-shaped bottom portion, and a second region having second slits SL2 having a second width differing from the first width and formed along the peripheral edge of the disk-shaped bottom portion.

11 Claims, 34 Drawing Sheets

U.S. PATENT DOCUMENTS

| | | | | |
|---|---|---|---|---|
| 6,624,540 | B2 * | 9/2003 | Fukuda et al. | 310/40 MM |
| 6,785,199 | B2 * | 8/2004 | Ohtsu et al. | 369/30.36 |
| 2009/0042653 | A1 * | 2/2009 | Hamada | 463/42 |
| 2009/0224473 | A1 * | 9/2009 | Motegi et al. | 273/138.1 |
| 2010/0096803 | A1 * | 4/2010 | Sasaki et al. | 273/138.3 |

FOREIGN PATENT DOCUMENTS

| | | | |
|---|---|---|---|
| JP | 11-076599 | A | 3/1999 |
| JP | 11-146977 | A | 6/1999 |
| JP | 2000-140406 | A | 5/2000 |
| JP | 2000-202154 | A | 7/2000 |
| JP | 2000-207615 | A | 7/2000 |
| JP | 2000-225267 | A | 8/2000 |
| JP | 2000-288237 | A | 10/2000 |
| JP | 2001-017730 | A | 1/2001 |
| JP | 2001-046732 | A | 2/2001 |
| JP | 2001-087541 | A | 4/2001 |
| JP | 2001-265264 | A | 9/2001 |
| JP | 2002-113256 | A | 4/2002 |
| JP | 2002-210222 | A | 7/2002 |
| JP | 2002-331162 | A | 11/2002 |
| JP | 2003-325961 | A | 11/2003 |
| JP | 2003-325962 | A | 11/2003 |
| JP | 2004-113566 | A | 4/2004 |
| JP | 2004-298400 | A | 10/2004 |
| JP | 2005-021492 | A | 1/2005 |

* cited by examiner

Fig. 13

826 827

| EVENT | MOTOR ROTATING SPEED (rpm) |
|---|---|
| MOVING TARGETS | 2000 – 2100 |
| SMALL TARGETS | 3000 – 3100 |
| LARGE TARGETS | 4200 – 4300 |
| TARGET MECHANISMS | 2800 – 2900 |

SETTINGS TABLE 825

CHUCKER WITH SLITS AND MEDAL GAME DEVICE

CROSS-REFERENCE TO RELATED APPLICATIONS

This application is the U.S. national phase of the International Patent Application No. PCT/JP2007/058174 filed Apr. 13, 2007, which claims the benefit of Japanese Application No. 2006-132030 filed May 10, 2006, the entire content of which is incorporated herein by reference.

BACKGROUND

The present invention relates to recreational device using medals in the form of a medal game device, and a chucker with slits used therein.

Various types of devices are known as medal game devices based on so-called medal dropping games. In such medal game devices, for example, a medal inserted into a medal inserting port is typically supplied to a pusher portion provided with a medal table moving reciprocally in the forward and backward directions. When a medal accumulated on this pusher portion is pushed out and drops from the pusher portion to a prescribed location, this medal is paid out to a player.

In addition, some of these medal game devices are provided with a medal passage portion on the front surface of the medal table, and when a medal passes through this medal passage portion, a prescribed lottery, for example, is carried out, and a prescribed benefit (such as paying out a number of medals greater than the usual number of medals paid out) is given to the player corresponding to the result of the lottery.

For example, Patent Document 1 describes a medal game device in which a moving table is provided in front of a medal chute in which medals are inserted, and a comb-like or plate-like obstacle plate having slits is provided in a prize box arranged there above. In this medal game device, the comb-like obstacle plate is provided to be able to move to the left and right, and this movement increases the difficulty of medals passing through the slits.

In addition, Patent Document 2 describes a medal game machine provided with a medal insertion device for inserting medals onto a flat playing surface, and a medal discharge device that moves back and forth in the forward and backward directions over the flat playing surface, wherein a plurality of blade plates that obstruct the passage of medals by rotating to the left and right are provided in a medal passage port of a pushing plate of the medal discharge device. As a result of employing this configuration, the pattern of movement of the plurality of blade plates obstructing the passage of medals can be made to be complex, thereby serving to suppress a decrease in the variety of the game by preventing the patterns of movement from being easily anticipated by a player.

[Patent Document 1] Japanese Patent Application Laid-open No. H10-179922

[Patent Document 2] Japanese Patent Application Laid-open No. 2000-225267

However, in the medal game device described in Patent Document 1, since the width of the slits in the obstacle plate is fixed, even if the obstacle plate moves to the right and left, it was not possible to further adjust the degree of difficulty of medal passage. In addition, since the obstacle plate is in the form of flat plate, it was inherently difficult for medals to pass through the slits since medals released from the medal chute enter the slits on an angle. Moreover, since the obstacle plate independently serves as an obstacle to the medals, it was necessary to provide a winning prize port for medals that passed through the slits separate from the obstacle plate.

On the other hand, in the medal game machine described in Patent Document 2, a complex and intricate cam mechanism was required to rotate the plurality of blade plates to the left and right. In addition, although the slit intervals between the blade plates change due to the left and right rotation of the blade plates, since the size of the slit intervals changes periodically within a series of operations of the blade plates unless the rotating speed is changed, the movement pattern of the blade plates cannot be said to be complex with respect to this point. Alternatively, if the rotation speed were changed, the slit interval would end up changing continuously, thereby resulting in the risk of the opposite effect of increasing the difficulty of medal passage beyond that which would be expected by a player (in other words, medal passage would be excessively difficult). Moreover, similar to the medal game device of Patent Document 1, since the blade plates independently serve as medal obstacles, it was necessary to provide a winning prize port for medals that passed through the slits between the blade plates separate from the blade plates.

SUMMARY

Therefore, with the foregoing in view, an object of the present invention is to provide a chucker with slits capable of reducing the scale of a device with a simple configuration and allowing the degree of difficulty of medal passage to be adjusted properly and conveniently according to the situation of a game, and a medal game device using that chucker with slits.

In order to solve the above-mentioned problems, the chucker with slits according to the present invention is used in a medal game device that is provided with a medal inserting portion into which medals are inserted, and a winning prize port formed so as to be able to receive the inserted medals, and that is configured such that a prescribed privilege is given to a player on the condition that a medal has at least entered the winning prize port; the chucker with slits being provided with a disk-shaped bottom portion having in a central portion thereof an opening formed communicably with the winning prize port and allowing the passage of medals; a first slit region having first slits having a first width larger than the thickness of the medals and formed in a portion of the periphery of the disk-shaped bottom portion along the peripheral edge thereof; and a second region having second slits having a second width differing from the first width and formed in another portion of the periphery of the disk-shaped bottom portion along the peripheral edge thereof.

If a chucker with slits configured in this manner is provided in a medal game device, in the case a medal inserted into the medal inserting portion has reached the first region, that medal passes through a first slit and is able to enter the winning prize port, while on the other hand, in the case the medal has reached the second region, that medal passes through a second slit and is able to enter the winning prize port. At this time, since the first width of the first slits differs from the second width of the second slits, the difficulty of medal passage differs. Accordingly, the difficult of medal passage, and thus the probability of a medal entering the winning prize port, can be easily varied without requiring a complex mechanism as in the prior art simply by switching so that medals reach either the first region or the second region.

In addition, since the first slits and the second slits are formed along the periphery of the disk-shaped bottom portion and arranged in the shape of an arc, the entrance angle when a medal has reached the slits is less severe as compared with the slits of a flat plate. As a result, the degree of difficulty of medal passage through the slits is not excessively high for a player and a suitable probability of winning is ensured, thereby maintaining the level of interest in the game. In other words, in addition to simplifying the configuration of the medal game device while reducing the scale of the device, the difficulty of medal passage can be easily adjusted by suitably switching between the first slits and the second slits according to the situation of the game.

Moreover, since an opening is provided in the central portion of the chucker with slits and that opening communicates with a winning prize port, the winning prize port is substantially integrally provided with the chucker with slits, and a medal that has passed through the first slit or the second slit is immediately guided to the winning prize port. Thus, it is no longer necessary to provide the winning prize port and guide portion leading thereto separately, thereby making it possible to further simplify the configuration of the medal game device. In this case, if the disk-shaped bottom portion is formed in the shape of a mortar and an opening is formed in the center of that mortar, a medal that has passed through a slit is more easily guided to the winning prize port.

More specifically, the first slits are preferably formed by having a plurality of first walls provided upright on a portion of the peripheral edge separated by a first width, while the second slits are preferably formed by having a plurality of second walls provided upright on another portion of the peripheral edge separated by a second width.

When configured in this manner, the first slits and the second slits can be formed without forming hole-shaped slits by providing holes in a plate, thereby eliminating the upper walls of the slits and simplifying the configuration. In addition, the first walls and the second walls also serve as guides that guide a medal that has passed through a first slit and a second slit, respectively, to the central opening, thereby facilitating the guidance of medals to the opening, and thus the winning prize port.

In addition, in this case, the first walls and/or second walls are preferably formed to have a prescribed thickness and to be tapered towards the opening in the disk-shaped bottom portion (or in other words, the central portion thereof).

When configured in this manner, in addition to a medal that has passed through the first slits or the second slits being more easily guided to the opening, mold separation becomes easier when fabricating the first walls and the second walls using a mold, thereby enhancing the production efficiency of the chucker with slits.

Moreover, although quite obvious if the first walls and/or the second walls have a prescribed thickness in this manner, but even if they do not, if the first slits and the second slits have a prescribed thickness along the radial direction of the disk-shaped bottom portion, this is similarly preferable from the viewpoint that medals are easily guided to the opening.

Moreover, the disk-shaped bottom portion more preferably is provided with a groove extending radially along the radial direction.

Employing such a design offers the advantage of a medal that has passed through the first slits or the second slits being more easily guided to the opening. In this case as well, the disk-shaped bottom portion is more preferably formed into the shape of a mortar.

In addition, it is also useful to provide barriers having a width larger than the width of the first width and/or second width provided on both sides of first region and/or second region, respectively.

If provided with barriers in this manner, in addition to facilitating well-defined separation of the first region and the second region, medals can be prevented from entering from both sides of the first slits and the second slits when, for example, the chucker with slits is allowed to rotate within a certain angular range and the first slits and the second slits are allowed to reciprocate to the left and right in the circumferential direction of the disk-shaped bottom portion.

In addition, still another portion of the peripheral edge of the disk-shaped bottom portion is preferably provided with a third region left open (or in other words, not provided with obstructions such as slits or walls) so as not to obstruct the medal.

In this third region, since the entry of medals into the chucker with slits is not restricted, if the third region is made to oppose the direction of movement of medals instead of the first region and the second region, the probability of medals entering the winning prize port is increased considerably. As a result, a prescribed privilege can be given to a player using the chucker with slits itself, thereby making it possible to enhance the variety of the game.

In addition, the medal game device according to the present invention is useful by being provided with the chucker with slits of the present invention, is provided with a medal inserting portion into which medals are inserted, and a winning prize port formed so as to be able to receive the inserted medals, and is configured such that a prescribed privilege is given to a player on the condition that a medal has at least entered the winning prize port; wherein the medal game device is provided with the chucker with slits, and a rotating mechanism that rotates the chucker with slits so that one of either a first region and a second region opposes the direction of movement of the medal inserted into the medal inserting portion and so that the chucker with slits moves reciprocally within a prescribed angular range about the opening, and rotates the chucker with slits so that, when a prescribed condition is satisfied, the other region of either the first region or the second region opposes the direction of movement of the medal (or in other words, so as to switch between first slits and second slits). Furthermore, there are no particular limitations on the operation of the rotating mechanism, monitoring and control of the operating status thereof or procedures thereof, and are carried out, for example, based on a control signal and the like from control means (CPU and the like) provided separately from the medal game device.

In a medal game device configured in this manner, the degree of difficulty of medal passage, and ultimately the probability of a medal entering the winning prize port, can be conveniently and properly adjusted with a simple device configuration as previously described by switching between the first slits and the second slits of the chucker with slits with the rotating mechanism.

In addition, since the first slits and the second slits are moved reciprocally to the left and right within prescribed angular range by the rotating mechanism, the degree of difficulty of medal passage can be changed thereby. At this time, in the case barriers are respectively provided on both sides of the first region and/or the second region, the width (length) along the periphery of the barriers is preferably greater than the length corresponding to the rotating angle of the chucker with slits. As a result, the entry of medals from both sides of the first slits and the second slits can be reliably prevented.

Moreover, the chucker with slits is preferably provided with the above-mentioned third region, and the rotating mechanism preferably rotates the chucker with slits so that one of either the first region, the second region and the third region opposes the direction of movement of the medal inserted into the medal inserting portion and so that the chucker with slits moves reciprocally within a prescribed angular range about the opening, and rotates the chucker with slits so that, when a prescribed condition is satisfied, the other region of either the first region, the second region and the third region opposes the direction of movement of the medal (or in other words, so as to switch between the first slits, the second slits and the open portion of the third region).

In addition, the reciprocal motion (to the left and right) of the chucker with slits is preferably stopped when a prescribed condition is satisfied.

When configured in this manner, since the degree of difficulty of medal passage decreases in comparison with the case of rotating the chucker with slits to as to reciprocate to the left and right, adjustment and control can be carried out in the manner of increasing the probability of a winning medal when the chucker with slits is rotated by a prescribed angular range under normal conditions.

Moreover, if a medal table on which a plurality of medals are placed, including the medal inserted into the medal inserting portion, and a pusher table reciprocally provided along the upper surface of the medal table, are provided, and the chucker with slits is provided on this pusher table, the device is also able to function as a medal pusher game device. According to this configuration, in addition to moving the chucker with slits to the left and right within a prescribed angular range, the chucker with slits is moved forward and backward in response to the forward and backward motion of the pusher table, thereby realizing a complex operation.

Moreover, a guide member in the form of a plate is more preferably provided to which the medal inserted into the medal inserting portion is released, which is arranged in front of the chucker with slits, and which is provided inclinably so that the edge thereof on the side of the medal inserting portion is higher than the edge thereof on the side of the chucker with slits.

If configured in this manner, an inserted medal is released on the guide member, and that medal is able to rapidly and smoothly move towards the chucker with slits due to the incline of the guide member, thereby increasing the efficiency of the medal reaching the slits. In addition, as a result of the guide member being inclined, a medal that has fallen onto the guide member without rolling is also able to move towards the chucker with slits. In this case, the chucker with slits and the guide member are preferably separated by a prescribed distance since medals are able to drop onto the medal table below.

In addition, it is also useful to fix the guide member to the pusher table. As a result, since the guide member moves forward and backward with the pusher table enabling the distance between the chucker with slits and the guide member to be kept constant, medals can be prevented from dropping onto the medal table without reaching the chucker with slits as a result of the distance between the guide member and the chucker with slits being excessively great.

According to the chucker with slits and the medal game device of the present invention, since a first region in which first slits are formed and a second region in which second slits are formed are provided on a disk-shaped bottom portion, the scale of the device can be reduced with a simple configuration, and the degree of difficulty of medal passage through the slits, and thus the probability of winning, can be properly and conveniently adjusted in accordance with the situation of a game by suitably switching between the two regions.

DESCRIPTION OF THE DRAWINGS

FIG. 13 illustrates an example of the configuration of a settings table 825;

Figure 1:
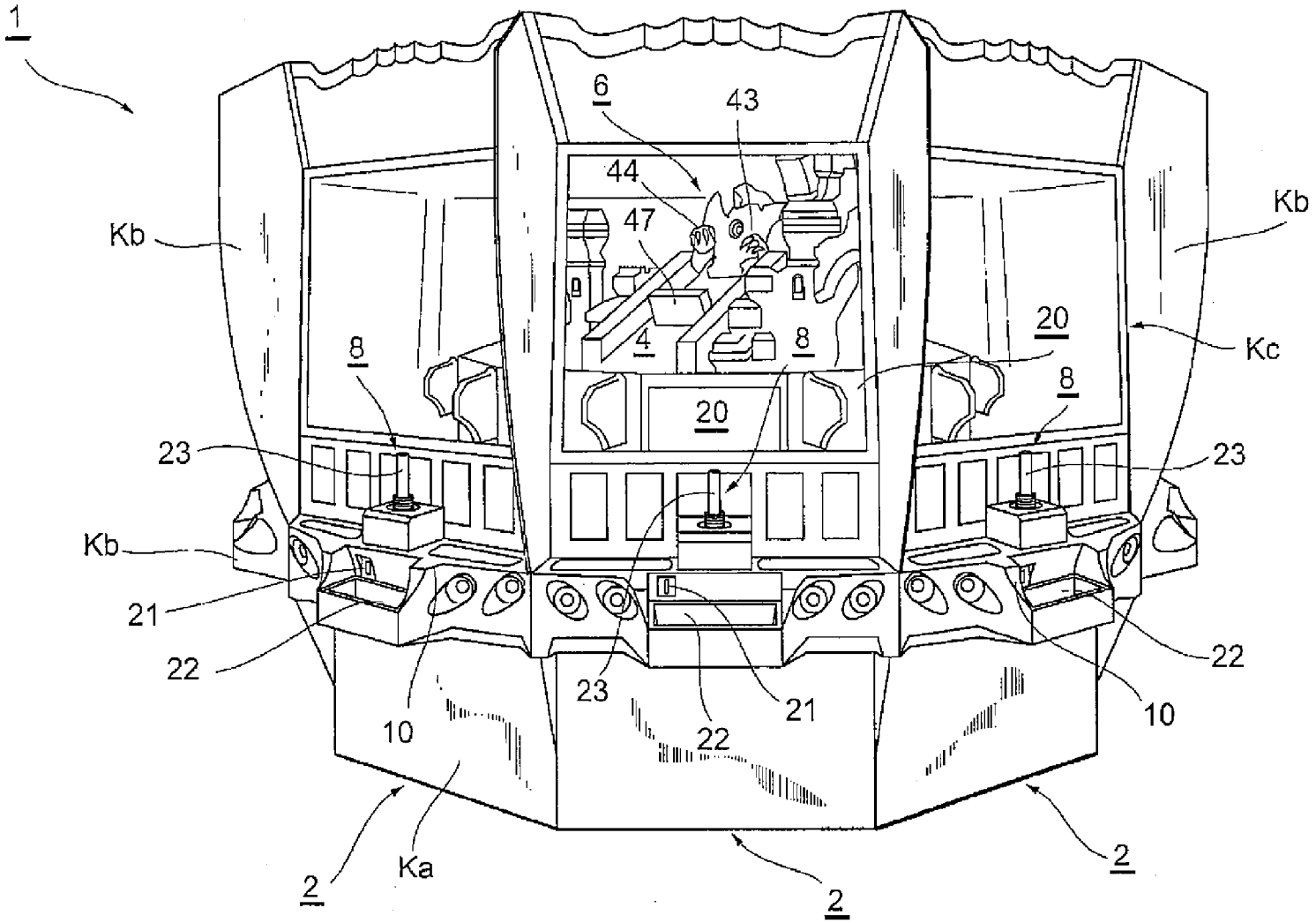
FIG. 1 is a perspective view illustrating one example of the appearance of a medal game device as claimed in the present invention.
Figure 2:
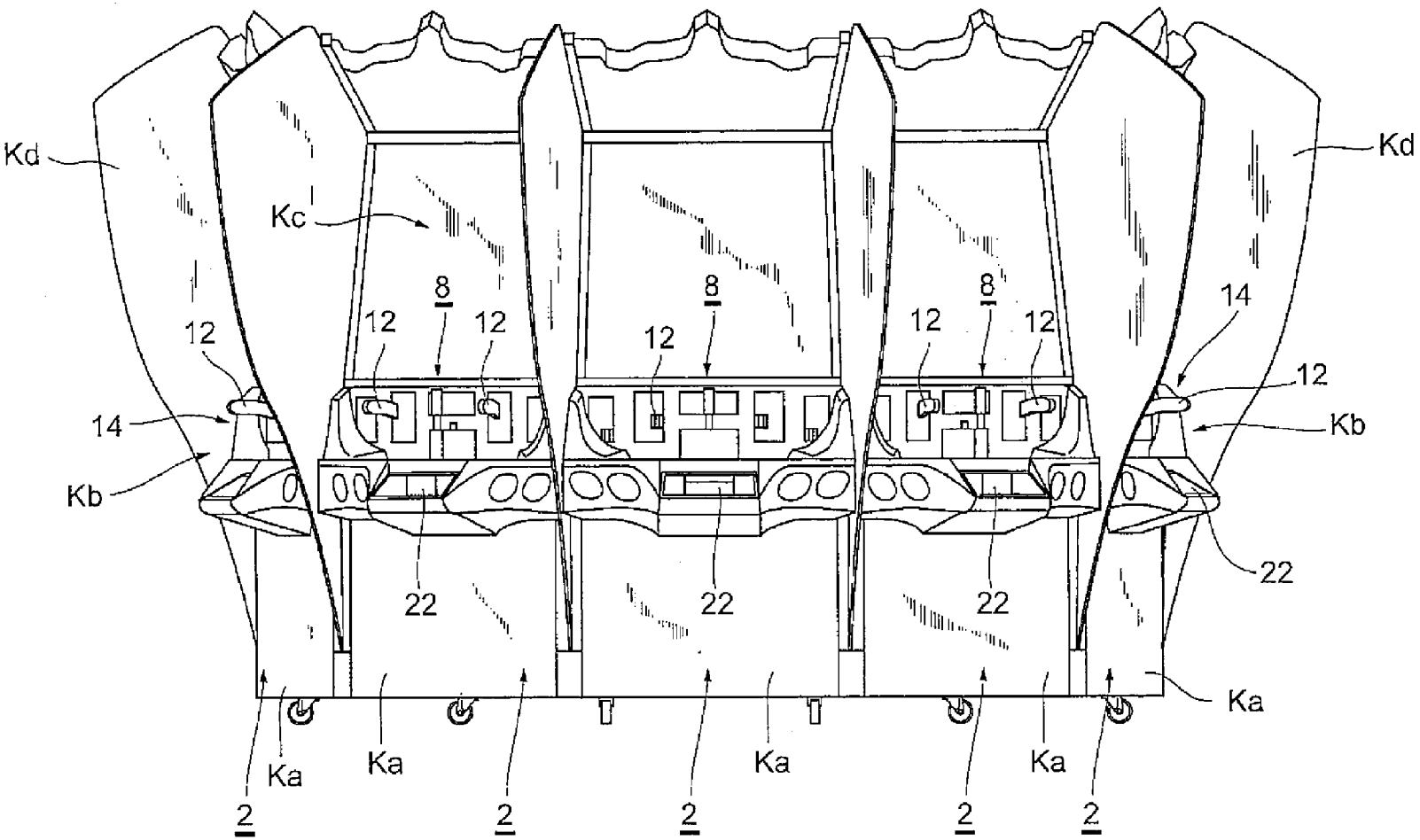
FIG. 2 is a front view illustrating one example of the appearance of a medal game device.

1: medal game device, 2: satellite portion, 3: pusher portion, 4: jackpot portion, 5: turntable portion, 6: rotating center unit, 8: medal launching device, 10: console panel, 12: medal inserting portion, 14: medal feed mechanism, 17: cup-shaped unit, 18: rotating mechanism, 20: display portion, 21: payout portion, 22: tray, 23: lever, 25: satellite hopper, 26: speaker, 27: medal transport unit, 31: cylindrical body, 32: control rod, 33,34: opening, 35,351,352: chucker (chucker with slits), 35*a*: disk-shaped bottom portion, 35*b*: barrier portion, 36: pusher table, 37: medal table, 38: medal collecting portion, 39: guide plate (guide member), 39*a*: inclining mechanism, 39*f*,39*n*: edge, 41: moving target, 42: small target, 43: large target, 44: obstacle, 45: chucker, 46: lower gate portion, 47: upper gate portion, 48: switching mechanism, 49: medal supply path, 51: medal tray, 52: round chute, 53: medal supply device, 54: rotating plate, 55: base, 80: operating table, 81: medal supply unit, 82: medal propelling unit, 83: medal ejection unit, 84: operating unit, 85: pedestal, 86: first operating table portion, 87: second operating table portion, 88: supporting unit, 89: medal launching drive unit, 91: projection unit, 92: projector device, 93: reflecting plate, 94: elevator mechanism, 100: main unit, 101: CPU, 102: memory, 103: timer, 104,105,106,108: interface circuit, 107: sound source circuit, 110: amp, 200: satellite unit, 201: CPU, 202: memory, 203, 204,206,208,209: interface circuit, 205: sound source circuit, 207: video display circuit, 211: amp, 212: motor, 213: count sensor, 214: motor, 214: drive motor, 271: medal guide, 272: transport rail, 273: switching flap, 274: first transport path, 275: second transport path, 276: medal tray, 300: target unit, 301: sensor, 302: board, 303: cold cathode tube, 304: light-emitting device, 400: jackpot unit, 401,402: motor, 403: wave sensor, 404: motor, 405: count sensor, 406: full sensor, 411, 421: support rod, 422: rotating shaft, 423: mounting pedestal, 441: motor, 442: cam, 443: cam follower, 444: fulcrum, 445: support plate, 451, winning prize port, 452, sensor, 453, guide path, 461, lower gate, 462, shaft, 462: upper gate, 463: lower gate pusher, 471: upper gate, 472: shaft, 473: upper gate pusher, 480: inclined path, 481: guide shaft, 482*a*: medal introducing portion, 482: rail, 483: slope, 483*a*: inclined surface, 484: motor, 485: medal flow path, 486: bearing, 487: rotating plate, 487*a*: projection, 488: locking piece, 489: sensor, 500: turntable unit, 501: motor, 502: jackpot sensor, 503: position sensor, 505,507: inclined path, 506,508: dropping hole, 509: frame, 511: opening, 512: bottom portion, 513: trough, 521: opening, 522: bottom portion, 523: trough, 524: opening, 531: main hopper, 531*a*, medal quantity sensor, 532: medal guide, 533: rocking lever, 534: medal outlet, 600: medal collecting unit, 601: medal supply motor, 700: illumination unit, 800: maintenance unit, 801: support shaft, 803: rotation central axis, 811: mini-hopper, 812: medal supply motor, 813: medal guide, 814: medal supply port, 815: rotating disk, 821: rotating roller, 821*a*: outer peripheral portion, 822: rotating roller, 823: roller drive motor, 825: settings table, 826: event, 827: rotating speed, 831: launching rail, 832: incident end, 833: medal launching port, 835: lower surface, 836: upper surface, 837: medal sensor, 842: launch button, 843: trigger sensor, 844: light-emitting device, 861: enclosure, 862: sidewall, 863,864: guide hole, 871: enclosure, 872: side surface, 873,874: claw, 875: upper surface, 876: medal replenishing hole, 881: locking mechanism, 891, 892: flight path, 900: interface unit, 911: target mechanism, 912: each chucker, 913: open/close mechanism, 941: motor, 943: slider, 944: support arm, 944*a*: support piece, 944*b*: projection, 945,946: shaft, 947: slide rail, 948: guide, 948*a*: inclined portion, 949: cushion, Ka: base enclosure, Kb: console enclosure, Kc: upper enclosure, Kd: divider, M: medal, Mz: groove, OP: opening, P: open portion, R1: first region, R2: second region, R3: third region, SL1: first slits, SL2: second slits, W1: first walls, W2: second walls, Y1: left and right reciprocal directions, Y2: rotating direction, Z: ridge

DETAILED DESCRIPTION

The following provides a detailed explanation of the configuration of the present invention based on one example of an embodiment illustrated in the drawings.

FIGS. 1 to 32 illustrate an embodiment of a medal game device as claimed in the present invention. This medal game device is a type of so-called mass medal machine having a large rotating center unit 6, on which characters and various other gimmicks are arranged, and a plurality (for example, 10) of satellite portions 2 circumferentially arranged around the periphery thereof at equal intervals, enabling multiple groups of players to play at the same time. This medal game device is configured to offer greater amusement and playability in that, in the case a player has inserted a medal M, in addition to receiving payout of the medal M by a pusher function, the player can also receive payment of a larger number of medals M by executing various games.

The medal game device of the present embodiment is provided with a medal launching device 8 for launching a medal M towards the rotating center unit 6 and the like corresponding to an operation by a player, a payout device for paying out a number of medals M equivalent to a prize to a player, and a main hopper 531 for collecting medals M that have dropped down after having been launched from each of the satellite portions 2 towards the rotating center unit 6. Accompanying the payout operation of medals M to the satellite portion 2 that has acquired a prize, in the case of having judged that the number of medals M in the main hopper 531 has fallen below a prescribed number of medals or has the risk of falling below a prescribed number of medals, this medal game device carries out the operation of automatically launching medals M from the medal launching device 8 in the satellite portions 2 other than the applicable satellite portion and collecting those medals M in the main hopper 531 to replenish the medals M for subsequent payoffs.

An explanation is first provided of the overall configuration of the medal game device. FIG. 1 illustrates an external view of the medal game device of the present embodiment. This medal game device is provided with the rotating center unit 6, the satellite portions 2, a pusher portion 3, a jackpot portion 4 and a turntable portion 5, and the rotating center unit 6 and the jackpot portion 4 are surrounded by the ten satellite portion 2. The jackpot portion 4 is configured to rotate by the same amount together with the turntable portion 5.

In addition, in this medal game device, a medal M can be fed towards the pusher portion 3 using a medal feed mechanism 14, and when the applicable medal M has passed a prescribed location such as a slit in the pusher portion 3, a video game image is displayed on a display portion 20 in coordination therewith. Moreover, this medal game device is able to launch and propel a medal M from the medal launching device 8 operated by a player towards various types of depictions provided on the rotating center unit 6 and the like.

A base that comprises the body of the medal game device is comprised of a base enclosure Ka, a console enclosure Kb and an upper enclosure Kc. The ten satellite portions 2 are arranged at equal intervals around the enclosure, and a console panel 10 protrudes from each of the satellite portions 2 (see FIG. 1). In addition, the upper enclosure Kc is formed of a translucent member to that the inside thereof is visible. Furthermore, a transparent or semi-transparent divider Kd and the like, for example, may be provided between the adjacent satellite portions 2 (see FIGS. 1 to 3).

The satellite portions 2 are comprised of a display portion 20, a payout port 21 and a tray 22. The display portion 2 is such that video game images are displayed by a satellite unit 200 illustrated in FIG. 4. The payout port 21 is a supply port to which medals M are paid out to a player at the applicable satellite portion 2. For example, simultaneous to depiction of a medal M being displayed on the display portion 20, a medal M is paid out from the payout port 21, thereby imparting to the player a sensation as if the medal M in the form of the image on the display portion 20 was paid out. The tray 22 allows the medals M paid out from the payout port 21 to accumulate therein and be removed by a player.

Figure 5:
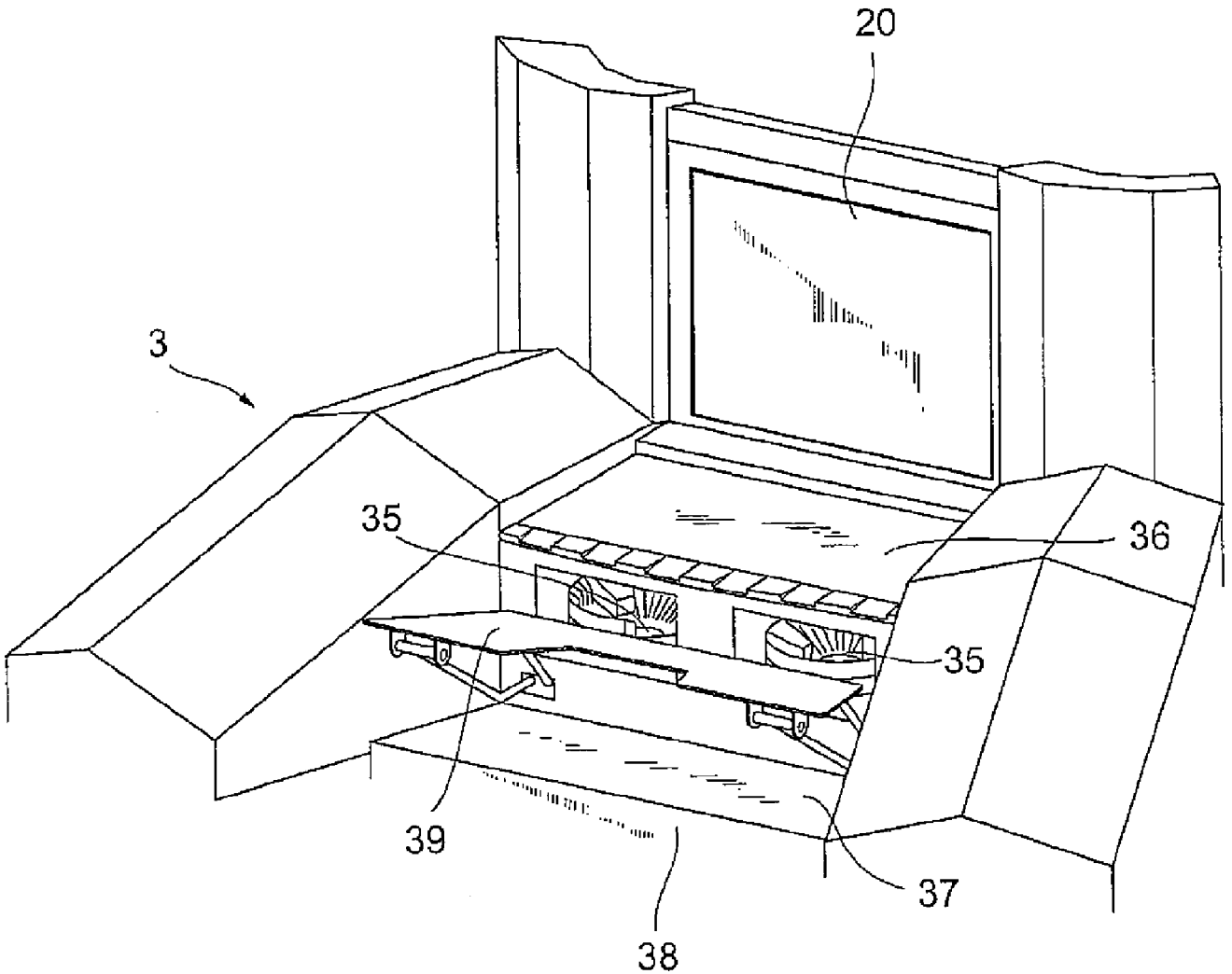
FIG. 5 is a perspective view of the periphery of a pusher portion 3 and a display portion 20 (before movement)
Figure 6:
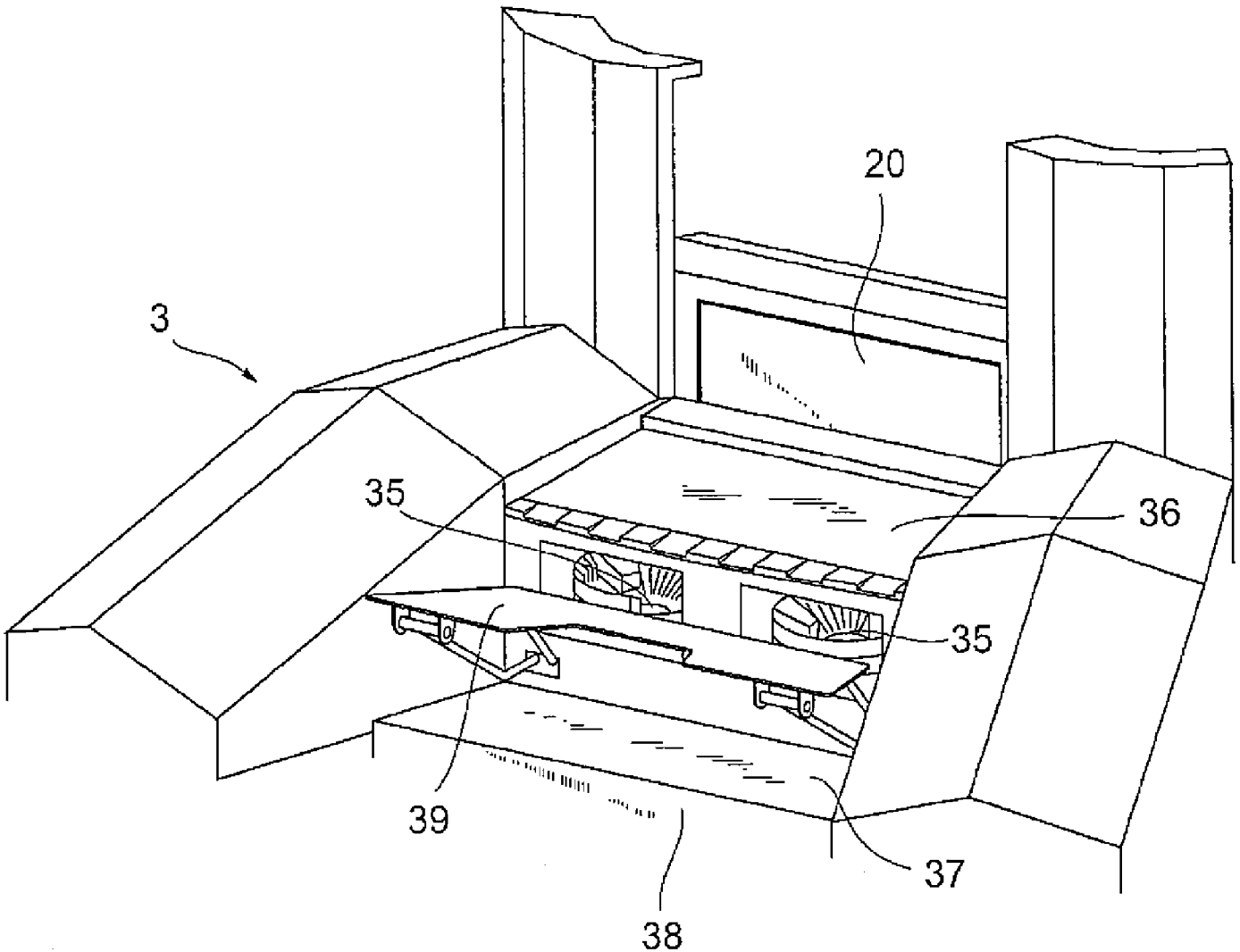
FIG. 6 is a perspective view of the periphery of a pusher portion 3 and a display portion 20 (after movement)

The display portion 20 is a monitor device such as a liquid crystal panel, and the display portion 20 is able to move up and down by a movement mechanism containing a drive motor 214 to be described later (see FIGS. 5 and 6). Although a movement mechanism for raising and lowering the display portion 20 is provided in the present embodiment, the manner of movement is not limited to vertical raising and lowering, but rather various other modes of movement are included. For example, movement may be in the form of the monitor device sliding to the left and right or rotating about a prescribed axis.

In addition, the medal feed mechanism 14, installed on a downward incline towards a leading end while able to move freely with medals M retained therein, is provided communicably with a medal inserting portion 12 in each of the satellite portions 2. This medal feed mechanism 14 is provided with a guide portion and a rail (not illustrated). The guide portion is connected with the lower side of the medal inserting portion 12, and is a member for receiving an inserted medal M and feeding this medal M to the rail. Furthermore, in this medal game device, two sets of the medal inserting portion 12 and the medal feed mechanism 14 are provided in each of the satellite portions 2, enabling two players to simultaneous play side by side (see FIG. 1).

Moreover, the pusher portion 3 is provided for each of the satellite portions 2. During normal game play, a medal game is played by using this pusher portion 3 as a target. The pusher portion 3 has a pusher table 36, in which two chuckers 35, having a plurality of types of slits provided in the periphery thereof (dish-shaped bodies: chuckers with slits), are arranged in a row, a medal table 37, provided extending towards a player from below the pusher table 36, and a medal collecting portion 38 opening towards a player of the medal table 37.

In addition, the pusher table 36 is provided able to reciprocate in the forward and backward directions as viewed from a player relative to the fixed medal table 37. Moreover, a guide plate (guide member) 39 installed in front of the chuckers 35 while leaving a space there between is fixed to the pusher table 36. This guide plate 39 is formed with a transparent member so that a player is able to see the medal table 37 below, extends from the pusher table 36 towards a player on an upward incline to the medal feed mechanism 14, and is driven forward and backward together with the pusher table 36.

Figure 33:
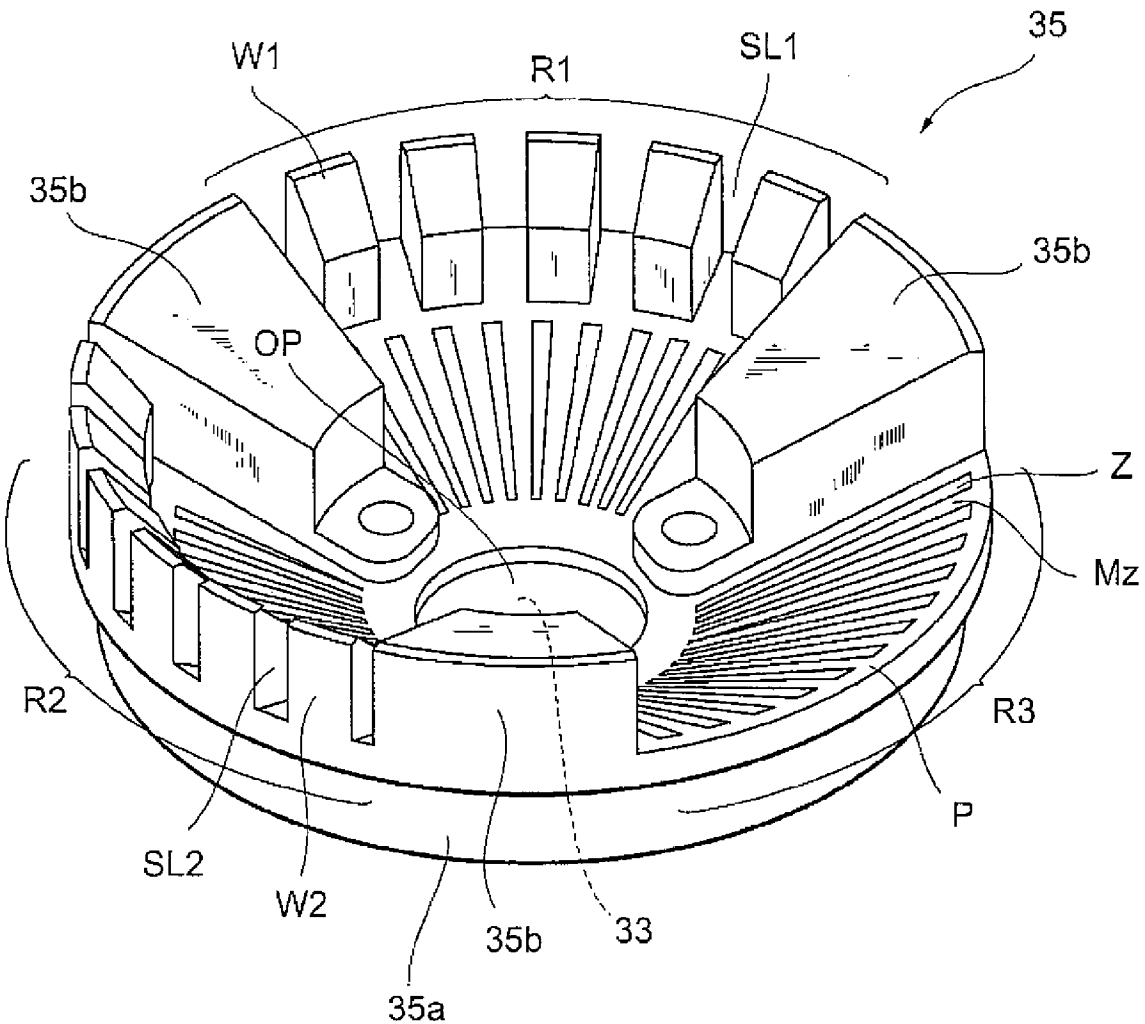
FIG. 33 is a perspective view illustrating a chucker 35.
Figure 34:
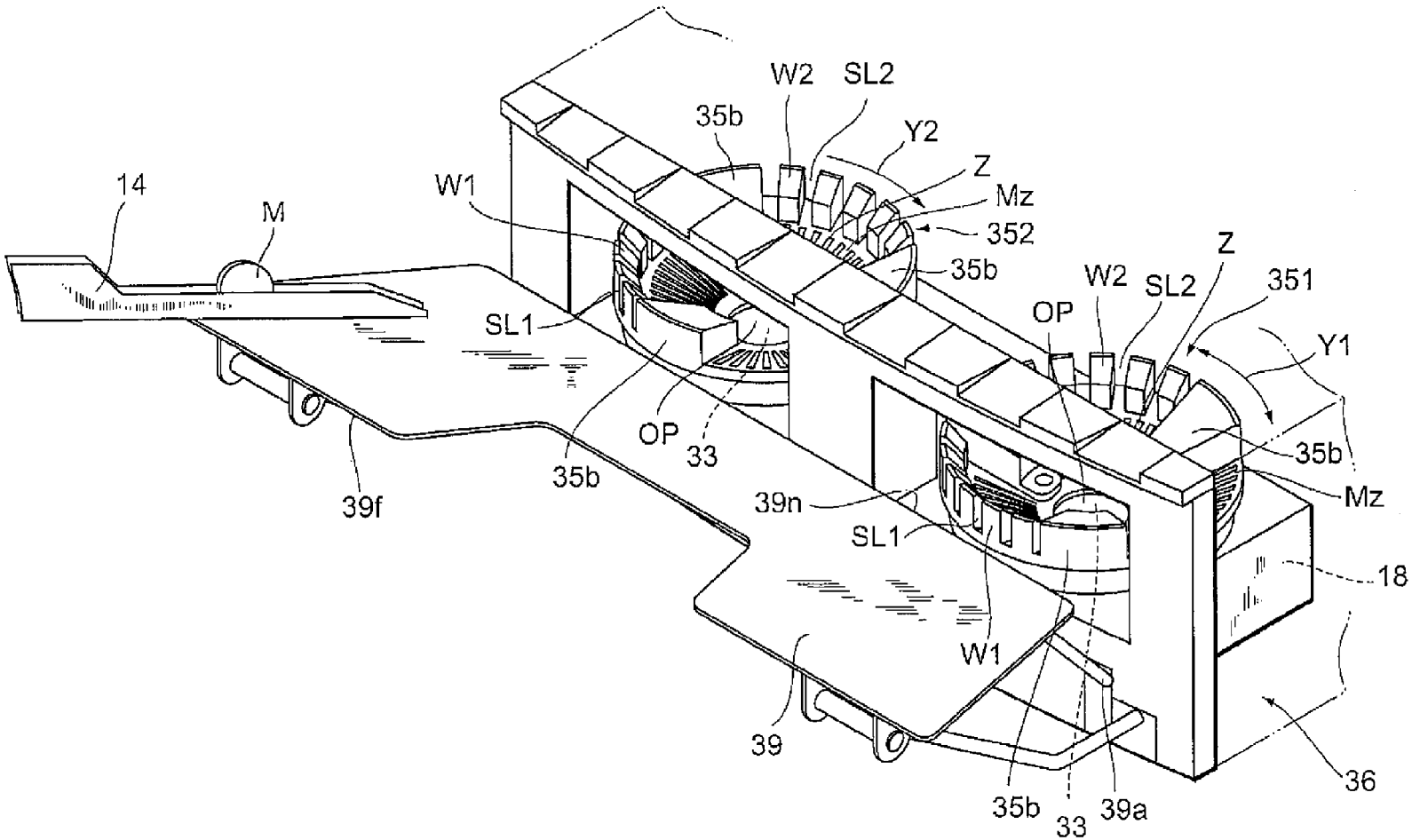
FIG. 34 is a perspective view (partial transparent view) illustrating the essential portion of the periphery of a chucker 35.

Here, FIG. 33 is a perspective view of one of the chuckers 35, while FIG. 34 is a perspective view (partial transparent view) illustrating the essential portion of the periphery of the chuckers 35. As illustrated in both drawings, in the chuckers 35, a disk-shaped bottom portion 35*a*, having the shape of a mortar and having an opening OP formed in the center thereof, is divided into a first region R1, a second region R2 and a third region R3. A radially arranged barrier portion 35*b* is provided between each of the regions R1, R2 and R3, and each of the regions R1, R2 and R3 is defined thereby. Furthermore, the chuckers 35 are installed in the pusher portion 36 so that the opening OP communicates with a winning prize port to be described later in the form of an opening 33.

A plurality of first walls W1 are provided upright in the first region R1 on a portion of the peripheral edge of the disk-shaped bottom portion 35*a* along the peripheral edge thereof, and first slits SL1, having a width (first width) larger than the thickness of a medal M, are formed between the adjacent first walls W1. In addition, a plurality of second walls W2 are provided upright in the second region R2 on another portion of the peripheral edge of the disk-shaped bottom portion 35*a* along the peripheral edge thereof, and second slits SL2, having a width (second width) larger than the width of the first slits Sl1, are formed between the adjacent second walls W2. Moreover, the third region R3 is not provided with obstacles in the manner of the first walls W1 and the second walls W2 described above, but rather has an open portion P, in which the entire third region R3 is opened towards the outside of the circumference of the chuckers 35, between two of the barrier portions 35*b*.

In addition, the first walls W1 and the second walls W2 generally have the shape of wedges, and have a tapered shape of a prescribed thickness along the radial direction of the disk-shaped bottom portion 35*a*. The first slits SL1 and the second slits SL2 have a prescribed thickness along the radial direction of the disk-shaped bottom portion 35*a* due to the first walls W1 and the second walls W2 formed in this manner. Moreover, a plurality of radially extending ridges Z is provided on the upper surface of the disk-shaped bottom portion 35*a* in each of the regions R1, R2 and R3. Furthermore, in the first region R1 and the second region R2, the ridges Z are provided corresponding to the first walls W1 and the second walls W2 inside the front surfaces thereof. A plurality of radially extending grooves Mz is formed between this plurality of ridges Z.

In addition, as illustrated in FIG. 34, the guide plate 39 has a shape such that a center portion thereof is lower than both ends, and the medal feed mechanisms 14 are positioned above both ends thereof. In addition, the guide plate 39 is such that the bottom walls of both ends thereof are supported by arm members so that an edge 39*f*, on the opposite side of an edge 39*n* opposing the chuckers 351 and 352 (both of which are chuckers with slits) on the side of the pusher table 36 as previously described, is higher than the edge 39*n*. Each arm member is connected to an inclining mechanism 39*a* embedded in the lower end of the pusher table 36, and the guide member 39 is held while able to be inclined by this inclining mechanism 39*a*. Moreover, a rotating mechanism 18 incorporating a motor and the like therein is provided inside the pusher table 36, and the chuckers 351 and 352 are each rotated (namely, moved to the left and right) independently centering about the opening OP by the rotating mechanism 18.

As will be described later, a medal M that has been inserted into the medal inserting portion 12 is sent out over the guide plate 39 through the medal feed mechanism 14, and from there rolls toward the chuckers 35. The chuckers 351 and 352 normally reciprocate to the left and right within a prescribed angular range in the reciprocating directions indicated with arrows Y1 in FIG. 34, while also moving forward and backward corresponding to the forward and backward reciprocating movement of the pusher portion 36. When a medal M passes through the first slits SL1 or the second slits SL2 of the chuckers 35 moving in this manner, the medal M immediately reaches the opening OP after passing over the upper surface of the disk-shaped bottom portion 35*a* in which the grooves Mz are formed, and from there drops into the opening 33 where it constitutes winning a prize by passing through the chuckers.

When a medal has constituted winning a prize by passing through the chuckers in this manner, a slot machine game to be described later begins. On the other hand, if a medal M is blocked by the first walls W1 or the second walls W2, and is obstructed from winning a prize by passing through the chuckers as a result of not passing through the first slits SL1 or the second slits SL2, the medal M is retained as a result of dropping onto the medal table 37 between the chuckers 351 and 352 and the guide plate 39. When medals M accumulate on the medal table 37, they are ultimately pushed out by the pusher table 36 and collected by dropping into the medal collecting portion 38.

The jackpot portion 4 operates during jackpot processing equivalent to a special prize or grand prize, and is comprised to allow payout of a prescribed number of medals M. More specifically, the jackpot portion 4 is provided with, for example, a large target 43 in the form of a boss character depicting a monster, or small targets 42 serving as guards (sentries) protecting the boss, as well as moving targets 41 depicting monstrous birds. The large target 43 is provided with an obstacle 44 based on a hand motif capable of being swung back and forth by a motor.

The turntable portion 5 rotates the jackpot portion 4 and is comprised to be able to collect launched medals M. A detailed description of the configuration thereof is provided hereinafter.

Figure 4:
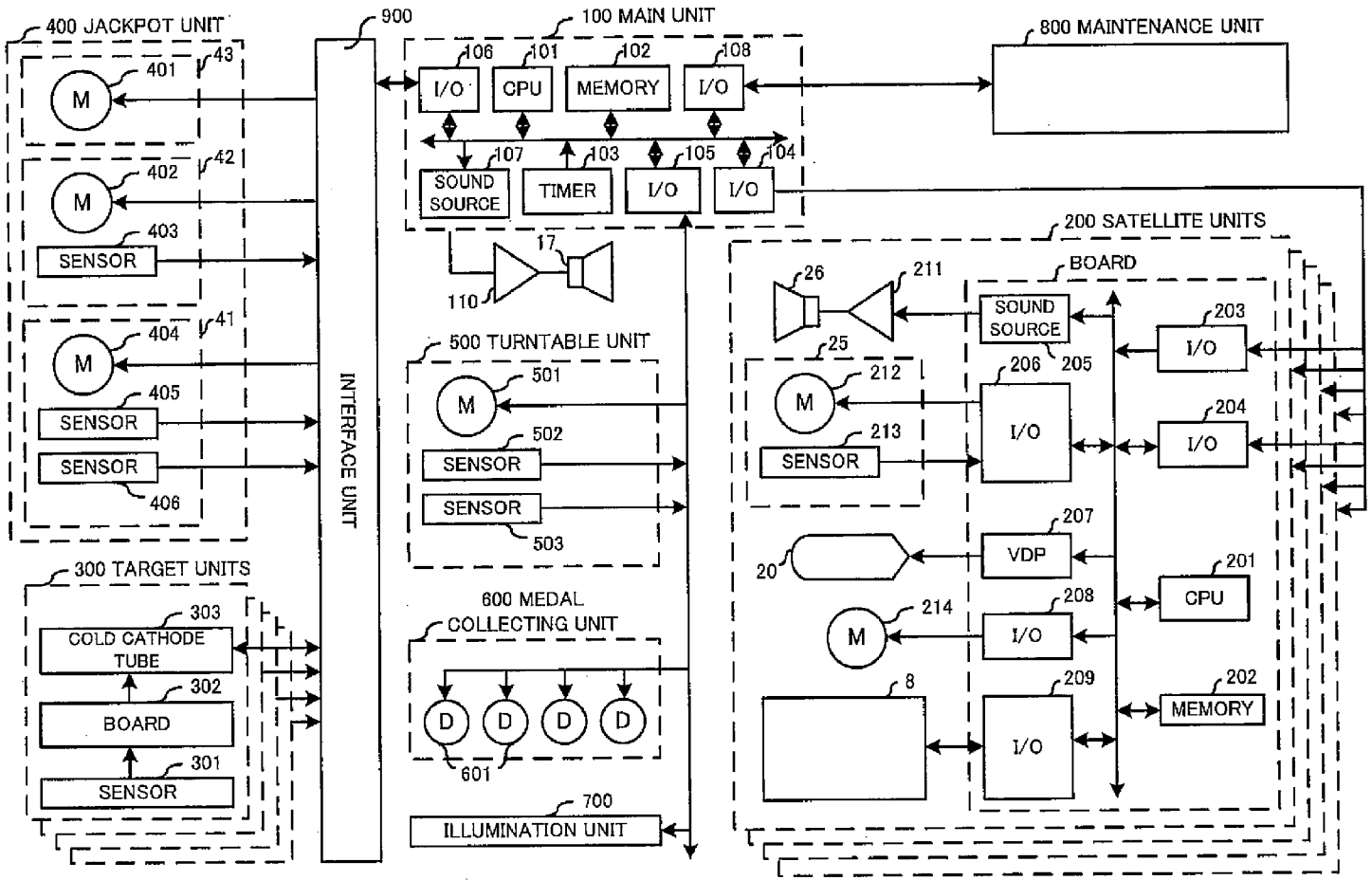
FIG. 4 is a schematic block diagram illustrating the functional configuration of a medal game device.
Figure 7:
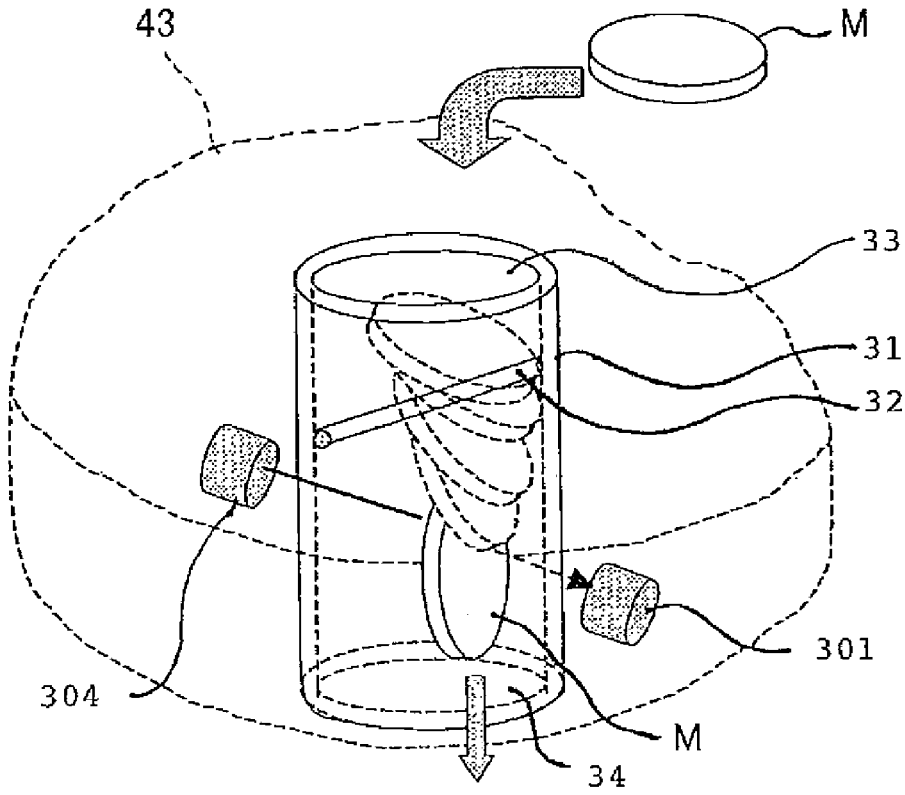
FIG. 7 is a drawing schematically illustrating an example of the structure of a device for detecting a medal at each target of a pusher portion and a jackpot portion.

Here, FIGS. 4 and 7 schematically illustrate an example of a structure for detecting medals in the pusher portion 3 or each of the targets 41 to 43 of the jackpot portion 4. For example, the large target 43 is covered with a molding depicting a character, and a cylindrical body 31 is installed in a central portion with the axial direction thereof facing in a generally vertical direction. A portion of the molding (such as a portion depicting an eye in the vicinity of the center) forms an indentation having a hole, and a medal M that has flown in from that portion is able to be guided to the cylindrical body 31 from this hole. In other words, if a medal M flies into the indentation (successfully hits the target), the medal M having hit the target can be detected as a result of passing through the cylindrical body 31.

The cylindrical body 31 allows medals M of a fixed diameter or less to pass through from the opening 33 (the "winning prize port" of the present invention in the case of the pusher portion 3) towards an opening 34, and a control rod 32 is attached crossing the central axis thereof. This control rod 32 is provided with the function of aligning the orientation of a medal M that dropped from the opening 33 within a fixed range. The cylindrical body 31 is formed from a material that allows the transmission of light such as a resin, and a light-emitting device 304 and a sensor 301 are provided below the control rod 32 to allow detection of the presence or absence of an obstacle. A detection line that connects the light-emitting device 304 and the sensor 301 is preferably set to form a right angle with the direction extending from the control rod 32.

As illustrated in FIG. 7, in the case of assuming the diameter of the smallest medal M as d1, the diameter of the largest medal M as d2 and the inner diameter of the cylindrical body 31 as D1, then d and D1 are defined so as to satisfy the relationship of $\sqrt{2}\square d1>D1>d2$. If the inner diameter of the cylindrical body 31 is smaller than the largest diameter of a launched medal M, then the medal M is unable to pass through the cylindrical body 31. In addition, in the case the detection line and the control rod 32 form a right angle, the size of a medal M such that the detection line is always blocked is when the angle formed between the surface of the medal M and the control rod 32 is smaller than 45 degrees. In the case both form an angle of 45 degrees, the above relationship is valid since the medal diameter multiplied by $\sqrt{2}$ is equal to the inner diameter of the cylindrical body 31. Distance D2 between the detection line according to sensor 301 and the control rod 32 is set to be generally the distance when control of orientation is completed to a degree that the surface of the medal is as close to perpendicular to the detection line as possible, and for example, is set to be generally equal to the diameter of the medal.

In the above configuration, in the case a medal M has entered the cylindrical body 31 and reached the position of the control rod 32, as long as the medal M is not parallel to the vertical direction, a portion of the medal M hits the control rod 32. When a portion of the medal M hits the control rod 32, the medal M rotates as indicated by the broken lines in FIG. 7. This force acts in a direction that causes the surface of the medal to face in the vertical direction. In addition, in the case the surface of the medal forms a large angle with the direction extending from the control rod 32, this force acts so as to hold that angle to less than 45 degrees. As a result, a medal M having a diameter that satisfies the above condition always crosses the detection line and the passage of the medal M is detected.

Figure 8:
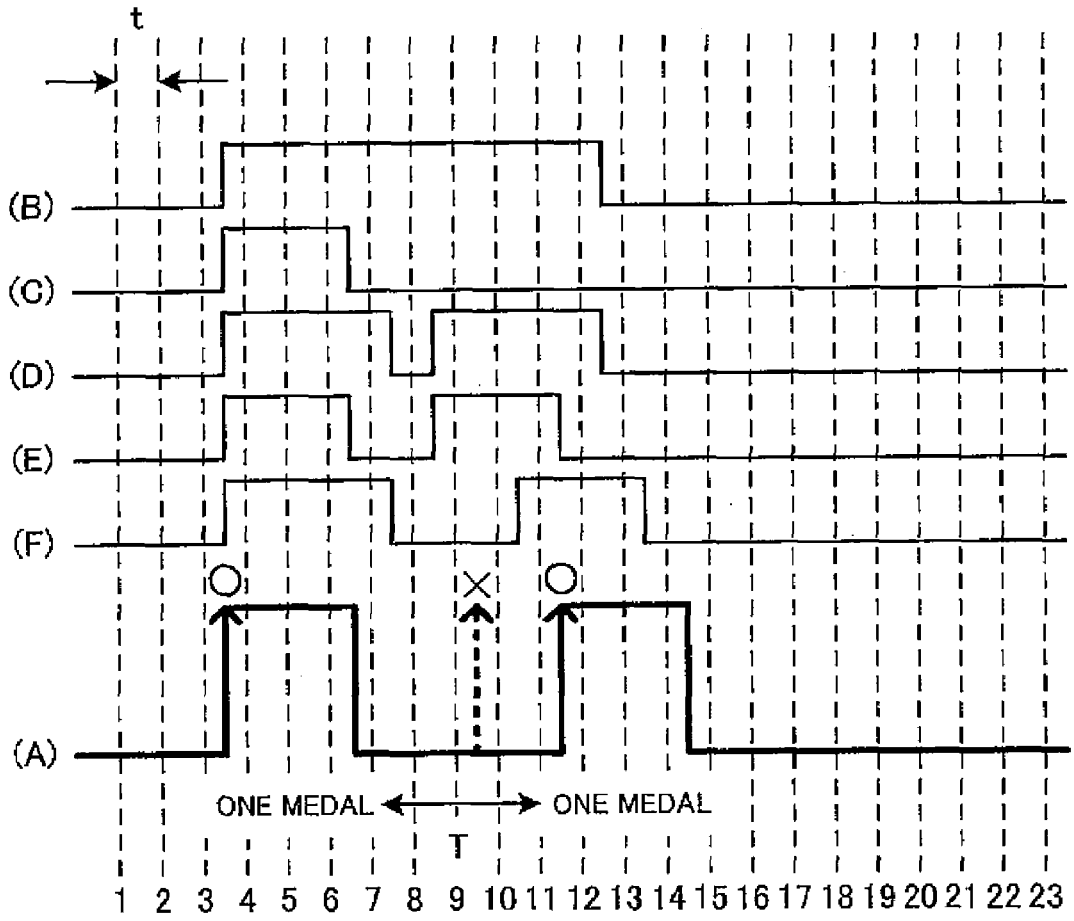
FIG. 8 is a timing chart for explaining a medal detection signal and a detection method.

FIG. 8 illustrates waveforms a detection signals output from the sensor 301 in (B) through (F). Waveforms (B) and (C) are illustrated to have a different pulse width due to a difference in the amount of time the detection line is blocked corresponding to the diameter and orientation of a medal M. Waveforms (D), (E) and (F) indicate cases of multiple pulses being generated as a result of the same medal M crossing the detection line multiple times within a short time period in the case of the medal M being subjected to a rotation force by the control rod 32.

In a detection circuit of the present embodiment (such as that present in a board 302 of FIG. 4), a single medal M is judged to have passed at the point the detection signal changes from a steady state (L level) to an H level, and the circuit is configured so as to enable subsequent detection of the passage of a medal M to be prohibited for a fixed amount of time. For example, if the status of a detection signal is detected at a prescribed sampling interval (such as about every 2 ms), and an H level is detected for a fixed amount of time (for example, 3 samplings) following the detection of an L level for a fixed amount of time (for example, 3 samplings), a single medal M is judged to have passed after which detection of status is prohibited for an amount of time (for example, about 10 ms) sufficient for being able to ignore the second pulse in waveforms (D) to (F). As illustrated in waveform (A) of FIG. 8, the detection circuit may also be configured to be able detect the passage of a medal M with a pulse rise, and then prohibit detection of a pulse rise for a fixed amount of time T following the pulse rise. As a result of employing this configuration, passage of medals M can be detected accurately and inexpensively with only a single sensor. Furthermore, it goes without saying that the passage of medals M may also be detected by providing two or more sensors.

The medal launching device 8 is a device operated by a player during a shooting game to launch medals M one at a time towards the targets 41 to 43, the rotating speed of a roller drive motor 823 can be variably controlled corresponding to a distance to a target being aimed at by the player, and the orientation of a launching rail 831 (direction in which medals are launched) can be freely made to face in any upward, downward, leftward or rightward direction corresponding to the operation of a lever 23 by the player. When a shooting mode begins, the roller drive motor 823 of the medal launching device 8 operates, and a medal M can be launched from the medal launching device 8. At this time, when the player presses a launch button 842, a medal M is launched from the launching rail towards a target. The roller drive motor 823 of the medal launching device 8 stops after a time limit and the like has elapsed, thereby ending the shooting game. In addition, the medal launching device 8 is provided with a medal supply unit 81 such as a mini-hopper 811, and this medal supply unit 81 is automatically replenished with medals to a predetermined number of medals to be launched successively.

The following provides a detailed explanation of one embodiment of the medal launching device 8.

Figure 9:
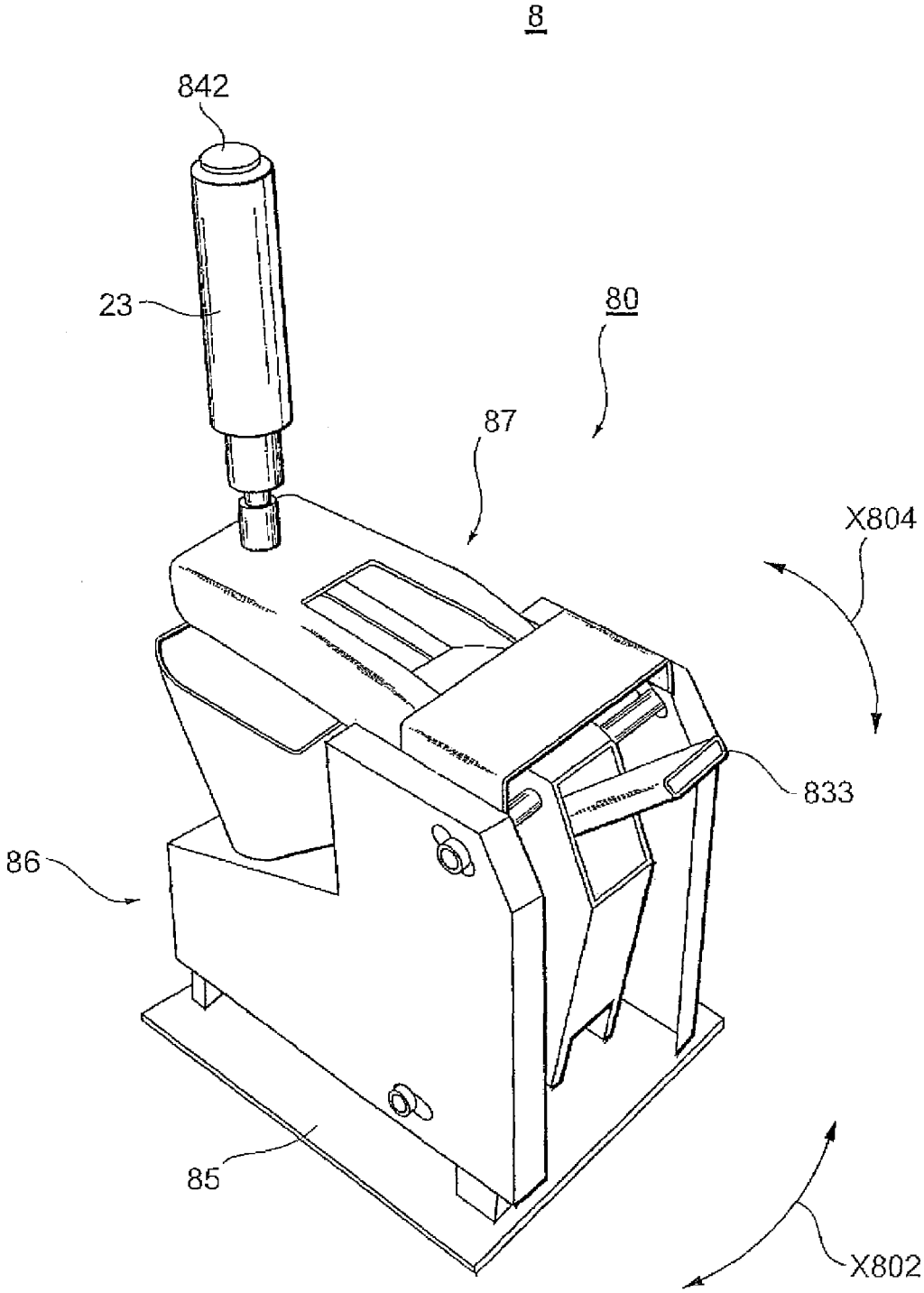
FIG. 9 is a perspective view as viewed from the side of a medal launching port 833 of a medal launching device 8.
Figure 10:
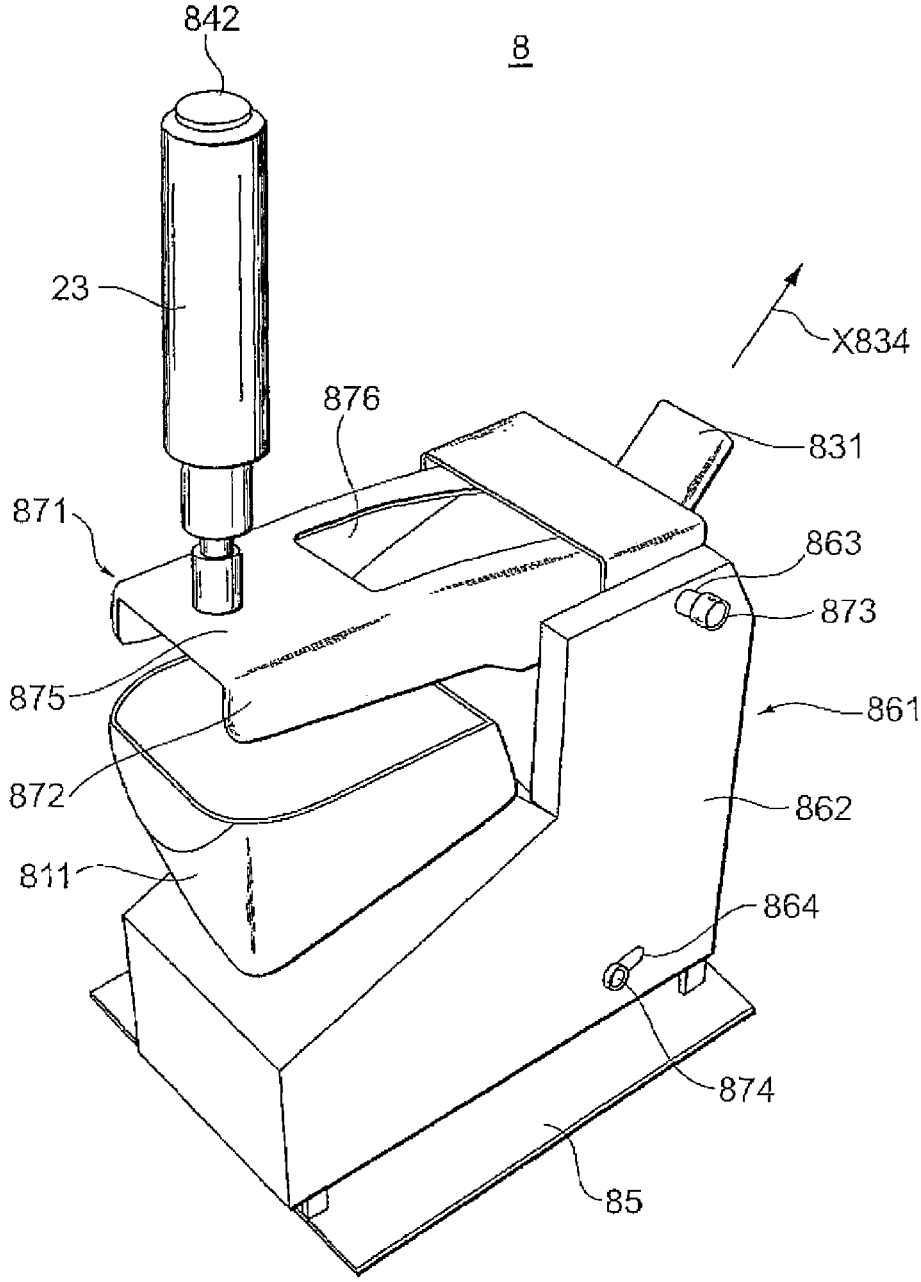
FIG. 10 is a perspective view as viewed from in front of (from the viewpoint of a player) a medal launching device 8.
Figure 11:
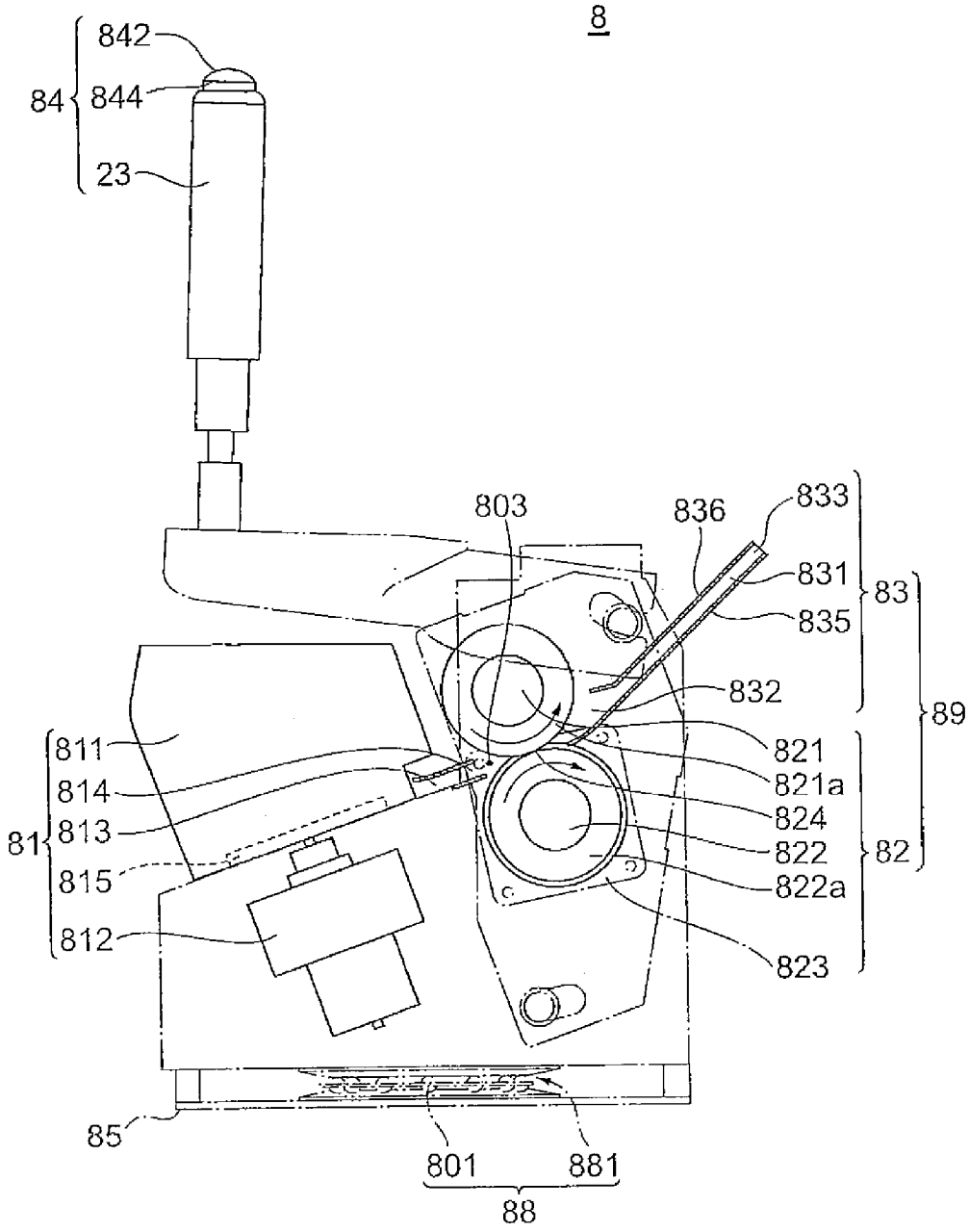
FIG. 11 is a semi-transparent view of the right side of a medal launching device 8.

FIGS. 9 and 10 are perspective views of the medal launching device 8 in the present embodiment. FIG. 9 is a perspective view as viewed from the side of a medal launching port 833 from which medals are launched, while FIG. 10 is a perspective view as viewed from the front (side of a player). In addition, FIG. 11 is a semi-transparent view of the right side of the medal launching device 8 in the present embodiment.

The medal launching device 8 includes the medal supply unit 81, capable of storing a plurality of medals M and supplying the medals M by removing one at a time, and a medal launching drive unit 89 that launches the medals M along the launching rail 831 by imparting a takeoff force to the medals M supplied from the medal supply unit 81 by applying force thereto. In addition, the medal supply unit 81 and the medal launching drive unit 89 are provided on an operating table 80 axially supported by a supporting unit 88 to as to be able to rock on a pedestal 85. Moreover, the medal launching drive unit 89 includes a medal propelling unit 82 that imparts takeoff force to a medal M by applying force thereto, and a medal ejection unit 83 comprising the launching rail 831. The medal ejection unit 83 is at least configured to rock freely in any upward, downward, leftward or rightward direction relative to the pedestal 85. An operating unit 84 is provided for operating the medal launching device 8, and allows the direction in which medals M are launched (orientation of the launching rail 831) to face in any arbitrary direction.

In the present embodiment, the operating table 80 includes a first operating table portion 86 containing the medal supply unit 81, and a second operating table portion 87 containing the medal launching drive unit 89 and the operating unit 84. The first operating table portion 86 is connected to the pedestal 85 by the supporting unit 88, and is axially supported while being able to rock in the leftward and rightward directions (arrow X802) towards the game field by a support shaft 801 generally perpendicular to the pedestal 85. In addition, the second operating table portion 87 is able to rock in the upward and downward directions (arrow X804) relative to the first operating table portion 86 centering on a rotation central axis 803 generally horizontal to the pedestal 85 and generally perpendicular to the lengthwise direction of the launching rail 831 of the of the medal ejection unit 83 (direction in which medals are launched: arrow X834).

The medal supply unit 81 of the first operating table portion 86 contains the mini-hopper 811 capable of holding a large number of medals M, and a medal supply motor 812 that supplies the medals M from the mini-hopper 811 to the medal propelling unit 82. The mini-hopper 811 is removably placed on upper portion on the side of the player of an enclosure 861 of the first operating table portion 86. In addition, the medal supply motor 812 is fixed on the inside of the enclosure 861. Moreover, a rotating disk 815 is provided in contact with the bottom of the mini-hopper 811. A large number of holes (not illustrated) capable of freely engaging the medals M are provided in the rotating disk 815 in the peripheral direction, and when the rotating disk 815 is driven by the medal supply motor 812, medals M that have engaged in the holes of the rotating disk 815 are sent in one at a time to a medal guide 813, the medals M are pushed out by the expelling force of the rotating disk 815, and the medals M are supplied to the medal propelling unit 82 from a medal supply port 814 on an end of the medal guide 813.

In addition, the medal propelling unit 82, the medal ejection unit 83 and the operating unit 84 are fixed on an enclosure 871 of the second operating table portion 87, and are able to integrally rock centering on the central rotation axis 803. At this time, when the central rotation axis 803 is positioned in the vicinity of the outlet of the medal supply port 814 of the medal supply unit 81, medals M can be smoothly supplied to the medal propelling unit 82, thereby making this preferable. In addition, guide holes 863 and 864 provided in left and right sidewalls 862 of the enclosure 861 of the first operating table portion 86 engage with claws 873 and 874 protruding from the left and right sidewalls 872 of the enclosure 871 of the second operating table portion 87 to limit the range of movement of the second operating table portion 87.

The medal propelling unit 82 is provided with a unit that forcibly imparts a takeoff force to a medal M supplied from the medal supply unit 81, and the medal M to which takeoff force has been applied is sent to the medal ejection unit 83. In the present embodiment, a rotating roller 822 is driven by the roller drive motor 823, and takeoff force is imparted to a medal M interposed between two rotating rollers 821 and 822 due to the rotation thereof. At this time, the central rotation axes of the rotating rollers 821 and 822 are facing in a direction generally parallel to the central rotation axis 803, and the rotating rollers 821 and 822 are provided facing each other so as to be respectively located above and below the medal feeding surface of the medal guide 813 in the vicinity of the central rotation axis 803.

In addition, outer peripheral portions 821*a* and 822*a* of the rotating rollers 821 and 822 are comprised of a soft rubber such as urethane. Each rotating roller 821 and 822 is installed at a location at which the distance between the central rotation axes is slightly smaller than the sum of the radii of each rotating roller 821 and 822, and the outer peripheral portions 821*a* and 822*a* are preferably in contact for a prescribed length in the circumferential direction. As a result, the upper and lower rotating rollers 821 and 822 are driven by the roller drive motor 823 at mutually the same rotating speed but in opposite directions, and a medal M interposed between the rotating rollers 821 and 822 is imparted with adequate takeoff force. Furthermore, in the present embodiment, a stepping motor is used for the roller drive motor 823 and the motor speed is controlled.

In the medal ejection unit 83, a medal M propelled by the medal propelling unit 82 travels within the launching rail 831 and is launched from the medal launching port 833 towards the front on an upward incline (arrow X834). The launching rail 831 is in the form of a flat tube and allows a medal M to travel through the inside thereof in the lengthwise direction thereof (direction of arrow X834). One end of the launching rail 831 (incident end 832) is located in the vicinity of the outlet of medals M propelled by the rotating rollers 821 and 822, with a lower surface 835 protruding father than an upper surface 836, and is formed to facilitate entry of medals M into the launching rail 831 as a result of spreading out in the shape of a trumpet towards the end portion thereof.

Furthermore, if the medal supply port 814 of the medal supply unit 81, the central rotation axis 803, a contact surface 824 of the rotating rollers 821 and 822, and the incident end 832 of the launching rail 831 are positioned generally linearly from the side of each player towards the back, transport and ejection of medals M can be carried out smoothly, thereby making this preferable.

The operating unit 84 is provided with the joystick-shaped lever 23 functioning as a gripping unit, and the launch button 842 serving as an input unit for inputting instructions for launching a medal M from the medal launching device 8. A player is able to determine a launching direction of the medal M by swinging the medal launching port 833 in any upward, downward, leftward or rightward direction by gripping the lever 23 and operating the medal launching device 8. In the present embodiment, the lever 23 is provided generally perpendicular to an upper surface 875 of the enclosure 871 of the second operating table portion 87, and the launch button 842 is installed on the top of the lever 23. Moreover, at least a portion of the launch button 842 is comprised of a translucent or semi-translucent member, thereby making it possible to visualize emission of light from an LED or other light-emitting device 844 embedded within or below the button.

In addition, a medal replenishing hole 876 penetrating the enclosure 871 in the vertical direction is provided generally in the center of the upper portion of the enclosure 871 of the second operating table portion 87, and a medal M sent out from a satellite hopper 25 and transported by a first transport path 274 to be described later is replenished in a pool container 811 of the medal supply unit 81 by means of a medal transport unit 27. This medal replenishing hole 876 is arranged in an upper portion extending from the support shaft 801 and allows medals M to reliably enter the pool container 811 even during rocking of the operating table 80.

Furthermore, each of the satellite portions 2 has a medal tray 276 (collecting unit) provided on the lower side of the pusher section 3, enabling medals M that have dropped from the side or behind the pusher portion 3 as well as medals M that have been launched from the medal launching device 8 to be collected therein. Medals collected by the medal tray 276 are sent to the satellite hopper 25. This satellite hopper 25 functions as a medal pool unit for housing the collected medals M.

In addition, medals M that have been sent out from the satellite hopper 25 are transported to the medal launching device 8 through a medal guide 271 and a transport rail 272 functioning as a medal transport unit. The transport rail 272 has a switching flap 273 at an intermediate location in the transport path thereof, and the medal M transport path is switched between a path by which medals M are transported to the medal launching device 8 (first transport path 274) and a path by which medals M are paid out to the game field in order to play a medal pusher game (second transport path 275) by switching the switching flap 273 with a payout destination allocation solenoid not illustrated.

Moreover, the medal launching device 8 is fixed to the console panel 10 by the pedestal 85. In addition, the supporting unit 88 axially supporting the pedestal 85 and the first operating table portion 86 is provided with a locking mechanism 881. This locking mechanism 881 prevents the first operating table portion 86 from rocking by locking the supporting unit 88 during normal game play, and when in the shooting game mode, locking of the supporting unit 88 is released allowing the first operating table portion 86 to rock.

Next, an explanation is provided of each of the targets 41 to 43. As previously described, each of the targets 41 to 43 is configured to serve as targets when a medal M is aimed at a target in a shooting game or when allowed to pass through a prescribed hole and the like. Furthermore, each of the targets 41 to 43 is arranged at locations having a different distance and/or height from the medal launching device.

The moving target (bird mechanism) 41 is a target depicting a monstrous bird arranged behind the display portion 20 (on the side of the rotating center unit 6) in each of the satellite portions 2, and is supported so as to swing up, down, left and right in the manner of a flying bird by a swinging drive mechanism containing a support rod 411. The mouth of this moving target 41 can be opened and closed, a medal chucker (winning prize port) is provided inside the mouth, and whether or not a medal has entered the mouth of the moving target 41 can be detected. In addition, light-emitting devices can be embedded in the eyes and the wings can be made to flap to enhance the presentation.

Figure 3:
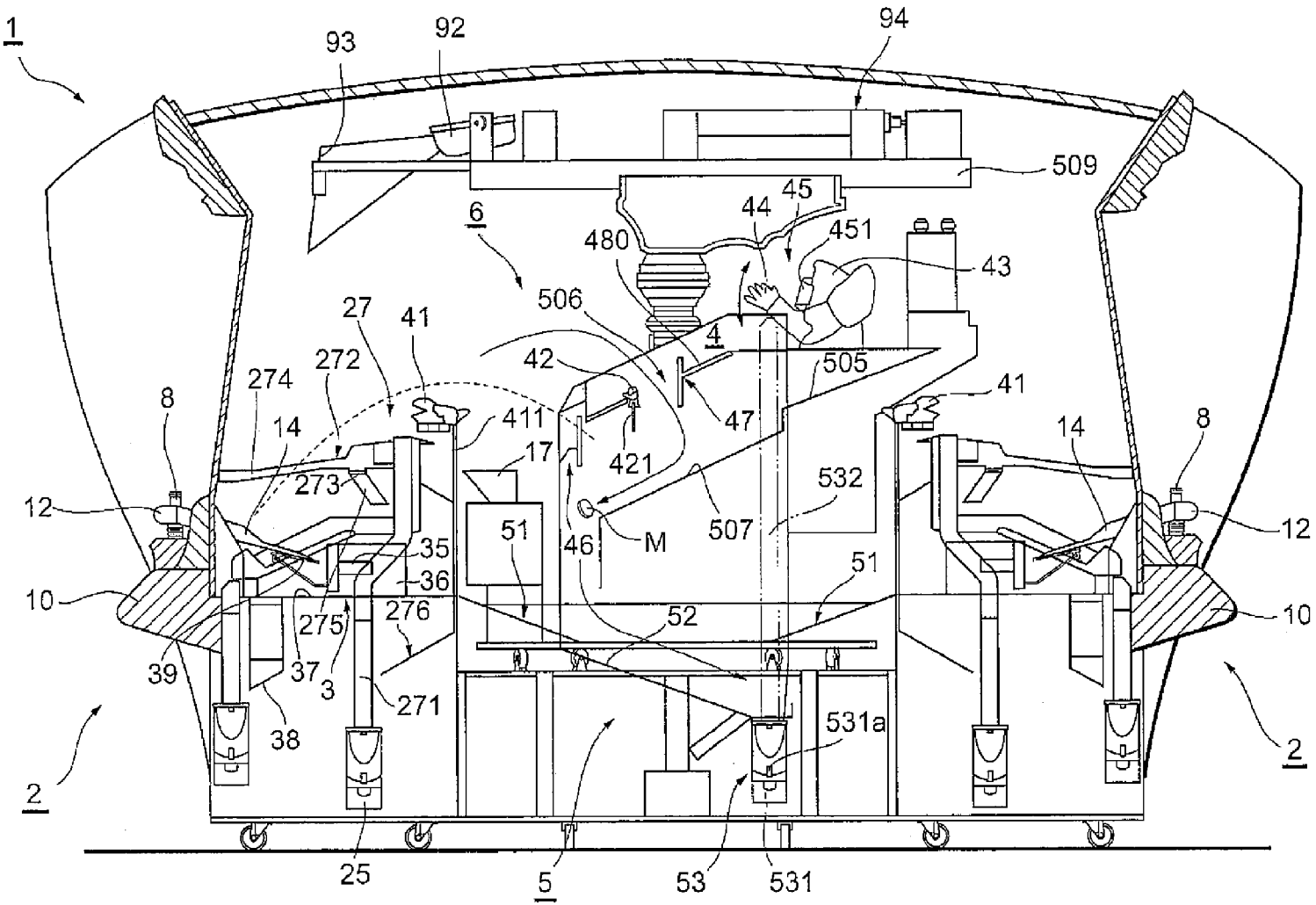
FIG. 3 is a cross-sectional view illustrating the internal structure of a medal game device.

The small targets 42 and the large target 43 are respectively provided on the jackpot portion 4 (see FIG. 3). Among these, the small targets 42 are comprised using as a gimmick the image of four guards horizontally arranged in a row, for example. These four small targets 42, for example, are comprised so as to individually fall backward when hit by a launched medal M together with rising up all at once upon completion of a shooting game using the medal launching device 8.

Figure 14:
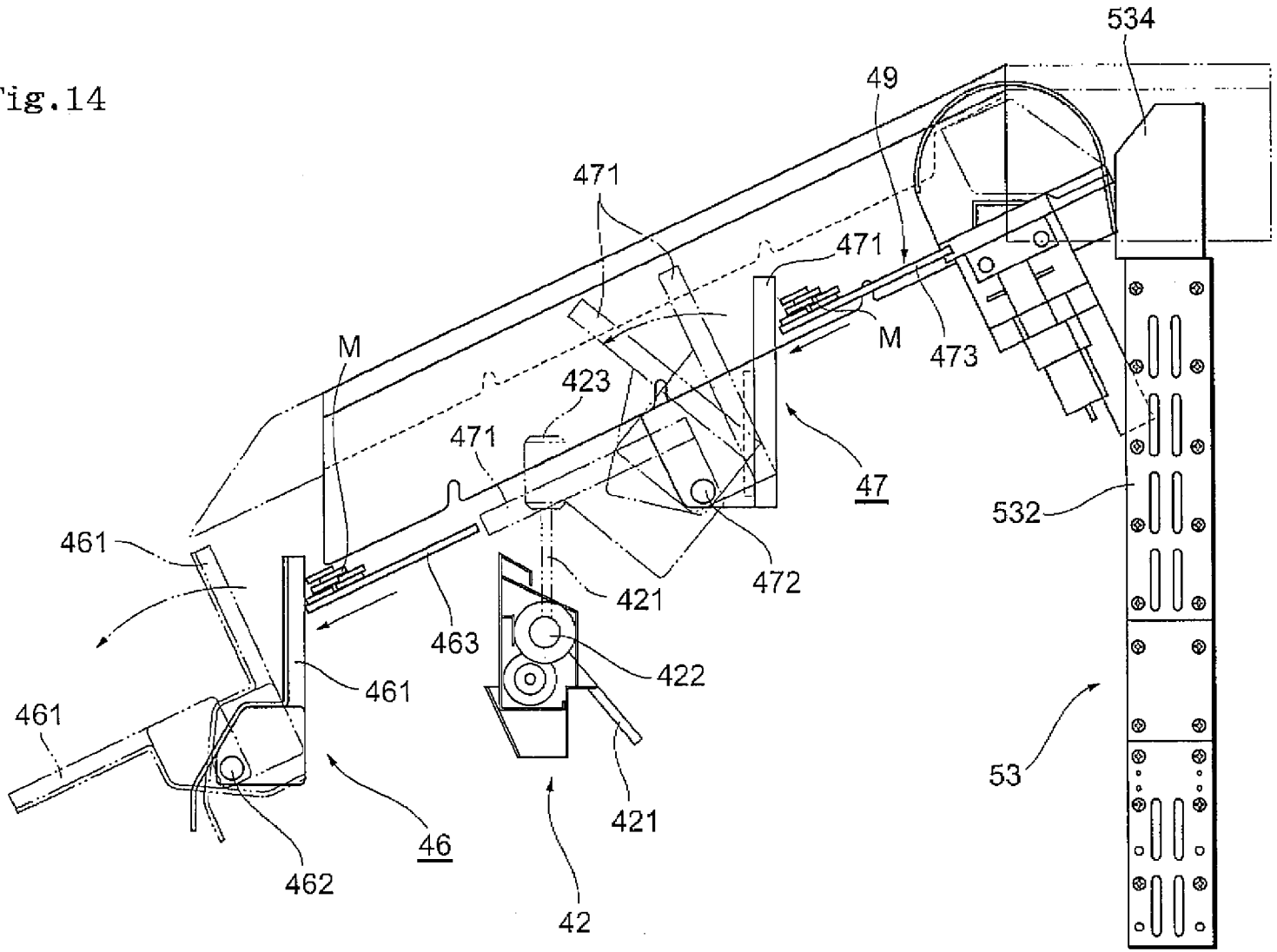
FIG. 14 is a drawing as viewed from the side illustrating one example of a mechanism for accumulating and paying out medals in a jackpot portion.
Figure 15:
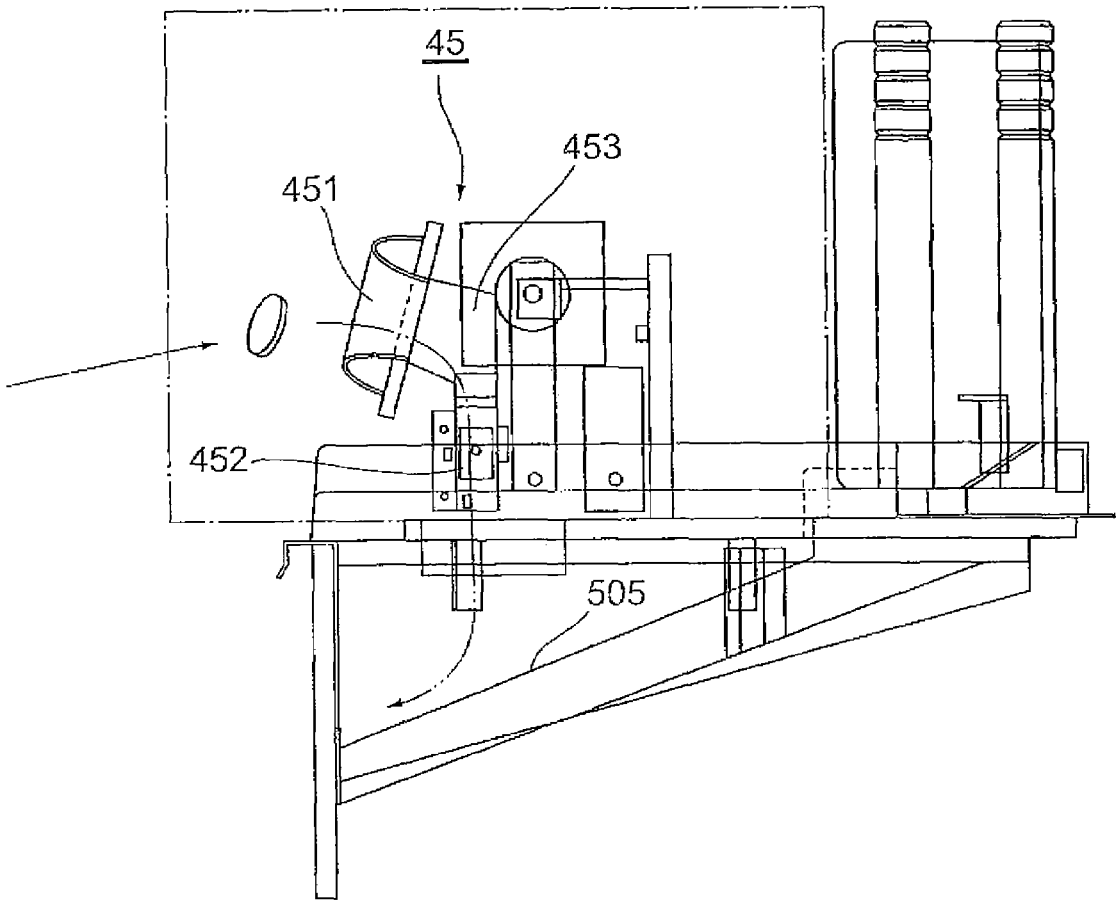
FIG. 15 is a drawing illustrating the structure of a winning prize port and chucker of a large target.

In providing a brief indication of a specific example of the small targets 42, a rotating shaft 422 connected to a motor through a gear is provided, and four support rods 421 provided with mounting pedestals 423 for the small targets 42 are respectively rotatably attached to the rotating shaft 422 (see FIGS. 3 and 14). Thus, when a medal M is launched and hits one of the small targets 42, the small target 42 that has been hit falls backward together with the mounting pedestal 423 and the support rod 421 centering on the rotating shaft 422.

Which of the small targets 42 remains upright and which have fallen down can be determined by detecting the position of a detection tab and the like integrally attached to the support rod 421, for example, with a sensor. In addition, four cams, for example, are integrally arranged at equal intervals on the rotating shaft 422, and pins able to catch on the small targets 42 or support rods 421 are attached to the cams. As a result of driving the motor causing the rotating shaft 422 to rotate forward through the gear, each cam and pin rotates integrally enabling the four small targets 42 to be raised up all at once by using the pins.

Once the small targets 42 have been raised up in this manner, the motor and gear are reversed to rotate the rotating shaft 422 backward and retract the pins from the small targets 42 and the support rods 421. As a result, the small targets 42 are free to fall backward when hit by a medal M. Furthermore, the rotating shaft 422 can be made to continue to rotate backward for nearly one revolution to that the four small targets 42 fall backward all at once using each of the pins.

The large target 43 is set as the main target of a shooting game after the small targets 42 described above (see FIG. 3).

As an example thereof, the large target is comprised using as a gimmick an image depicting a character in the form of leader of monsters in the present embodiment. In addition, the large target 43 is provided with a chucker 45, provided with a winning prize port 451 enabling passage of a launched medal M, and a sensor 452 for detecting the passage of a medal M through the winning prize port 451, and the obstacle 44 that impedes the entrance of medals M into the chucker 45 by performing a prescribed operation (see FIG. 15).

An example of the configuration of the obstacle 44 is described below. Namely, a cam 442 driven by a motor 441 is provided, and a cam follower 443 is provided that is driven by this cam 442 (see FIG. 16). Although not illustrated in detail, the cam follower 443 employs a structure such that a force is applied to this cam follower 443 so as to contact the cam surface of the cam 442 or the cam follower 443 engages with a cam groove in the cam 442, and pivots centering on a fulcrum 444 while being driven by the cam 442.

In addition, this cam follower 443 is integrated with a support plate 445, and the obstacle 44 depicting an arm of a monster, for example, is attached to this supporting plate 445. The end portion (for example, a hand portion) of the operating portion of the obstacle 44 is formed so as to be positioned in front of the winning prize port 451 (see FIG. 3, for example). Thus, when the cam follower 443 and the support plate 445 swing back and forth, the obstacle 44 also swings in the same manner thereof, and the end portion thereof (hand portion) is moved up and down to cyclically impede medals M from entering the winning prize port 451.

In addition, in the present embodiment, the obstacle 44 is provided on both sides of the winning prize port 451, and a gimmick is created such that the large target 43 depicting a monster is shaking his arms up and down (see FIG. 3, for example). In this case, although the left and right obstacles 44 can be made to simultaneously move up and down in phase, in the present embodiment, the phase is shifted by half a cycle so that the pair of left and right operating portions mutually operate in opposite directions simultaneously. The obstacles 44 moving in this manner improves the entertainment value of the game by suitably increasing the degree of difficulty of hitting the target in a shooting game. Furthermore, in the case of arranging the pair of left and right obstacles 44 in this manner, the end portions thereof (hand portions) may be made to move up and down without mutually interfering by ensuring that they do not overlap, or the left and right obstacles 44 may be made to move up and down by arranging so that both arms are in front of and in back of each other so that the end portions thereof overlap.

Moreover, the chucker 45 of the large target 43 is configured, for example, in the manner described below. First, the winning prize port 451 is formed from a resin molding, for example, so as to be in the form of a nozzle that becomes narrower towards the back (see FIG. 15). A medal M that has been shot into this winning prize port 451 proceeds downward after passing through a guide path 453 formed in the back of the winning prize port 451 after which it drops onto an inclined path 505 and is guided to an inclined path 507 continuing there from (see FIG. 3). In addition, the sensor 452 is provided at an intermediate location in the guide path 453 for detecting passage of a medal M, enabling the number of medals M shot into the winning prize port 451 to be counted (see FIG. 15). This type of chucker 45 is provided in the form of a gimmick such as a central eye of the monster as described above (see FIG. 1, for example). In addition, decorative illumination may also be provided as necessary in the winning prize port 451 of the chucker 45, for example.

Continuing, an explanation is provided of a mechanism for storing and paying out medals in the jackpot portion 4 (see FIG. 14, for example). In the present embodiment, a gate portion having a bilevel structure comprised of lower gate portion 46 and an upper gate portion 47 is used as a mechanism for storing and paying out medals in the jackpot portion 4.

The lower gate portion 46 is a mechanism for storing and paying out medals provided in front of the small targets 42 described above (see FIG. 14, for example). A lower gate 461 comprising the lower gate portion 46 is provided so as to be able to rotate in the forward and backward directions centering on a shaft 462, and stores medals M when upright while paying out the stored medals M all at once when fallen forward. There are no particular limitations on the configuration for allowing the lower gate 461 to operate in this manner, and although a motor and gear and the like may be used, in the present embodiment, force is applied towards the back of the lower gate 461 (in the direction of the small targets 42) using a helical extension spring not illustrated so that the lower gate 461 is normally upright (see FIG. 14). In this case, a spring capable of withstanding the weight of the stored medals M is used for the helical extension spring to prevent the lower gate 461 from rotating simply by storing the medals M.

In addition, a slidable lower gate pusher 463 is provided along the incline of an inclined surface over which medals M flow in the jackpot portion 4 behind the lower gate 461 (in front of the lower targets 42) (see FIG. 14). In the present embodiment, this lower gate pusher 463 is allowed to slide towards the front and push into the lower gate 461 at the end thereof, causing the lower gate 461 to fall forward and pay out medals M stored therein all at once. After the medals M have been paid out, if the lower gate pusher 463 is allowed to slide backward and return to its original position, the lower gate 461 pulled on by the helical extension spring again returns to the upright state accompanying this sliding of the lower gate pusher 463 (see FIG. 14).

Furthermore, there are no particular limitations on the mechanism for sliding the lower gate pusher 463, and although not illustrated in the drawings, a motor and guide, for example, are used in the present embodiment.

The upper gate portion 47 is a mechanism for storing and paying out medals that is provided behind the small targets 42 and in front of the large target 43 (see FIG. 14, for example). An upper gate 471 comprising the upper gate portion 47 is provided so as to be able to rotate forward and backward centering on a shaft 472, and stores medals M when upright while paying out the stored medals M all at once when fallen forward. There are no particular limitations on the configuration for allowing the upper gate 471 to operate in this manner, and although a motor and gear and the like may be used, in the present embodiment, force is applied towards the back of the upper gate 471 (in the direction of the large target 43) using a helical extension spring not illustrated so that the upper gate 471 is normally upright (see FIG. 14). In this case, a spring capable of withstanding the weight of the stored medals M is used for the helical extension spring to prevent the upper gate 471 from rotating simply by storing the medals M.

In addition, a slidable upper gate pusher 473 is provided along the incline of an inclined surface over which medals M flow in the jackpot portion 4 behind the upper gate 471 (in front of the large target 43) (see FIG. 14). In the present embodiment, this upper gate pusher 473 is allowed to slide towards the front and push into the upper gate 471 at the end thereof, causing the upper gate 471 to fall forward and pay out medals M stored therein all at once. After the medals M have been paid out, if the upper gate pusher 473 is allowed to slide backward and return to its original position, the upper gate 471 pulled on by the helical extension spring again returns to the upright state accompanying this sliding of the upper gate pusher 473 (see FIG. 14).

Furthermore, there are no particular limitations on the mechanism for sliding the upper gate pusher 473, and although not illustrated in the drawings, a motor and guide, for example, are used in the present embodiment. Incidentally, in the present embodiment, the upper gate pusher 473 is operated and the upper gate 471 is made to fall forward only when all of the four small targets 42 (and the support rods 421 supporting them) have fallen backward and retracted (see FIG. 14).

In the present embodiment, in the case fixed conditions for the targets 42 and 43 have been satisfied in a shooting game, the operation is such that medals M stored in the lower gate portion 46 and the upper gate portion 47 are collectively paid out to a player. Although various conditions can be set for the fixed conditions referred to here, an example of such a condition consists of shooting at least a predetermined number of medals M into the chucker 45 of the large target 43 described above within a prescribed amount of time.

Furthermore, in the medal game device 1 of the present embodiment, the aforementioned first gate 461 and the second gate 471 are comprised in the form of gimmicks respectively depicting a first castle gate and a second castle gate of a fortress. For example, in the case the small targets 42 and the large target 43 have been knocked down, an operation can be carried out that lowers the lower gate 461 and the upper gate 462, thereby enabling a player to enjoy atmosphere and timing of attacking a fortress by successively defeating enemies, or to use another expression, enjoy the atmosphere and sensation of sequentially proceeding through the stages of a so-called role playing game.

In addition, according to the mechanism for storing and paying out medals by each of the gate portions 46 and 47 as described above, a player or other person within the visible range of the jackpot portion 4 is able to directly visualize a large number of medals M stored therein. As a result, a player is given the incentive of desiring to obtain the large number of medals M by hitting the jackpot or visualize a scene of all of the large number of medals M being paid out all at once, thereby making it possible to further arouse interest in the medal game device 1.

Figure 17:
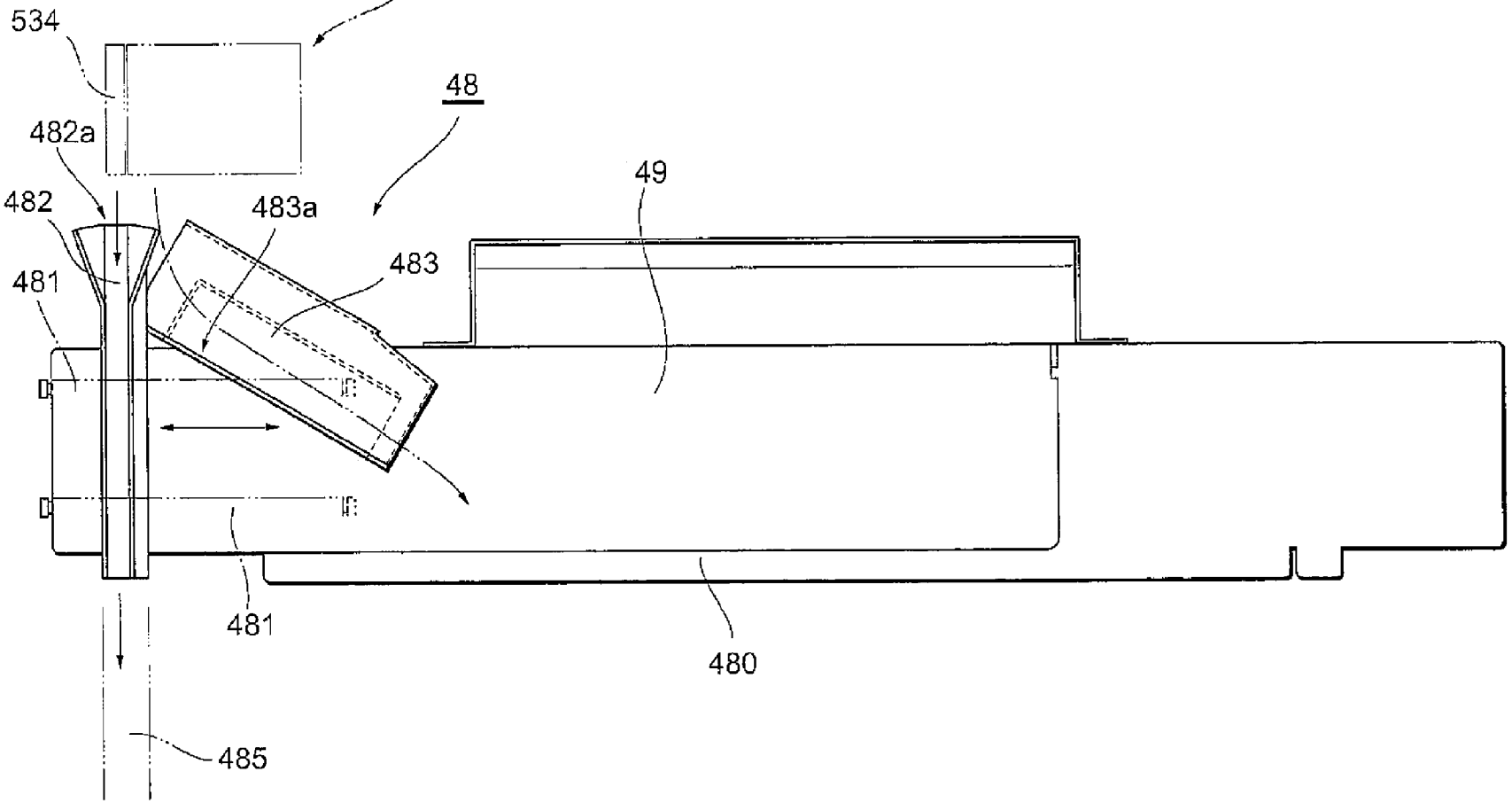
FIG. 17 is an overhead view illustrating a mechanism for supplying medals to a jackpot portion, and a mechanism for switching between medal supply paths.
Figure 18:
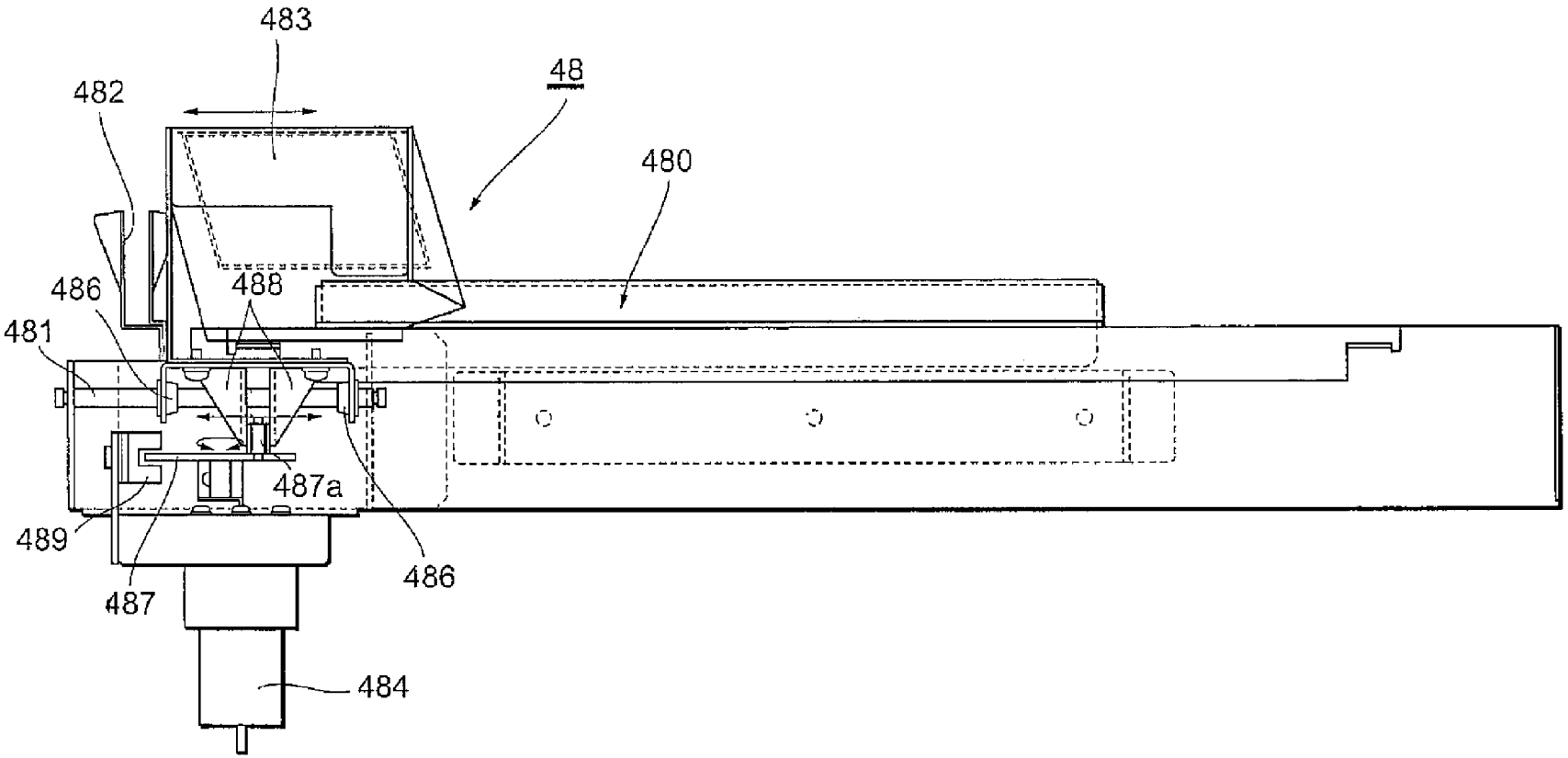
FIG. 18 is a front view illustrating a mechanism for switching between medal supply paths in a jackpot portion.

Next, an explanation is provided of a mechanism for supplying medals to the jackpot portion 4, and particularly for switching a medal supply path 49 (see FIGS. 17 and 18). Although also described in a different section, the supply of medals to jackpot portion 4 is carried out by a medal supply device 53 provided with a medal 10 guide 532 successively feeding medals M collected in the bottom portion of the rotating medal unit 6.

In addition, the medal game device 1 of the present embodiment is provided with a switching mechanism 48 for switching the medal supply path 49 when a medal M is supplied from a medal outlet 534 of the medal supply device 53 described above (see FIGS. 17 and 18). Although there are various examples of a mechanism for switching the medal supply path 49, as one example thereof, the switching mechanism 48 of the present embodiment is comprised of a guide shaft 481, in which a shaft is arranged in the horizontal direction (horizontally oriented direction perpendicular to the direction in which medals M are paid out) in the lower portion of an inclined path 480 over which the medals M flow in the jackpot portion 4, a rail 482 and a slope 483 that slide in the horizontal direction along this guide shaft 481, and a motor 484 and the like that slides the rail 482 and the slope 483 (see FIGS. 17 and 18). Two of the guide shafts 481 are arranged in parallel.

The rail 482 is a guide rail for guiding medals M supplied from the medal outlet 534 to the lower gate portion 46, and the slope 483 is a guide path for guiding the medals M supplied from the medal outlet 534 to the upper gate portion 47. The rail 482 and the slope 483 are integrated into a single unit, and are able to integrally slide along the guide shafts 481 (see FIGS. 17 and 18). Among these, the rail 482 is a supply path having a cross-section in the shape of a channel, for example, that bypasses the side of the slope 483, and guides the medals M to a medal flow path 485 leading to the lower gate portion 46. A medal introducing portion 482*a* of the rail 482 has a wide opening to facilitate introduction of the medals M. On the other hand, the slope 483 is a member having an inclined surface 483*a* inclined towards the center so as to guide the medals M towards the center of the inclined path 480, and when slid and positioned in front of the medal outlet 534, guides medals M supplied from the medal outlet 534 to the upper gate portion 47 (see arrow indicated with a double-dot broken line depicting a virtual line in FIG. 17).

In addition, the rail 482 and the slope 483 are supported by, for example, a channel-shaped bearing 486 capable of moving along the guide shafts 481 (see FIG. 18). Moreover, a rotating plate 487 is provided beneath the rail 482 and the slope 483. This rotating plate 487 transmits driving force of the motor 484 to the rail 482 and the slope 483 through a projection 487*a* on the rotating plate 487 and a locking piece 488 integrated with the bearing 486 and the like. In addition, the positions of the rail 482 and the slope 483 can be detected based on an output from a sensor 489 capable of detecting the amount of rotation of the rotating plate 487 (see FIG. 18).

Furthermore, a so-called progressive type of mechanism can be employed for the mechanism for storing and paying out medals in the above-mentioned jackpot portion 4. This type of mechanism increases a cumulative value each time a number of medals inserted by a player reaches a prescribed number of medals (such as when the total number of medals inserted by all players reaches 10), and the cumulative value can be displayed as a so-called jackpot value. According to this type of progressive mechanism, the interest of a player can be strongly attracted since the number of medals paid out when a prize is won increases as the cumulative value increases. Furthermore, in the case of using this type of progressive mechanism, medals M are supplied from the medal supply device 53 to the jackpot portion 4 corresponding to an increase in the cumulative value.

Figure 19:
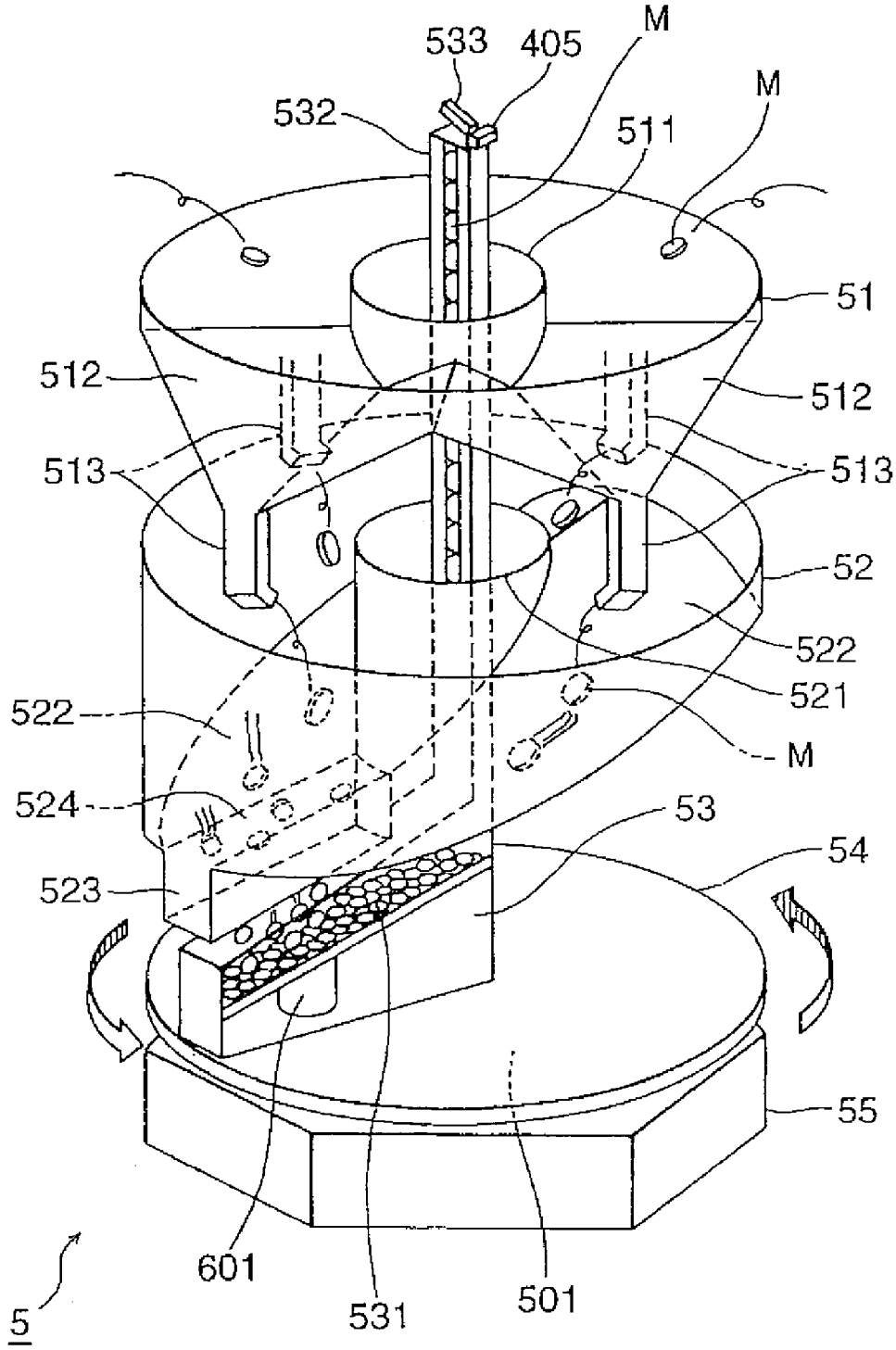
FIG. 19 is a perspective view illustrating one example of the structure of a turntable portion.

Continuing, an explanation is provided of an example of the structure of the turntable portion 5 in the rotating center unit 6. FIG. 19 indicates a perspective view illustrating the structure of the turntable portion 5. As illustrated in FIG. 19, the turntable portion 5 is provided with a medal tray 51, a round chute 52, the medal supply device 53, a rotating plate 54 and a base 55. With the exception of the medal tray 51 and the base 55, the constituent members rotate simultaneously along the same axis of rotation.

The medal tray 51 is provided with an opening 511 in the center thereof and has a shape for collecting medals M from a surrounding ring-shaped portion thereof. A beam not illustrated extends from the opening 511 to the outer periphery. The medal tray 51 is provided with a tapered bottom portion 512 capable of collecting medals M that have flown in around the periphery of the rotating center unit 6 (or the targets 42 and 43 arranged there on). The lowermost portion of the bottom portion 512 is open and leads to a trough 513. As a result of employing this configuration, medals M that have flown into the medal tray 51 are discharged from the trough 513 by sliding over the bottom portion 512.

The round chute 52 has a doughnut shape provided with an opening 521. A bottom portion 522 is provided in the round chute 52 that inclines in a tapered shape towards an opening 524 in the lowermost portion (deepest portion). A trough 523 is provided in the opening 524 to allow medals M to stably drop therein. As a result of employing this configuration, medals M that drop into the round chute gather at a single location of the opening 524 and are discharged from the trough 523.

The medal supply device 53 is configured to be able to supply medals M gathered in the round chute 52 to the jackpot portion 4. In the case of the present embodiment, the medal supply device 53 is provided with the main hopper (medal collecting container) 531, a medal supply motor 601, the medal guide 532, a rocking lever 533 and a count sensor 405.

The main hopper 531 is a collecting container for collecting medals M that have been launched from each of the satellite portions 2 towards the rotating center unit 6 (or the targets 42 and 43 provided there on) and have dropped down therein (see FIG. 3). In the case of the present embodiment, the structure is such that all medals M that have dropped within the range of the rotating center unit 6 are collected with this main hopper 531. A medal feeding device not illustrated is provided in the bottom portion of the main hopper 531. In addition, although not illustrated in detail in the drawings, a medal quantity sensor 531*a* is provided in the main hopper 531 of the present embodiment (see FIG. 3). This medal quantity sensor 531*a* can function as a sensor (near empty sensor) for detecting whether or not the amount of medals (stored amount) collected in the main hopper has exceeded a fixed amount.

The medal feeding device is able to successively send out medals M into the medal guide 532 by rotating a disk in which is provided a plurality of holes into which the medals M can fit. The medal guide 532 functioning as a medal transport mechanism serves as a pathway for medals M, and is able to transport the medals M over a long distance in single file. When the medals M are discharged into the jackpot portion 4 from the outlet of the medal guide 532, the rocking lever 533 rocks and the discharged medals M are detected by the count sensor 405 corresponding to this rocking motion.

The rotating plate 54 is able to integrally rotate the medal tray 51, the round chute 52 and the medal supply device 53 by a motor 501 provided on the base 55 (although not illustrated in detail in the drawings in the present embodiment).

Here, an example of the flow until a medal M launched from the satellite portion 2 towards the rotating center unit 6 is collected with the main hopper 531 is indicated below (see FIG. 3). Namely, a medal M that has dropped behind the small targets 42, for example, drops through a dropping hole 506 provided in that portion of the rotating center unit 6, slides (or rolls) over the inclined path 507 and further drops through a dropping hole 508. The dropped medal M slides (or rolls) over the medal tray 51 and the round chute 52, is guided to the trough 523 and is collected in the main hopper 531 (see FIGS. 3 and 19). Medals M that have been collected in this manner are subsequently supplied to the jackpot portion 4 by being driven by the medal supply motor 601.

Continuing, an explanation is provided of the configuration of a control block in the medal game device. FIG. 4 illustrates a block diagram of a system for operating the medal game device of the present embodiment. As illustrated in FIG. 4, the system block is provided with a main unit 100, the satellite units 200, target units 300, a jackpot unit 400, a turntable unit 500, a medal collecting unit 600, an illumination unit 700, a maintenance unit 800 and an interface unit 900. The main unit 100 serving as a first control device and the plurality of satellite units 200 serving as second control devices are characterized by forming a distributed processing system by being connected by two-way communication.

The main unit 100 is configured to be able to control the target units 300, the jackpot unit 400, the turntable unit 500, the medal collecting unit 600, the illumination unit 700 and the maintenance unit 800. In addition, the main unit 100 also transmits and receives data and commands with each of the satellite units 200. More specifically, the main unit 100 is provided with a CPU 101, a memory 102, a timer 103, interface circuits 104, 105, 106 and 108, and a sound source circuit 107.

Figure 20:
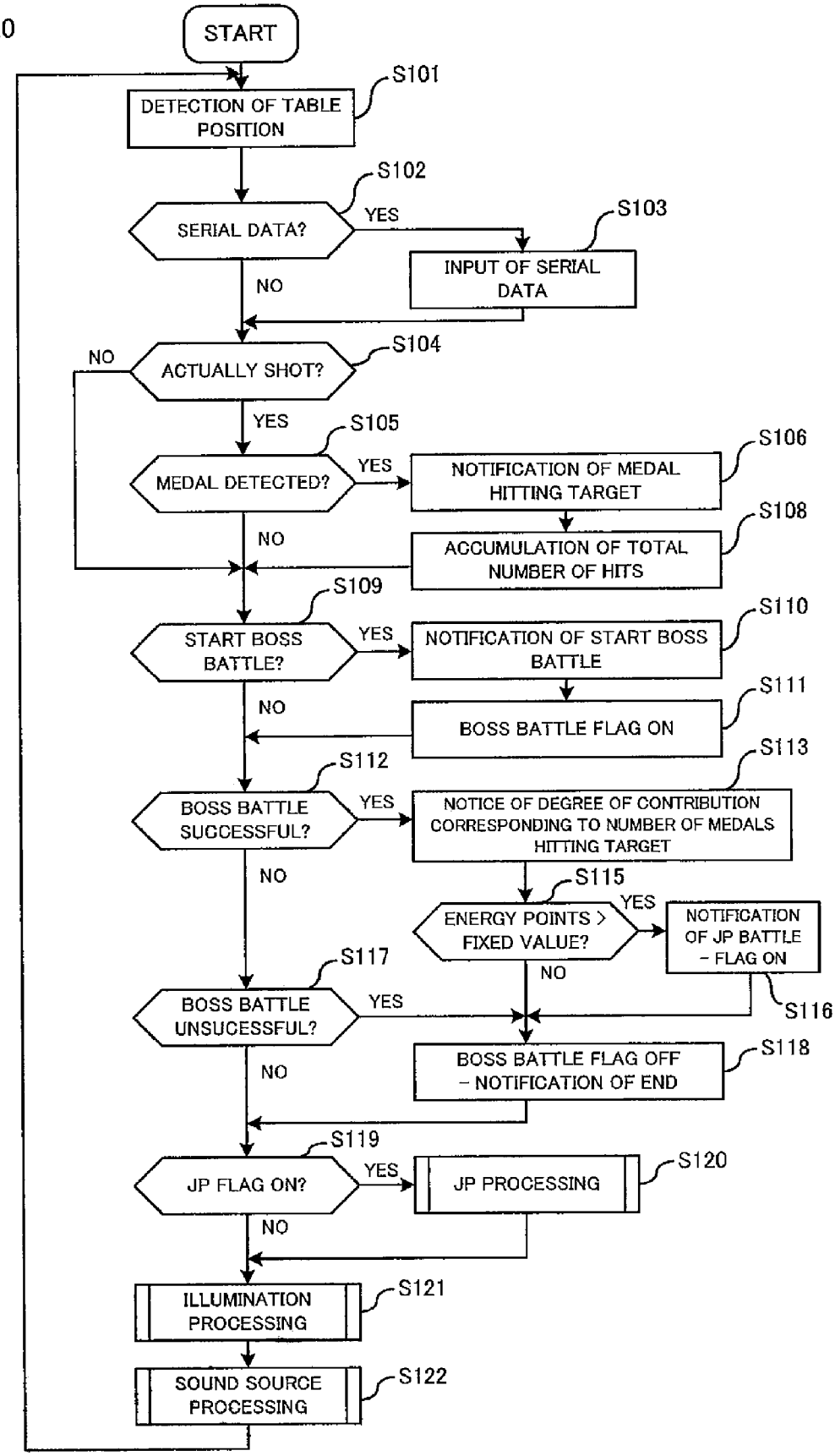
FIG. 20 is a flow chart illustrating one example of processing in a main unit.
Figure 21:
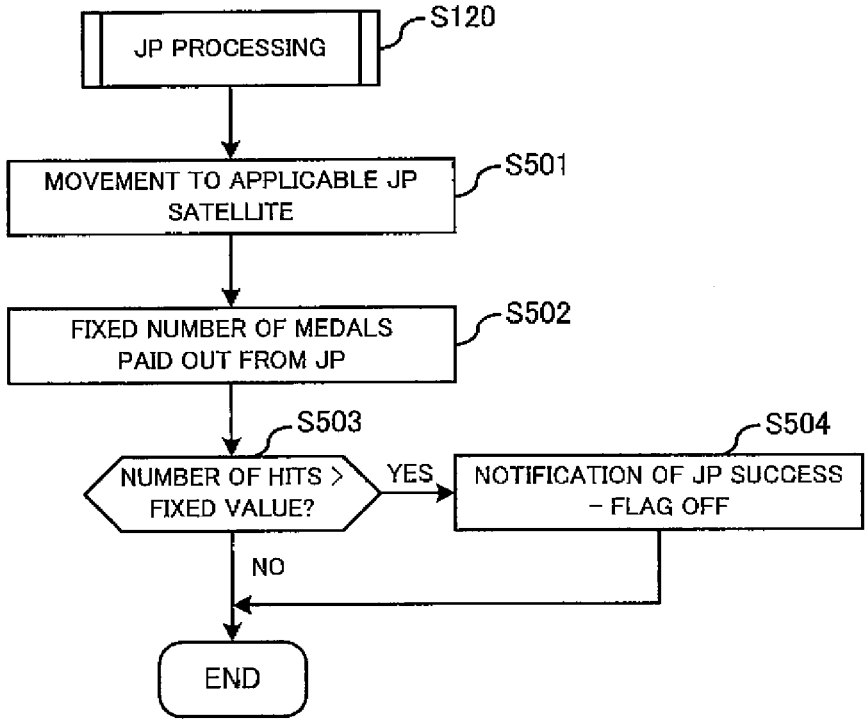
FIG. 21 is a flow chart illustrating one example of jackpot processing in a main unit.
Figure 22:
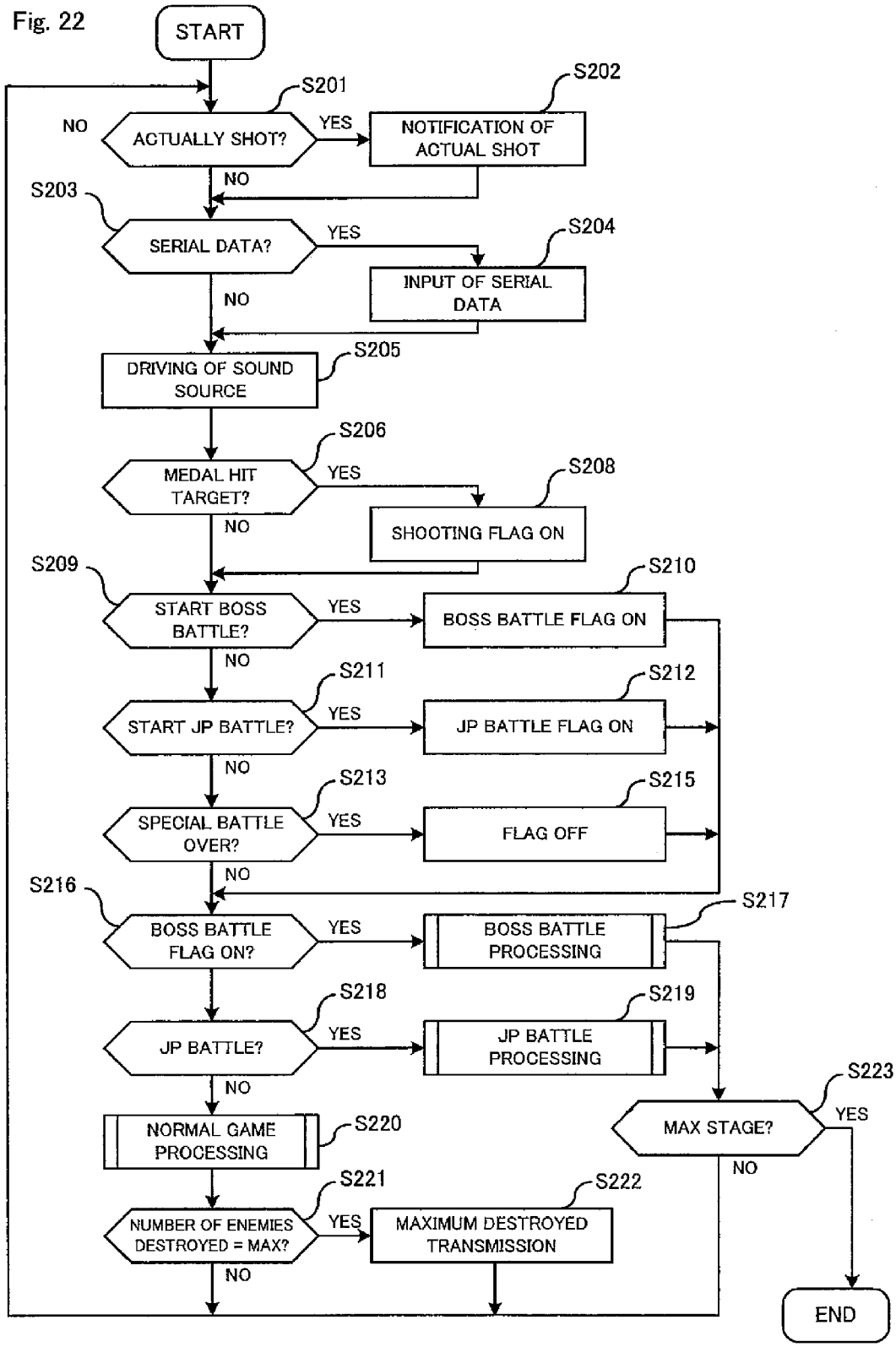
FIG. 22 is a flow chart illustrating one example of processing in a satellite unit.
Figure 23:
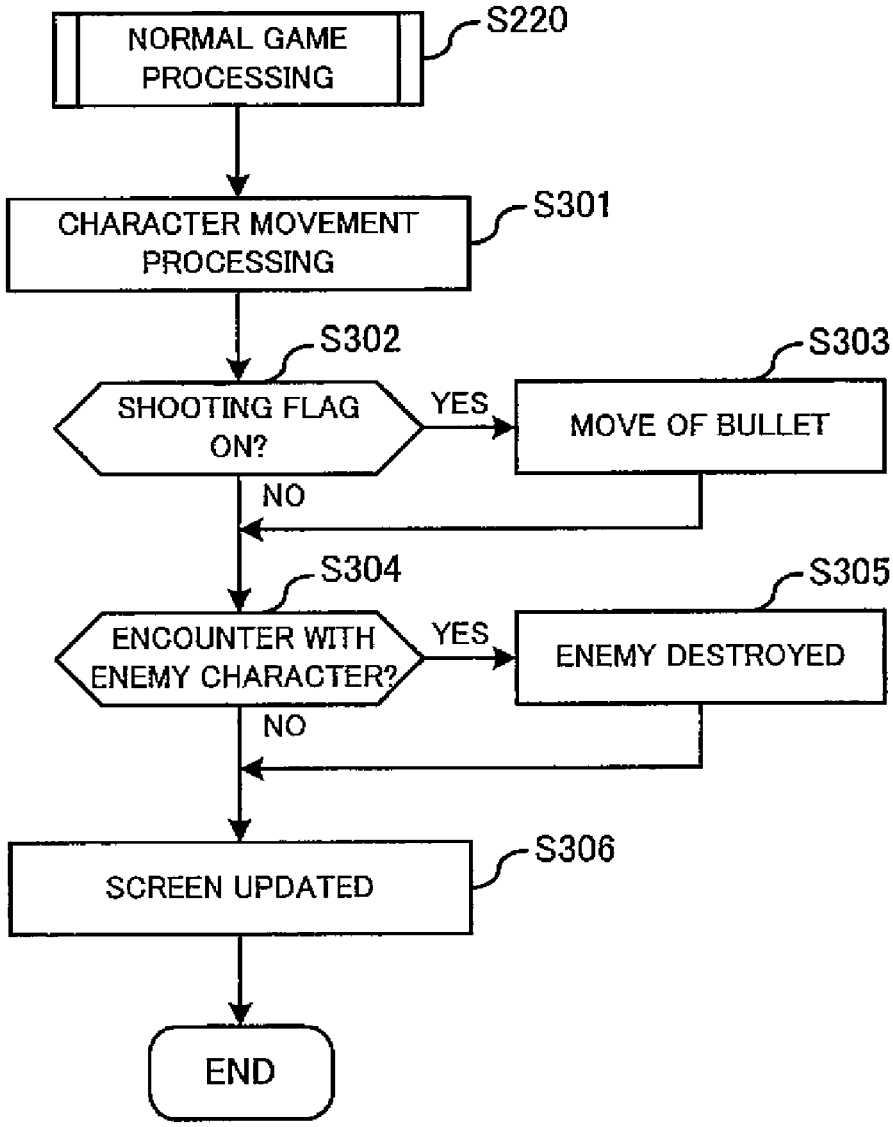
FIG. 23 is a flow chart illustrating one example of normal game processing.
Figure 24:
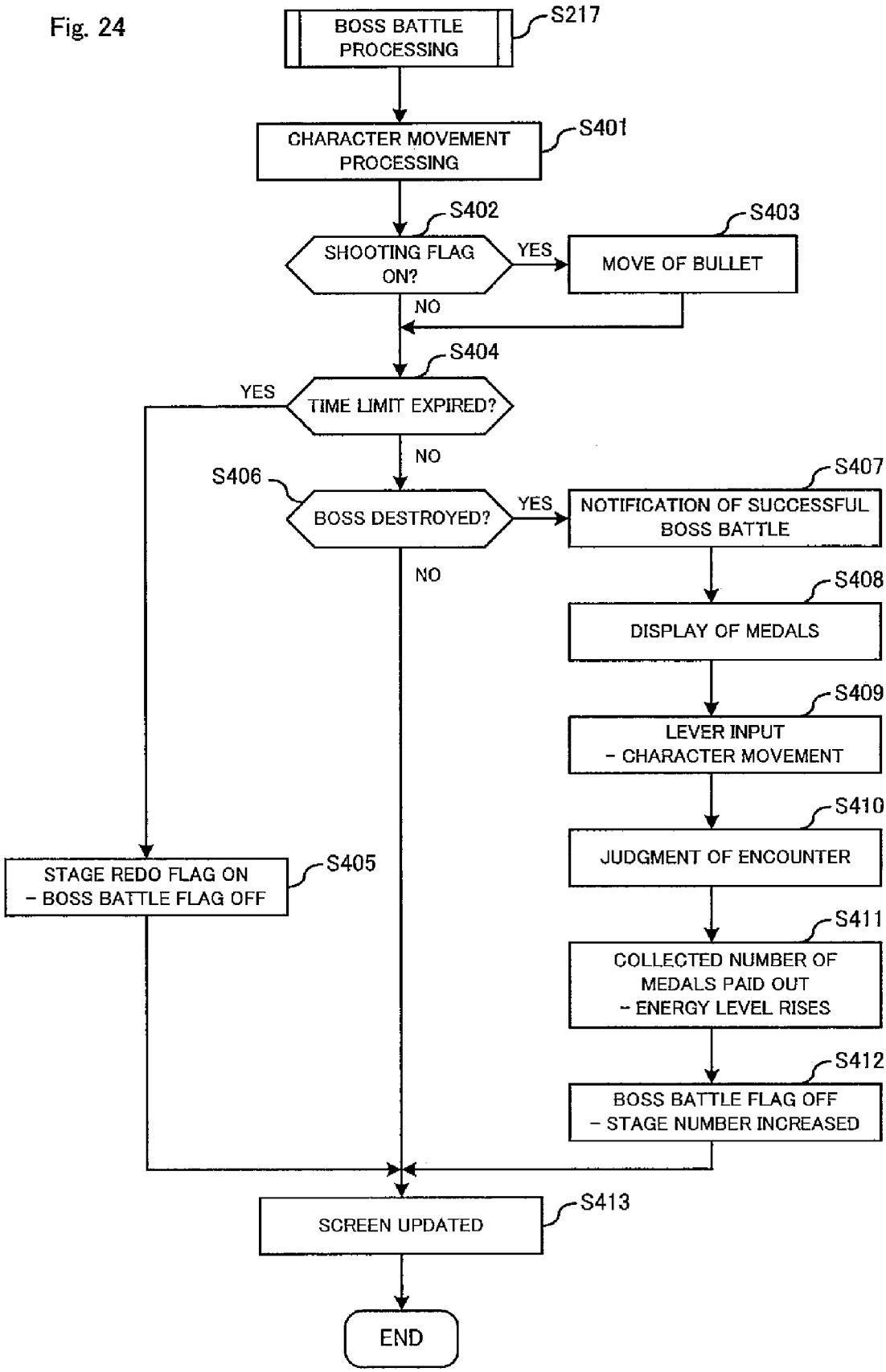
FIG. 24 is a flow chart illustrating one example of processing in a boss battle explained in a present embodiment.
Figure 25:
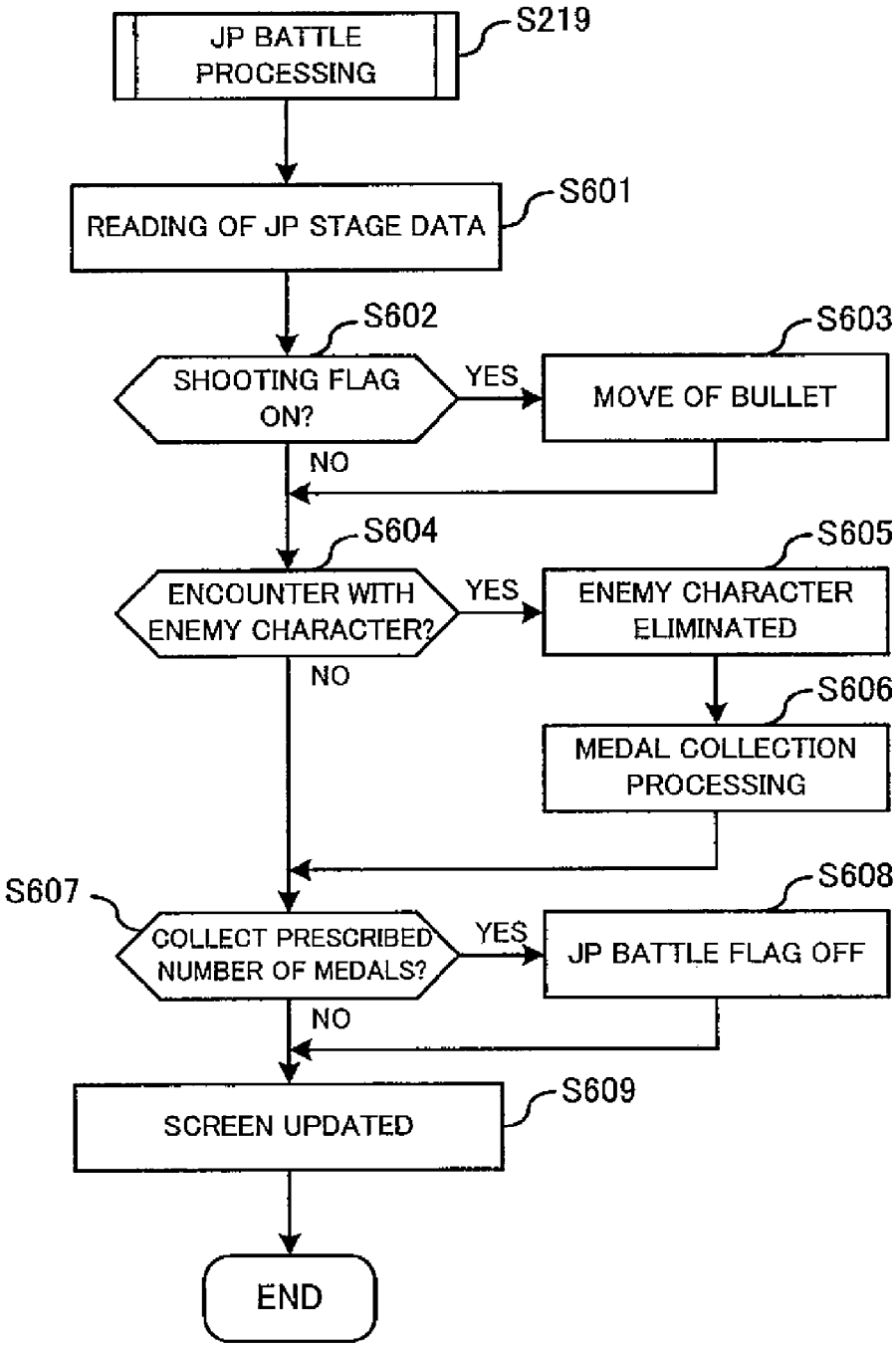
FIG. 25 is a flow chart illustrating one example of jackpot processing in a satellite unit.
Figure 26:
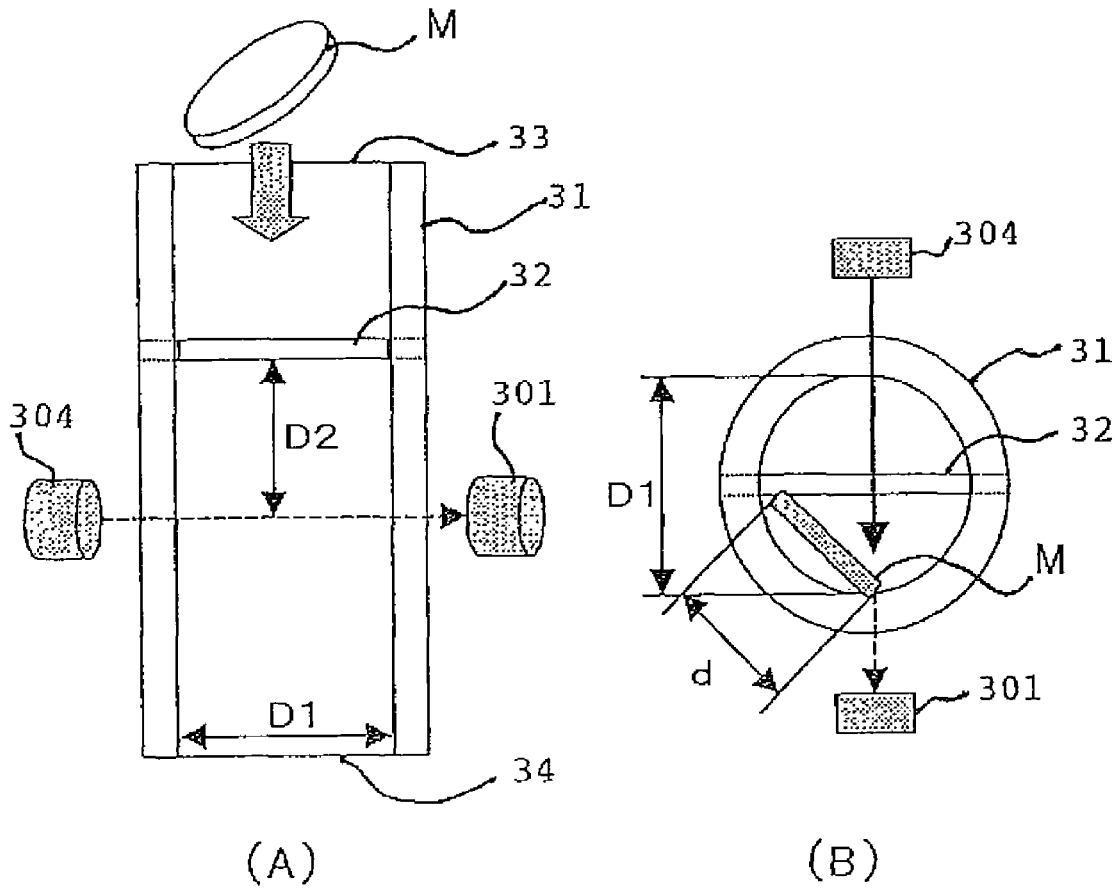
FIG. 26 is a front view (A) and an overhead view (B) schematically illustrating a device for detecting medals.

The CPU 101 is able to execute a prescribed processing as indicated in FIGS. 20 and 21 as a part of the control device of the present invention by executing a program stored in the memory 102. The memory 102 is able to provide a RAM portion as a work area for the CPU in addition to storing a program in a ROM portion. The timer 103 is able to notify an elapsed time by applying an interrupt to the CPU 101 at fixed time intervals by dividing the frequency of a crystal oscillator.

The interface unit 104 performs two-way serial communication with each of the satellite units 200 as well as transmission of sound source control commands. The interface circuit 105 transmits motor drive signals to the turntable unit 500, drive signals to the medal collecting unit 600, and illumination instruction signals to the illumination unit 700, and receives detection signals of a position sensor 503 from the turntable unit 500. The interface circuit 106 outputs small target drive signals for a motor 401, large target drive signals for a motor 402, and hopper drive signals for a motor 404, and inputs detection signals of a wave sensor 403, the count sensor 405 and a full sensor 406 of the large target 43, to and from the jackpot unit 400 via the interface unit 900. In addition, the interface circuit 106 outputs illumination instruction signals to each of the target units 300 and inputs detection signals from the sensor 301.

The interface circuit 108 is inputted operation signals for maintenance from the maintenance unit 800. The sound source circuit 107 contains an internal waveform memory, synthesizes waveforms corresponding to sound source control signals from the CPU 101, and outputs acoustic signals of the synthesized waveforms. The acoustic signals synthesized with this sound source circuit are mainly related to BGM. The acoustic signals are amplified with an amp 110 and supplied to a speaker attached to the body of the medal game device.

The satellite units 200 are provided corresponding to the satellite portions 2, and are configured to allow control of each satellite portion 2 while exchanging data with the main unit 100. For example, in the case of the medal game device of the present embodiment provided with ten satellite portions 2, ten satellite units 200 are provided corresponding to each of the satellite portions 2. These satellite units 200 are specifically provided with a CPU 201, a memory 202, interface circuits 203, 204, 206, 208 and 209, a video display circuit (VDP) 207, and a sound source circuit 205 on a board.

The CPU 201 is able to execute a prescribed processing as indicated in FIGS. 22, 23, 24 and 25 as a part of the control device by executing a program stored in the memory 202, and is particularly configured to be able to execute a video game displayed on the display portion 20. The memory 202 is able to provide a RAM portion as a work area for the CPU in addition to storing a program and settings table 825 to be described later in a ROM portion.

The interface circuit 203 transmits and receives data and commands to and from the main unit 100, and the interface circuit 204 receives sound source control signals. The interface circuit 206 outputs drive signals for a motor 212 to the pusher portion 3 or the satellite hopper 25 that supplies medals M to each medal launching device 8, and inputs detection signals from the count sensor 213. The interface circuit 208 outputs drive signals to the motor 214 for moving the display portion 20 while the interface circuit 209 transmits and receives data (detection signal) and commands to and from the medal launching device 8, the details of which are described later.

The video display circuit 207 contains an internal data memory and frame memory, and is configured to generate frame images based on target data and positional data specified by commands from the CPU 201 controlling progression of a video game as well as output video signals to the display portion 20. The sound source circuit 205 contains an internal waveform memory, synthesizes waveforms corresponding to sound source control signals from the CPU 201, and outputs acoustic signals of the synthesized waveforms. The acoustic signals synthesized with this sound source circuit are mainly related to a launching sound of medals M and the audio of the video game displayed on the display portion 20. The acoustic signals are amplified with an amp 211 and supplied to a speaker attached, for example, next to the lever 23 of each of the satellite portions 2.

The target units 300 are units provided within, for example, the pusher portion 3 or each of the targets 41 to 43, and are provided with the previously described sensor 301, the board 302 and a cold cathode tube 303. In addition, although not illustrated in the drawings, the target units 300 are also provided with the light-emitting device 304 illustrated in FIGS. 7 and 26. The board 302 is able to input detection signals from the sensor 301, detect the passage of medals M by a judgment method as previously described, and output to the effect that the medals M have been detected to the CPU. In addition, in the case the passage of the medals M has been detected, the cold cathode tube 303 can be made to flash or illumination of the cold cathode tube 303 can be controlled corresponding to an illumination control signal from the CPU. The cold cathode tube 303 is arranged surrounding the cylindrical body 31, and emits a quantity of light to a degree capable of illuminating a target object through the moldings of the pusher portion 3 and the targets 41 to 43.

The jackpot unit 400 is provided with the motor 401 that drives the small targets 42, and the motor 402 that drives the large target 43, and is also provided with the motor 404 for driving other components (for example a hopper not illustrated). In addition, the jackpot unit 400 is provided with the wave sensor 403 for detecting the movement of the obstacles 44 of the large target 43, and the hopper count sensor 405 and full sensor 406. The motor 401 and the motor 402 contribute to imparting visual effects by respectively moving the targets 42 and 43. The motor 404 is a drive device for paying out medals M during jackpot processing.

The wave sensor 403 detects the positions of the obstacles 44 and inverts the movement of the motor 402 so as to make the large target 43 appear to, for example, alternately raise and lower both hands. The count sensor 405 counts the number of medals paid out, and the full sensor 406 outputs a detection signal to discontinue the supply of medals once medals M have been replenished in the hopper.

The turntable unit 500 is a control block for the turntable portion 5, and is provided with the motor 501, a jackpot sensor 502 and the position sensor 503. The motor 501 is provided on the base 55 in order to rotate the rotating plate 54. The jackpot sensor 502 detects the position for paying out medals during jackpot processing and stops the turntable portion 5. The position sensor 503 is provided in each of the satellite portions 2 and is a position sensor for specifying a target corresponding to each of the satellite portions 2.

The medal collecting unit 600 is provided with the jackpot medal supply device 53 and a plurality of medal supply motors 601 of medal supply devices (not illustrated) for supplying medals M to the medal launching device 8 of each of the satellite sections 2. The illumination unit 700 is a unit in which lighting fixtures are arranged to illuminate a game space. The maintenance unit 800 is a unit in which a maintenance reset switch, power switch, test selector switches and audio volume switches and the like are arranged. The interface unit 900 provides an interface mechanism for electrically connecting the rotating target units 300 and jackpot unit 400 with the stationary main unit 100.

Figure 12:
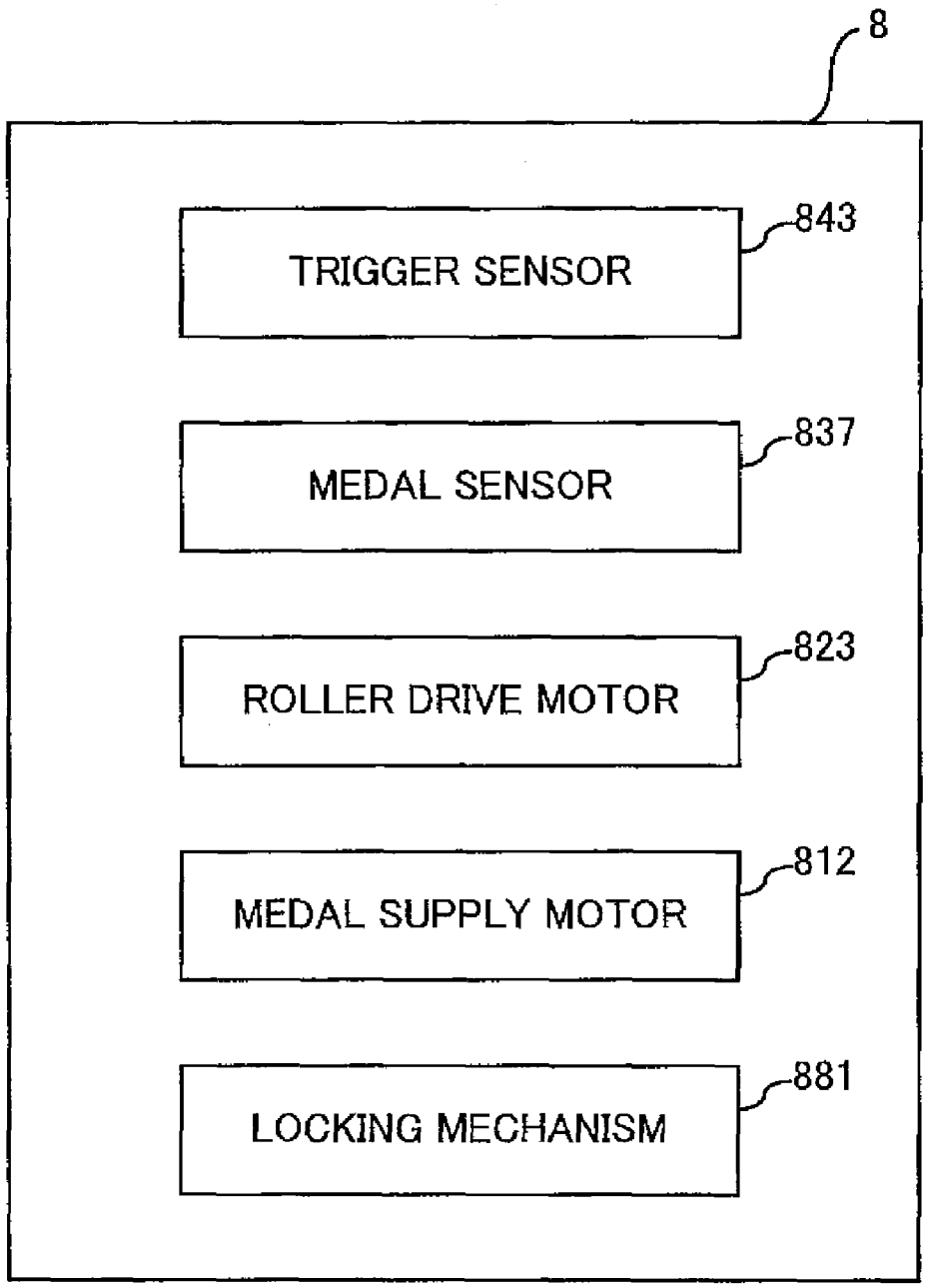
FIG. 12 is a schematic representation of a system block diagram of a medal launching device 8.

FIG. 12 is a schematic representation of a system block diagram of the medal launching device 8 in the present embodiment. Each medal launching device 8 is provided with a trigger sensor 843 that detects that the launch button 842 has been pushed, a medal sensor 837 that detects that a medal M has passed the launching rail 831, the roller drive motor 823 that is driven during a shooting game and for which the rotating speed thereof is controlled corresponding to the distance to a target, the medal supply motor 812 for operating the mini-hopper 811 during the time pressing of the launch button 842 is detected, and a locking mechanism 881 of the supporting unit 88 that locks and unlocks the first operating table portion 86. These are connected to the CPU 201 of the satellite unit 200 and the like via the interface (I/O) circuit 209.

Detection signals from the trigger sensor 843 and the medal sensor 837 are output to the interface (I/O) circuit 209, and motor drive control commands and the like are input from the interface circuit 209. Furthermore, the CPU 201 functions as a controller for controlling launching of medals M by each medal launching device 8 or controlling replenishing of medals M to each medal launching device 8 by executing a prescribed program stored in the ROM portion of the memory 202.

FIG. 13 is an example of the configuration of a settings table 825 that stores events performed during a shooting game in correlation with launching velocity parameters relating to the launching velocity of medals launched from each of the medal launching devices 8. As illustrated in FIG. 13, the settings table 825 contains data in the form of table that correlates a rotating speed 827 of each roller drive motor 823 for each of a plurality of targets (events 826) aimed at by a player. The motor rotating speeds are preset corresponding to the distance and/or height from the medal launching device 8 to each target, and are adjusted to a rotating speed that enables medals to just reach each of the targets. In the example illustrated in FIG. 13, the number of revolutions per minute of the roller drive motor 823 is set to 2000 to 2100 rpm when the target is the moving target 41. The rotating speed is subsequently set to 3000 to 3100 rpm for the small targets 42, to 4200 to 4300 rpm for the large target 43, and to 2800 to 2900 rpm for target mechanisms 911.

Furthermore, this settings table 825 is stored in ROM of the memory 202, and is referenced by the CPU 201 when driving and controlling the roller drive motor 823.

Figure 16:
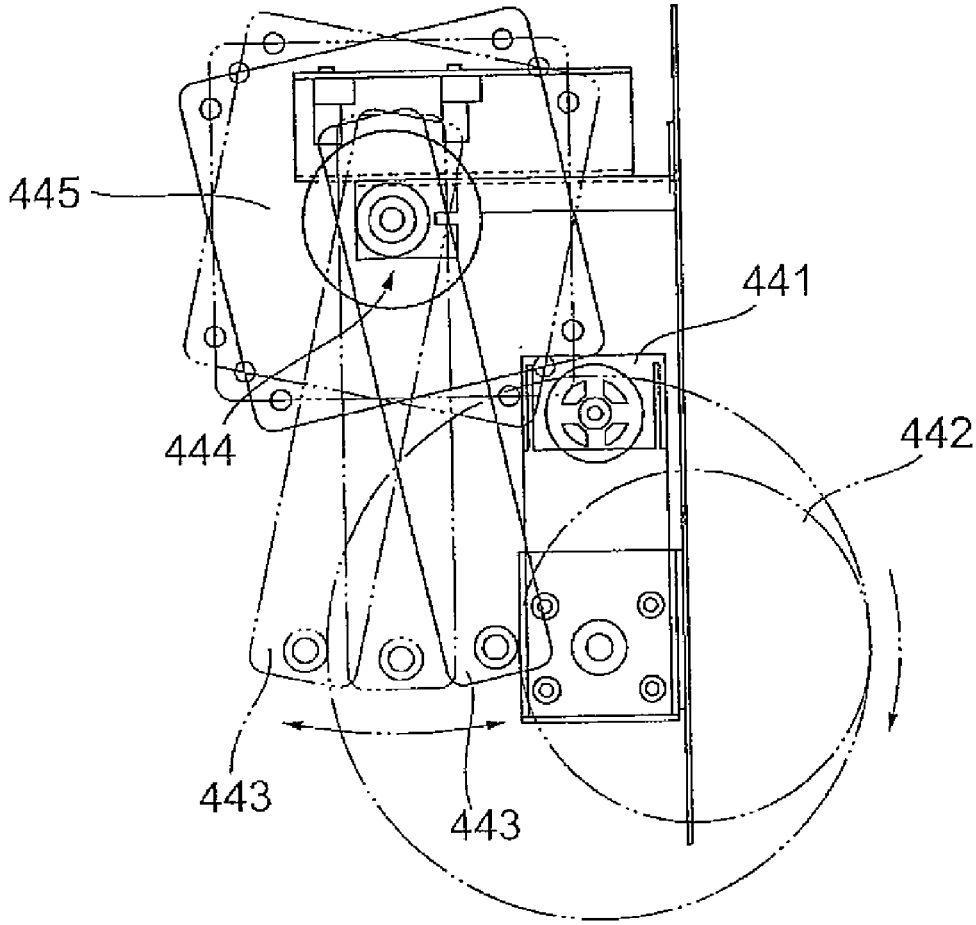
FIG. 16 is a drawing illustrating the structure of cams comprising an obstructing portion of a large target.
Figure 27:
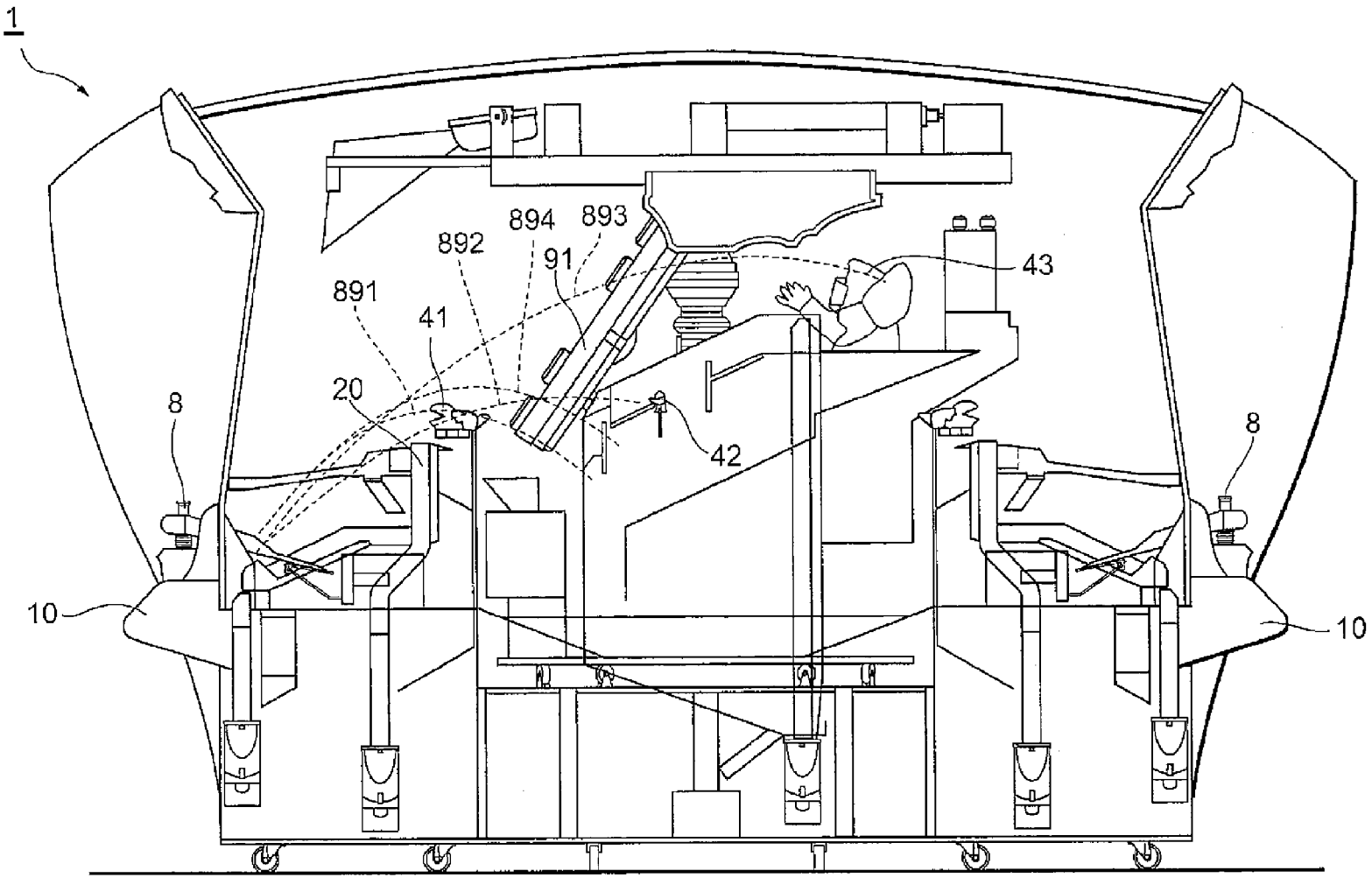
FIG. 27 is a drawing illustrating the flight paths of medals launched from a medal launching device 8.
Figure 28:
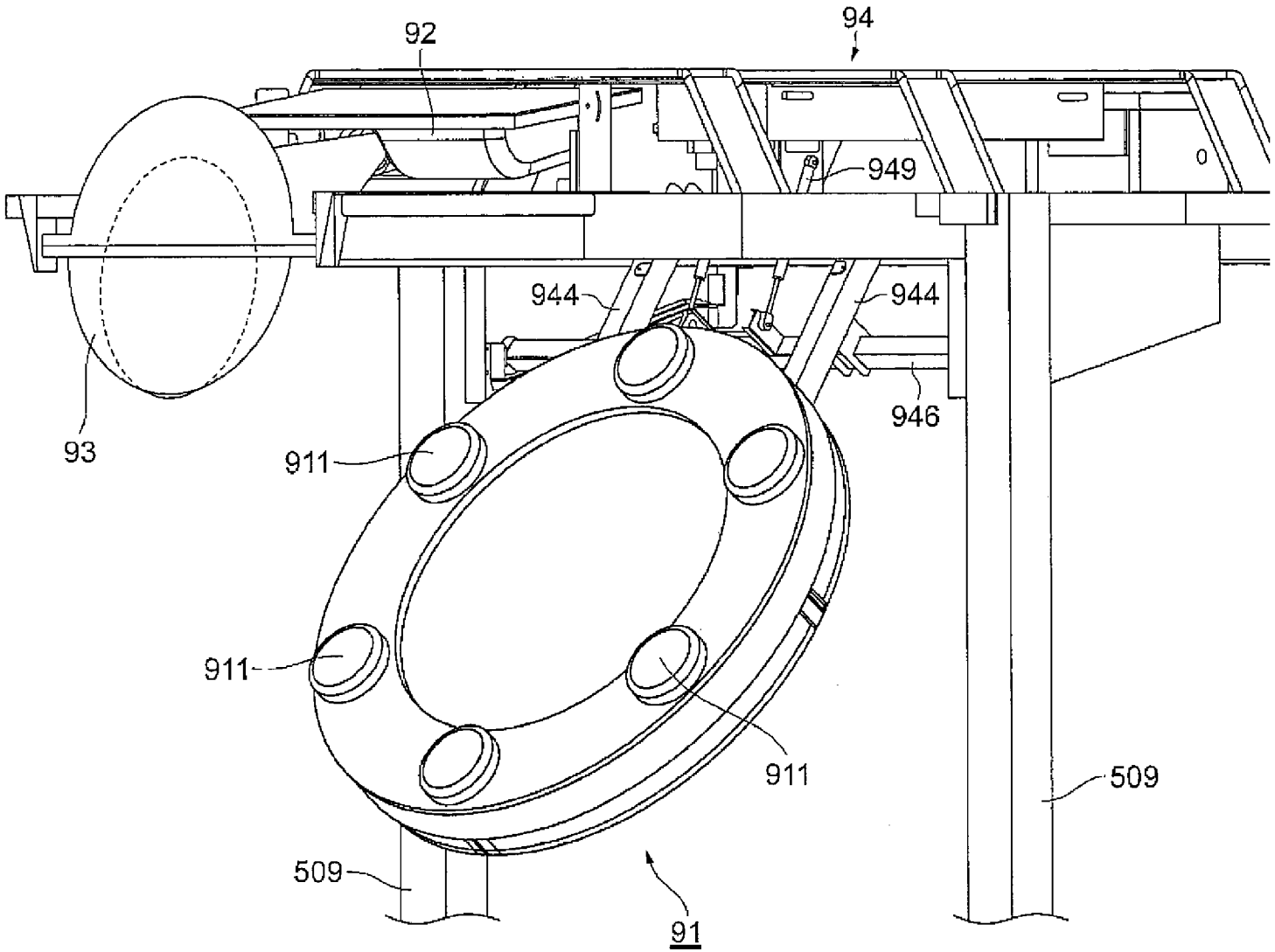
FIG. 28 is a perspective view illustrating a projection unit comprising a ceiling projector chucker device and a mechanism for raising and lowering thereof.

FIG. 27 is a drawing illustrating the flight paths of medals launched from the medal launching device 8 in the present embodiment. As illustrated in FIG. 16, the medal launching velocity (motor rotating speed) is adjusted so that, when aiming at the moving target 41, the medal follows a flight path 891 so as to just reach the moving target 41. Similarly, the medal launching velocities are adjusted so as to follow flight paths 892, 893 and 894 so that, when aiming at the small targets 42, the large target 43 and the target mechanisms 911, the medals just reach these targets.

Continuing, an explanation is provided of the configuration of a ceiling projector chucker device. In the medal game device 1 of the present embodiment, a ceiling projector chucker device housed in the ceiling is driven to a location in front of a player to perform a new event consisting primarily of a shooting game during a so-called super jackpot lucky chance event (to be explained in a later section).

This ceiling projector chucker device is provided with a projection unit 91, comprised of a target base that rises and lowers between a housed initial position (see FIG. 29) and the location of a target of a shooting game, a mechanism for raising and lowering the projection unit 91 in this manner, and a projector device 92 for projecting a prescribed image on the surface of the projection unit 91.

The projection unit 91 is a target base comprised of a disk, for example, provided with a plurality of targets (winning prize ports) on the surface thereof. In the case of the present embodiment, six target mechanisms 911, for example, are arranged circumferentially and at equal intervals along the outer periphery of the projection unit 91. In this case, a total of 12 targets may be arranged by positioning dummies between these target mechanisms 911. Furthermore, in FIG. 28 and other drawings, the target mechanisms 911 are simplified and represented in the form of cylindrical projections (see FIG. 28, for example).

The target mechanisms 911 are arranged as targets on the projection unit 91. A medal chucker (winning prize port) 912 is provided in each of the target mechanisms 911, and an open/close mechanism 913, which opens or closes the winning prize port thereof, is provided in each of the chuckers 912 (see FIG. 31). In the case of the present embodiment, for example, the open/close mechanisms 913 are formed to depict a mouth, and impart the visual sensation of opening and closing a mouth due to the effects of gimmicks depicted on the target mechanisms 911 and images and the like projected onto the target mechanisms 911.

The projector device 92 is a device for projecting a prescribed image onto the surface of the projection unit 91. In this case, although images can be projected by directly illuminating the projection unit 91 with the projector device 92, in the present embodiment, images are projected onto the projection unit 91 by first reflecting with a reflecting plate 93 such as a mirror (see FIG. 30). In this case, since a required projection distance can be secured even if, for example, the projector device 92 is arranged above the projection unit 91, these devices can be arranged in a compact manner. The projector device 92, the reflecting plate 93 and the projection unit 91 are all arranged on the turntable unit 500, and rotate with the turntable unit 500 within the medal game device 1 (see FIG. 3, for example).

Figure 29:
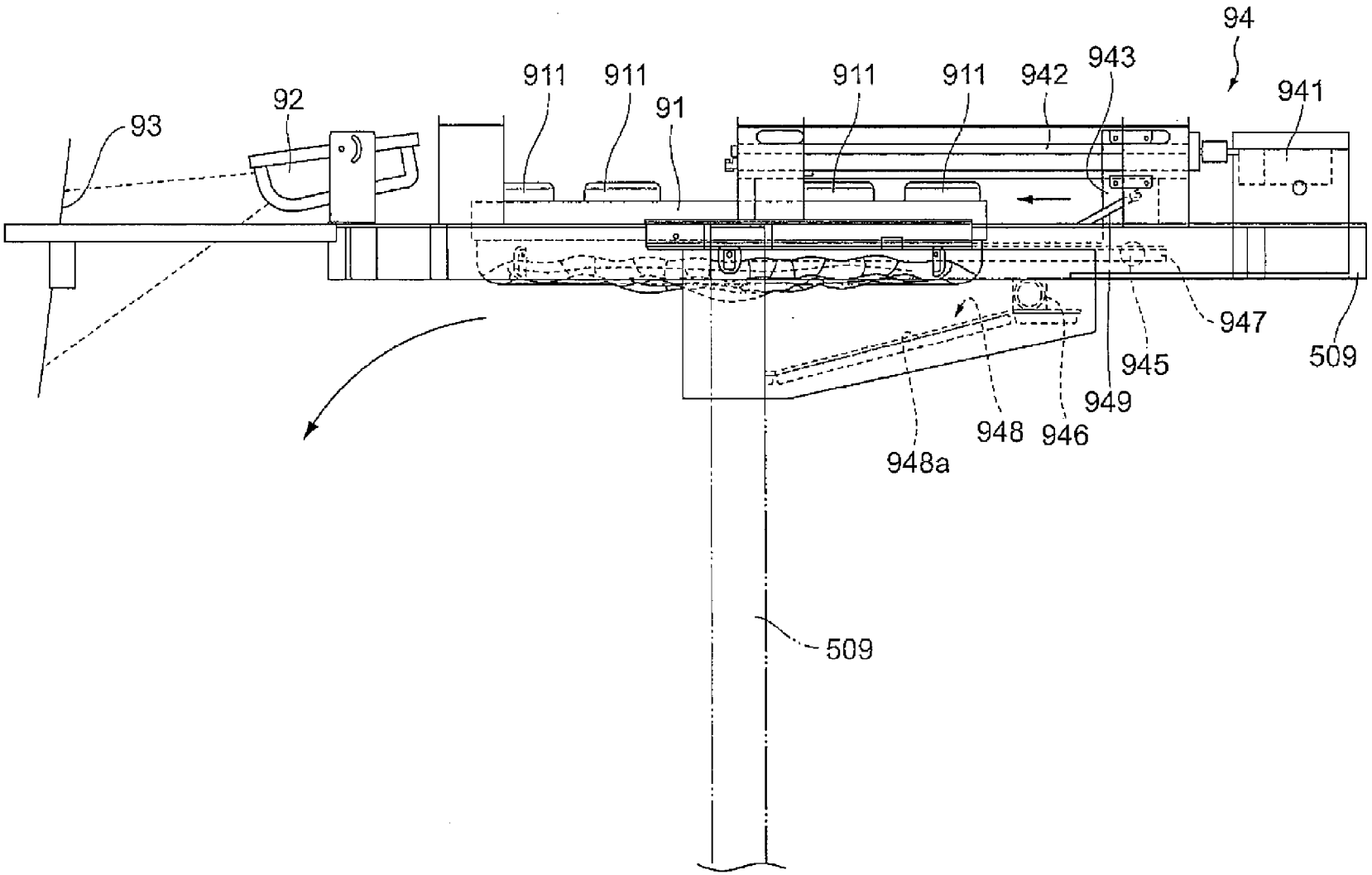
FIG. 29 is a side view illustrating a projection unit and a mechanism for raising and lowering thereof with the projection unit at the initial position.

Next, an explanation is provided of a mechanism (indicated with reference symbol 94) for raising and lowering the projection unit 91 (see FIG. 29, for example). In the case of the present embodiment, for example, the projection unit 91 is slid forward and backward by means of a motor 941 and a feed screw 942, and the surface thereof is lowered in coordination with this movement to as to be visible to a player.

The motor 941 is a drive source when raising and lowering the projection unit 91, and is fixed to a frame 509 of the turntable unit 500 on which the projection unit 91 is provided. The feed screw 942, extending in the forward and backward directions (direction connecting the satellite portion 2 with the turntable unit 500), is connected to an output shaft of the motor 941 so as to rotate coaxially therewith. A slider 943 able to move in the forward and backward directions engages with the feed screw 942 and slides corresponding to the amount of rotation of the feed screw 942.

Figure 31:
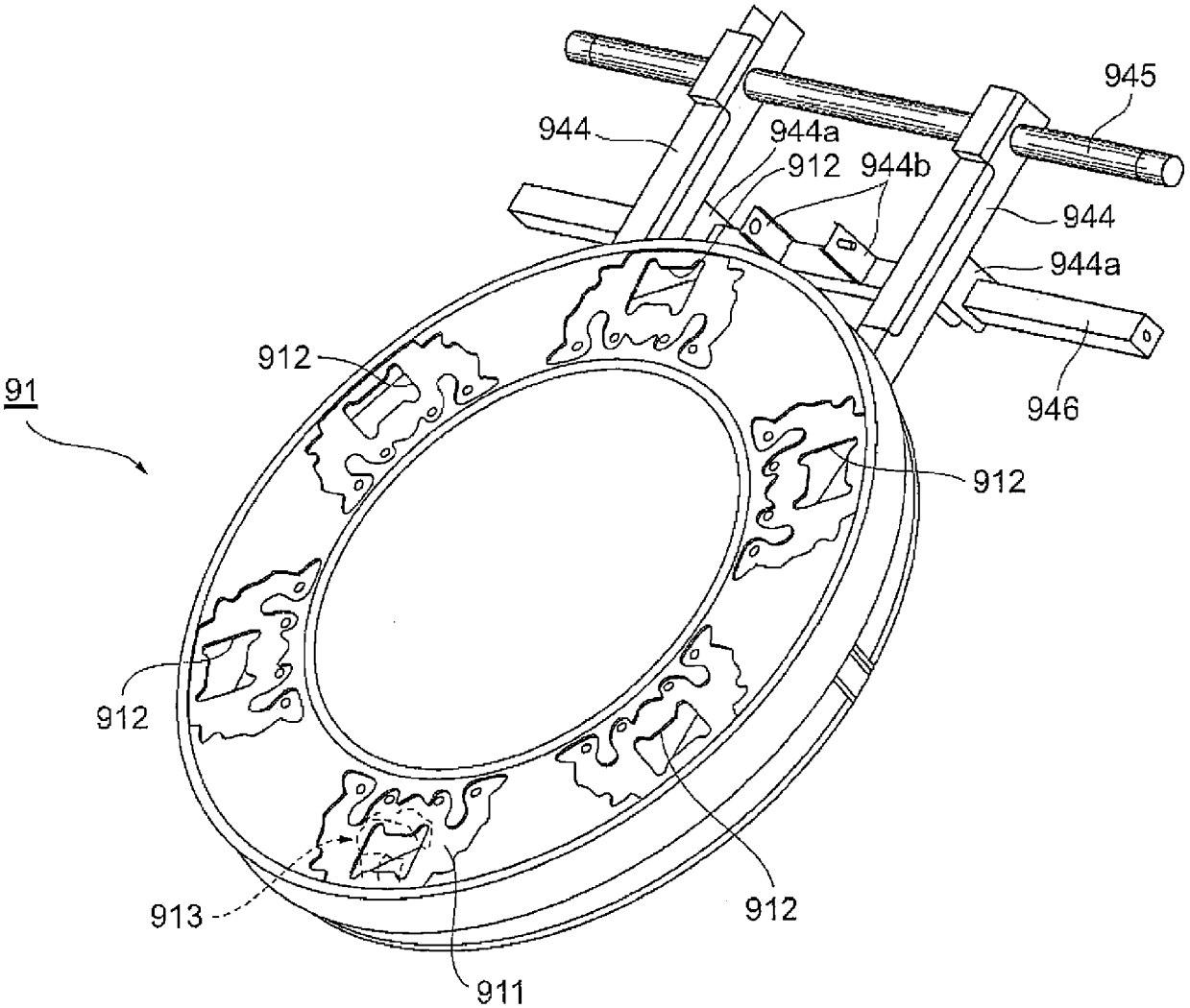
FIG. 31 is a perspective view illustrating a projection unit and support arms for support thereof.

On the other hand, the projection unit 91 is supported by a pair of support arms 944 arranged on the left and right, for example (see FIG. 31, for example). Moreover, two shafts 945 and 946, extending in the leftward and rightward directions, are attached mutually in parallel to the support arms 944. Among these, the first shaft 945 is attached in the vicinity of the ends of the support arms 944. In addition, the second shaft 946 is attached to the support arms 944 through, for example, support pieces 944*a* at locations between the projection unit 91 and the first shaft 945 (see FIG. 31). Furthermore, projections 944*b* are formed for rotatably attaching one end of a cushion 949. The other end of the cushion 949 is rotatably attached to the slider 943.

Here, the first shaft 945 is relatively rotatably coupled to the above-mentioned slider 943 (see FIG. 29). Moreover, both end portions of the first shaft 945 are guided by slide rails 947, and the first shaft 945 is able to slide in the forward and backward directions along these slide rails 947. The slide rails 947 are provided inside, for example, the frame 509 so that the pair thereof is mutually opposed.

Figure 30:
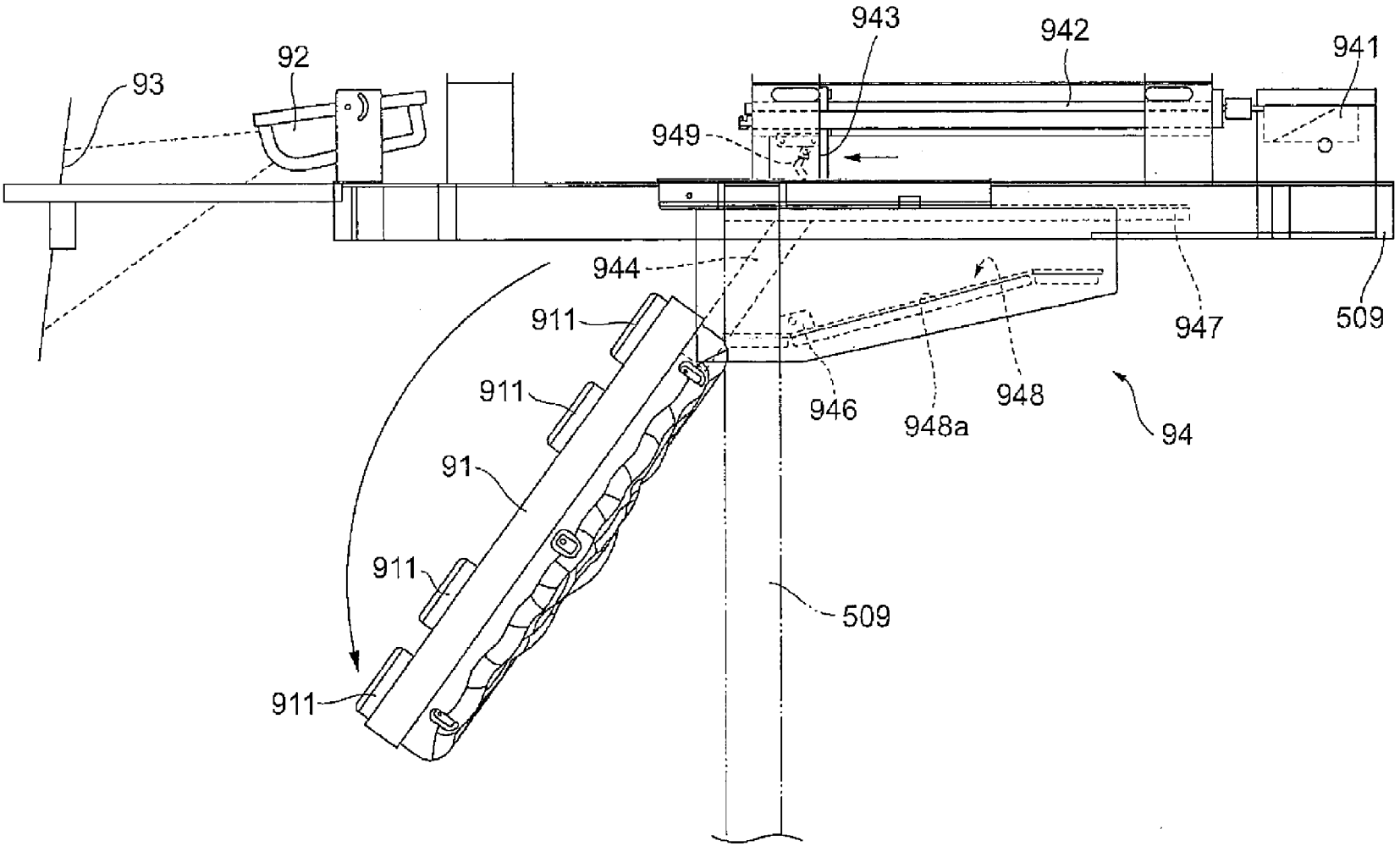
FIG. 30 is a side view illustrating a projection unit and a mechanism for raising and lowering thereof with the projection unit lowered.

Moreover, the elevator mechanism 94 for raising and lowering the projection unit 91 is provided with a guide 948 having an inclined portion 948*a* (see FIGS. 29 and 30). Both end portions of the above-mentioned second shaft 946 are placed, for example, on this guide 948, and the second shaft 946 is guided along the guide 948. In the case of the medal game device 1 of the present embodiment, for example, as the second shaft 946 moves downward along the inclined portion 948*a* of the guide 948, the projection unit 91 lowers while being pushed out towards the front, and moves to a position in front of a player (see FIG. 30, for example).

The following provides an explanation of the operation of the elevator mechanism 94 configured in the manner described above (see FIG. 28, for example). First, when the projection unit 91 is in the initial state, or in other words when housed in a ceiling portion of the medal game device 1 (see FIG. 29), the motor 941 is driven and the feed screw 942 is fed out in the forward direction (direction indicated by the arrow in FIG. 29). Accompanying this movement, the first shaft 945 moves forward along the slide rails 947 and the second shaft 946 moves forward along the guide 948. Accompanying this movement, the projection unit 91 moves so as to be pushed out in the forward direction. As this operation continues, the second shaft 946 approaches the inclined portion 948*a* of the guide 948, after which it moves forward while descending along the incline of the inclined portion 948*a*. Accompanying this movement, an operation that causes the projection unit 91 to rotate forward is added to the sliding operation thereof, the projection unit 91 lowers while being pushed out from the ceiling, and finally stops after being positioned in front of a player (see FIG. 30).

In the present embodiment, for example, a doughnut-shaped roulette wheel and projector images of the target mechanisms 911 arranged on the outer periphery of the roulette wheel are projected onto the projection unit 91 positioned in front of a player as described above by the projection device 92 and the reflecting plate 93, thereby depicting the rotating image of a roulette wheel and images of the mouths of the target mechanisms 911 opening and closing. In this case, the present embodiment is characterized by being able to instill a sense of presence in the player as if playing roulette without having to actually adopt the structure of a rotating roulette wheel. Moreover, if images are projected in coordination with opening and closing operations of the mouths of the target mechanisms 911, for example, effective images can be created in which the actual movement of the mechanisms is synchronized with the images depicted thereon.

(Explanation of Operation)

The following provides an explanation of the operation of the medal game device in the present embodiment. First, an explanation is provided of overall game flow.

(Overall Flow)

A game of the present embodiment consists primarily of an ordinary pusher game in addition to a type of role playing game (RPG) in which a hero displayed on the display portion 20 proceeds through the game while encountering various events. This RPG contains diverse contents in the manner of the hero defeating enemy characters while moving through a plurality of game zones or gathering prescribed game items, and as a result, receiving payment of a corresponding number of medals M and attempting to acquire jackpots allowing the acquisition of a large amount of medals or acquire super jackpot lucky chances employing a progressive mechanism, and proceeds while intermingling mainly slot machine game-based lotteries as well as shooting games and the like made available to a player corresponding to the results of the slot machine game-based lotteries. The following provides an explanation of specific examples thereof.

[Normal Game]

The normal game begins when a player begins the game by inserting a medal M into the medal inserting portion 12 of each satellite portion 2. A game title screen, demonstration screen or screen saver and so forth are displayed on the display portion 20 before a medal M is inserted, and as a result of inserting a medal M, a sound indicating the insertion of the medal M is generated and a game standby screen is displayed on the display portion 20. In addition, by inserting a fixed number of medals M, a progressive value (number of medals able to be paid out in a super jackpot game to be described later) is increased by a prescribed amount. Furthermore, together with the current progressive value being displayed as a numerical value on the display portion 20, that value is accumulated in the upper portion of the rotating center unit as an actual number of medals.

This normal game is a so-called medal pusher game, and medals M that have been inserted into the medal inserting portion 12 move towards the chuckers 35 (indicated with reference symbols 351 and 352 in FIG. 34) over the guide plate 39. More particularly, the chuckers 35 have a plurality of partitions in the form of the first walls W1 and the second walls W2 in the shape of the teeth of a comb provided upright at a prescribed interval on the edge of the disk-shaped bottom portion 35*a*, and reciprocate to the left and right over a prescribed angular range centering on the opening OP (namely, the central axis of the chuckers 35) formed in the center of the disk-shaped bottom portion 35*a*. If a medal M passes through the first slit SL1 or the second slit SL2 without being obstructed by these partitions, a slot machine game to be described later begins.

On the other hand, if a medal M is obstructed by the first walls W1 or the second walls W2 without passing through the first slits SL1 or the second slits SL2 of the chuckers 35, that medal M falls onto the medal table 37 and is retained. When medals M accumulate on the medal table 37, the medals M eventually obstruct the lower end front wall of the pusher table 36 moving forward and backward, and a portion of the medals M are pushed out towards the front of the medal table 37 (towards the player) and fall into the medal collecting portion 38 where they are collected. Medals M that have been collected are paid out to the player. This normal game is performed at all times throughout the entire game at each satellite portion 2 with the exception of prescribed cases.

[Role Playing Game]

As was previously described, the role playing game here unfolds as a hero proceeds through a plurality of game zones, and is comprised of a plurality of battle zones, in which a player gathers items referred to as magic balls, for example, engages in battles with monsters (monster battles) and plays shooting games in the satellite portion 2, bonus zones in which the player engages in monster battles with special monsters, and a final zone in which a shooting game is played to acquire so-called jackpots and super jackpot lucky chances for acquiring even larger numbers of medals. The role playing game starts when a medal M has successfully passed through the chuckers 35, and is comprised of a growing egg event as well as various games accompanied by branching processing based on the results of slot machine game-based lotteries.

(Growing Egg Event)

In a progressive event, when a medal M successfully passes through the chuckers 35, in addition to the chuckers 35 emitting light momentarily, a display is illustrated on the display portion 20 such that a circular display referred to as a "retaining ball" increases one at a time. Up to ten retaining balls, for example, are displayed.

An image of a dragon's egg is displayed in the upper portion of the retaining ball on the screen of the display portion 20, and when another medal M has successfully passed through the chuckers 35 while ten retaining balls are displayed, together with growth value of the egg increasing by one, the egg on the screen is displayed slightly larger, and an image of the egg gradually cracking open is displayed as the growth value increases. When the growth value of the egg reaches 10, an image depicting the egg cracking open and a dragon hatching from the egg is displayed on the display portion 20. Several types of dragons are available, and a different skill is demonstrated on the screen of the display portion 20 depending on the type of dragon.

For example, the dragons may be named "yellow dragon", "red dragon", "brown dragon" and "blue dragon" according to their display color, and in the case of the yellow dragon, together with spewing out and dropping items in the form of a prescribed number (such as 5 to 10) coins from its mouth, a number of medals M equal to the number of coins is actually paid out. Furthermore, "dropping items" refers to displaying an image of the items on the screen of the display portion 20 (and to apply similarly hereinafter). In addition, the red dragon waits behind the hero on the screen of the display portion 20 and defeats a monster appearing in a monster battle to be described later with a single below. On the other hand, the brown dragon drops one item referred to as an advantage item in the form of a prescribed item on the screen of the display portion 20. As a result, an advantageous state results in which each item can be used in a special way. On the other hand, the blue dragon drops a prescribed number of items referred to as "magic balls". Subsequently, the hatched dragons disappear from the screen of the display portion 20 and simultaneous to disappearing off the screen, a new dragon's egg is displayed coming down from above on the display portion 20.

Furthermore, processing for increasing the number of retaining balls during the growing egg event is carried out when a medal M has successfully passed through the chuckers 35 during the time a slot machine game described below is taking place, while the number of retaining balls is controlled to decrease by one each time the slot machine game is played.

(Slot Machine Game-Based Lottery)

In addition, a slot machine game begins when a medal M has successfully passed through the chuckers 35. The slot machine game is performed using three virtual reels displayed on the screen of the display portion 20, and numbers, symbols or other pictures are set for each of the virtual reels. Similar to the rotation of the reels of an ordinary slot machine, the arrangement of the three symbols on the reels determines, for example, whether or not medals M are paid out, the number of medals M paid out, switching the type of game in each battle zone, switching between battle zones, moving to bonus zones or the type of shooting game played in the final zone. The following provides an explanation of the contents of each type of game by using as an example the case of the numbers 1 to 7 and 9, gold coin symbols, treasure chest symbols, bonus zone symbols and two types of special symbols set as pictures on the virtual reels as prerequisites.

<Small Jackpot Event>

If at least one gold coin symbol appears on any of the three virtual reels, a small jackpot event begins, and together with an image of the hero picking up gold coins being displayed on the screen of the display portion 20, the background display displayed thus far is scrolled to cause a different background display to appear (in other words, the background is advanced). In addition, a prescribed number of medals M may be paid out corresponding to the number of gold coin symbols aligned on the three virtual reels (1, 2 or 3). Furthermore, in this small jackpot event, an operation that causes the virtual reel on which a gold coin symbol did not appear to rotate again even if two gold coin symbols are aligned (a so-called advantage action) is not performed.

In addition, as the background display advances, (1) an image depicting the dropping of magic balls, (2) an image depicting the appearance of a bad dragon, or (3) an image depicting the appearance of a monster is displayed on the screen of the display portion 20 when a gold coin symbol has appeared. At this time, the occurrence frequency of the magic balls and monsters varies according to the number of gold coin symbols.

In the case of an image depicting the dropping of magic balls of (1), an image of the hero picking up the magic balls is displayed and the magic ball gauge increases by one (1 UP) a result thereof. When the magic ball gauge increases by one (when the hero acquires a magic ball), the launch button 842 of the medal launching device 8 begins to flash when the turntable unit 500, on which gimmicks are arranged rotating in the center surrounded by the satellite portions 2, approaches the player's satellite portion 2, and when the gimmicks on the turntable unit 500 enter the medal launching area of that satellite portion 2, the motor of the medal launching device 8 is operated and medals M can be launched from the medal launching device 8. At this time, medals M are launched toward the small targets 42 in the form of guard figures installed on the turntable unit 500 by pushing the launch button 842. In the case of having launched medals M with the launch button 842 in this manner, the number of magic balls possessed by the hero decreases by one (1 DOWN).

In the case a medal M has hit the small target 42 causing the small target 42 to be tipped over by the force thereof, together with a light installed below the small target 42 flashing, an item (randomly selected from a prescribed number of coins, prescribed number of magic balls, advantage item or mirror fragment and the like) is dropped on the screen of the display portion 20. Next, when the gimmicks on the turntable unit 500 have passed the player's own satellite portion 2 and moved out of the medal launching area thereof, when the number of magic balls possessed by the hero has reached zero, or when all of the small targets 42 have been tipped over, the launch button 842 goes out and the motor of the medal launching device 8 is stopped.

In addition, when the image of a bad dragon has appeared as in (2), a shooting game begins in which the moving targets 41 are shot at with medals M. In this shooting game, medals M are launched from the medal launching device 8 towards the moving targets 41 for a prescribed time (such as 10 seconds) and a prescribed launching interval (such as every 0.2 to 0.5 seconds) in an attempt to shoot (cause to enter) the medals M into the mouths of the moving targets 41.

The moving targets 41 are made to perform warning operations such as flapping their wings or flashing their eyes, and together with stopping the pusher portion 3 on that satellite portion 2, an explanation of the shooting game is displayed on the display portion 20 once execution of the shooting game has been confirmed. Once this explanation is completed, the display portion 20 moves downward. After the moving targets 41 have temporarily paused at a position in the center at the top of the display portion 20, they move to the left and right while flapping their wings towards the player once the launch button 842 of the medal launching device 8 has lit. At this time, a plurality of different movement patterns is available for the movement pattern of the moving targets 41, and each movement pattern is controlled to be randomly selected. One example of a movement pattern consists of the moving targets 41 moving up and down while moving to the left and right in the manner of a wave. Furthermore, even if moving in this manner, since the display portion 20 has moved downward, the display portion 20 does not obstruct the moving targets 41.

Next, when a medal M launched from the medal launching device 8 has entered the mouth of the moving targets 41 and successfully passed through the chuckers, the lights in the eyes of the moving targets 41 flash while the wings begin to flap faster than normal (indicating an image of pain), and an item (randomly selected from a prescribed number of coins, prescribed number of magic balls, advantage item or mirror fragment and the like) is dropped on the screen of the display portion 20. When a time limit has elapsed, launching of medals from the medal launching device 8 stops and the moving targets 41 are returned to their original starting positions while flapping their wings slowly. After the moving targets 41 stop flapping their wings and the lights of their eyes go out, the display portion 20 moves upward and returns to its original position to end the shooting game.

On the other hand, a monster battle begins when an image depicting the appearance of a monster is displayed on the display portion 20 as in (3). In this monster battle, a slot machine referred to as a battle slot machine that differs from the slot machine containing numbers or symbols is displayed on the display portion 20, and whether or not the monster has been defeated is determined by the alignment result of that slot machine. As a result, in the case the monster has been defeated, a prescribed number of medals M are paid out.

<Large Jackpot Event>

When the same prescribed numbers are aligned on the three virtual reels, a large jackpot event takes place and a number of medals M greater than the number of medals in the small jackpot event described above is paid out (such as 20 to 50 medals, the amount differing in increments of 5 medals depending on the number on the virtual reels). In addition, in the large jackpot event, the battle zone changes randomly after which various types of games previously described and described later are played in the different battle zones. Furthermore, in this large jackpot event, an operation that causes the virtual reel on which the same number did not appear to rotate again even if two of the same numbers are aligned (a so-called advantage action) is performed.

Moreover, in the large jackpot event, there are two types of modes available in the form of a "normal jackpot" and a "variable probability jackpot" corresponding to the aligned numbers. In the case of a normal jackpot, the chuckers 35 are rotated from the previous state of the chuckers 35 by a fixed angle (for example, rotated in the direction indicated by arrow Y2 in FIG. 34) by the rotating mechanism 18 so that the first region R1, in which the first slits SL1 having the narrowest slit width are formed in the chuckers 35, is positioned in front towards the player. On the other hand, in the case of a variable probability jackpot, the setting for rotating the chuckers 35 at a fixed angle is changed (for example, by rotating in the direction indicated by arrow Y2 in FIG. 34) from the previous state of the chuckers 35 by the rotating mechanism 18 so that the second region R2, in which the second slits SL2 having a wider slit width are formed, is facing towards the player (front). The player then continues to play the game by inserting a medal M into the medal inserting portion 12 in the state of these new settings.

Here, although there are no particular limitations on the specific procedure for control processing that switches between the first region R1 and the second region R2, an example of the procedure is described below. Namely, when a medal M enters a winning prize port in the form of the opening 33 through the opening OP, control means in the form of the CPU 201 judges that the medal has successfully passed through the chuckers based on a detection signal from the sensor 301. Slot machine game processing is then executed premised on the medal having successfully passed through the chuckers, and together with determining the type of jackpot (and in the example above, either a normal jackpot or variable probability jackpot), the region R1 or R2 corresponding to that jackpot is selected by referring to a data table stored in advance in the memory 202, for example. The rotating mechanism 18 is then operated so that the selected region (the first region R1 or the second region R2) is positioned in front towards the player based on a control signal from the CPU 201, and a command signal is then sent to the rotating mechanism 18 to cause the slits of that region to reciprocate to the left and right.

<Lucky Chance Game Event>

When a prescribed number (such as a 3 or 7) is aligned on the three virtual reels, a "lucky chance game" is executed without changing the battle zone or background screen displayed on the display portion 20. In this lucky chance game, the chuckers 35 are rotated by a prescribed angle, and the setting is changed from the previous status of the chuckers 35 so that the third region R3, in which the open portion P is provided without providing the first walls W1 or the second walls W2 serving as obstacles to successful entry of medals M, faces toward the front. Furthermore, this processing for changing the setting to the third region R3 in this manner can be carried out in the same manner as controlling switching between the first region R1 and the second region R2 by the control means in the form of CPU 201 and the rotating mechanism 18 as previously described. As a result, nearly all of the medals M inserted into the medal inserting portion 12 continuously successfully pass through the chuckers 35. The duration of this open state (for example, 10 seconds) is defined as one set, and together with repeating three of these sets, a prescribed number of times the number of medals M that entered the chuckers 35 is paid out. Following completion of three sets, a slot machine game is repeated, for example, 10 times. Here, when a prescribed number is aligned again on the three virtual reels, the processing is repeated and the player is able to play the lucky chance game again.

<Treasure Chest Event>

When the treasure chest pictures are aligned on the three virtual reels, the "treasure chest event" is executed without changing the battle zone or background screen displayed on the display portion 20. Here, the hero is depicted to start to run and a large treasure chest is displayed on front of him on the screen of the display portion 20. When the hero reaches the treasure chest, he opens the treasure chest and an image is displayed of the treasure chest spewing out a large number of items and medals M. The number of medals M may be varied from 20 to 50 medals, for example, the amount differing in increments of 5 medals depending on the treasure chest.

<Special Monster Event>

When pictures of the bonus zone symbol are aligned on the three virtual reels, together with a prescribed number of medals M (such as 20 to 50) being paid out, the screen on the display portion 20 changes and processing for a bonus game zone is carried out. In the bonus game zone, special monsters in the form of special types of monsters appearing in the battle zone appear on the screen of the display portion 20. When a special monster appears, whether or not the special monster is defeated is determined based on the alignment result of the same battle slot machine as that used for the monster battles in the small jackpot event previously described. As a result, in the case the special monster has been able to be defeated, a larger number of medals M are paid out than the number of medals M paid out after having defeated a monster in the small jackpot event (for example, a number of medals M equal to the number of medals M paid out after having been successful in the jackpot lucky chance described below.

<Jackpot Lucky Chance>

When a "mirror" is completed by gathering a prescribed number (for example, 3) of mirror fragments during the course of games in each battle zone, the game screen changes from the battle zone to the final zone. In the final zone, a slot machine game is played using three virtual reels and pictures depicting, for example, two types of special symbols on each virtual reel displayed on the screen of the display portion 20.

In this slot machine game, if the jackpot symbols align on the three virtual reels, the gimmicks on the turntable unit 500 are rotated so as to be located in front of that satellite portion 2 while changing the illumination and music (BGM) of the enclosure of the medal game device 1. During this rotation movement, a screen explaining the jackpot lucky chance game is displayed on the display portion 20 to provide an explanation of the rules and the like to the player. Once the gimmicks on the turntable unit 500 are positioned in front of the player's satellite portion 2, the turntable unit 500 stops rotating and a desired light and sound presentation is performed. Next, the pusher portion 3 of that satellite portion 2 stops and the display portion 20 moves downward while lowering all of the small targets 42 in the form of guards together with moving the obstacles 44 (such as the arms of a figure) of the large target 43 which is larger than the small targets 42. Next, the motor of the medal launching device 8 is operated enabling medals M to be launched from the medal launching device 8.

This shooting game is a game in which medals M are launched from the medal launching device 8 towards the large target 43 for a prescribed time (such as 20 seconds) and a prescribed launching interval (such as every 0.2 to 0.5 seconds) in an attempt to shoot the medals M into the mouth of the large target 43. Medals M are launched toward the large target 43 when the launch button 842 is pushed. At this time, the obstacles 44 of the large target 43 are moved to obstruct the medals M from entering the mouth of the large target 43. If a medal M successfully enters the mouth of the large target 43, a prescribed number of medals M (such as 5) each are added to the number of medals M to be paid out, and finally the total number of medals M added corresponding to the number of times a medal M successfully entered the mouth of the large target 43 within the time limit and the basic number of medals paid out for the jackpot (such as 50) are paid out.

When the time limit has elapsed, the obstacles 44 of the large target 43 stop moving, the gate provided in front of the lower portion of the turntable unit 500 opens by lowering, and a cup-shaped unit 17 installed behind the gate (on the opposite of the player) and containing medals to be paid out is moved forward (toward the player) and over the medal table 37 of that satellite portion 2 by a link mechanism, thereby allowing the medals M inside the cup-shaped unit 17 to be discharged to the satellite portion 2.

Next, the cup-shaped unit 17 returns to its original location and the gate is raised followed by the display portion 20 being moved upward together with the turntable unit 500 returning to its normal rotating state and reactivating the pusher portion 3 thereby completing the shooting game.

<Super Jackpot Game>

On the other hand, if a super jackpot symbol is aligned on the three virtual reels in the slot machine game, the gimmicks on the turntable unit 500 are rotated so as to be located in front of that satellite portion 2 while changing the illumination unit 700 and music (BGM) of the medal game device 1. During this rotation movement, a screen explaining the jackpot lucky chance game is displayed on the display portion 20 to provide an explanation of the rules and the like to the player. Once the gimmicks on the turntable unit 500 are positioned in front of the player's satellite portion 2, the turntable unit 500 stops rotating and a desired light and sound presentation is performed. Next, the projection unit of the projector device moves so as to be pushed out towards the front (towards the player) and lowered together with lowering all of the small targets 42. Next, the pusher portion 3 of that satellite portion 2 stops and the display portion 20 moves downward. Next, the motor of the medal launching device 8 is operated enabling medals M to be launched from the medal launching device 8.

This shooting game is a game in which projected images of a doughnut-shaped roulette wheel and target mechanisms 911 arranged on the outer periphery thereof are projected onto the projection unit, and medals M are shot into the mouths of the target mechanisms 911 while depicting images of a rotating roulette wheel and opening and closing mouths of the target mechanisms 911. If a medal M hits in the region inside a mouth when a mouth of the target mechanisms 911 is open, the image of the rotating roulette wheel stops and a number indicating the number of winning medals or the super jackpot symbol is displayed in a region inside the roulette wheel.

(Case of Super Jackpot Symbol being Displayed Inside Roulette Wheel)

In this case, the turntable unit 500 is reciprocated within a fixed angular range so that the gimmicks on the turntable unit 500 face towards the front of the satellite portions 2, 2 immediately on both sides of the satellite portion 2 used to play the shooting game, and this operation is repeated several times. During this time, medals M can be launched towards the gimmicks on the turntable unit 500 from the satellite portion 2 used to play the shooting game as well as from the satellite portions 2 located on both sides thereof, and each of the players launches medals M toward the gimmicks using their respective medal launching device 8. When the total number of medals launched reaches a limiting number, the reciprocating motion of the turntable unit 500 stops, and the turntable unit 500 rotates so that the gimmicks are facing towards the front of the satellite portion 2 at which the shooting game event occurred and then stops.

Next, together with the projection unit returning to its initial state, the lower gate portion 46 provided in the lower portion of the gimmicks of the turntable unit 500 opens, the upper gate portion 47 provided in the upper portion of the gimmicks also opens, and the medals M retained by being interrupted by these gate portions are discharged into the cup-shaped unit 17 previously described. Furthermore, while the basic number of medals M for the super jackpot (for example 50) accumulate in the lower gate portion 46, the large number of medals M equivalent to a progressive value are retained in the upper gate portion 47.

Next, the gate provided in front of the lower portion of the turntable unit 500 opens, and the cup-shaped unit 17 installed behind the gate that has received transfer of medals to be paid out is moved forward (toward the player) and over the medal table 37 of the satellite portion 2 by a link mechanism, thereby allowing all of the medals M inside the cup-shaped unit 17 to be discharged to the satellite portion 2. The cup-shaped unit 17 then returns to its original location and the gate is closed followed by the display portion 20 being moved upward together with the turntable unit 500 returning to its normal rotating state and reactivating the pusher portion 3 thereby completing the shooting game.

(Case of Super Jackpot Symbol not being Displayed Inside Roulette Wheel)

In this case, the winning number of medals M displayed when the roulette wheel has stopped is paid out and added to the number of medals. Although opening and closing of the mouth of the target mechanism 911 hit by the medal M is stopped, the adjacent target mechanisms 911 are displayed as targets in its place, enabling the player to continue to launch medals M towards the mouths of these other target mechanisms 911.

In the case medals M have hit the mouths of all of the other target mechanisms 911 and the super jackpot system is not displayed inside the roulette wheel, or in the case a prescribed time limit has elapsed, together with the projection unit returning to its initial state, the lower gate portion 46 provided in the lower portion of the turntable unit 500 opens and medals M retained by being interrupted by the lower target portion 46 are discharged into the cup-shaped unit 17 previously described. Furthermore, the basic number of medals M for the super jackpot (for example 50) accumulate in the lower gate portion 46.

Next, the gate provided in front of the lower portion of the turntable unit 500 opens, and the cup-shaped unit 17 installed behind the gate that has received transfer of medals to be paid out is moved forward (toward the player) and over the medal table 37 of the satellite portion 2 by a link mechanism, thereby allowing all of the medals M inside the cup-shaped unit 17 to be discharged to the satellite portion 2. The cup-shaped unit 17 then returns to its original location and the gate is closed followed by the display portion 20 being moved upward together with the turntable unit 500 returning to its normal rotating state and reactivating the pusher portion 3 thereby ending the shooting game.

The series of games described above are repeated during the time medals M are inserted into the medal inserting portion 12. In addition, each of the operations described above are suitably carried out by suitably notifying of status between the main unit 100 and each of the satellite units 200 under the control of either unit.

According to the chuckers 35 configured in this manner and the medal game device 1 provided therewith, since the first width of the first slits SL1 differ from the second width of the second slits SL2 of the chucker 35, the degree of difficulty of medal passage varies. Accordingly, by simply setting the rotation of the chuckers 35 with the rotating mechanism 18 so as to switch the path of a medal inserted into the medal inserting portion 12 to reach either the first region R1 or the second region R2, the degree of difficulty of medal passage and ultimately the probably of a medal successfully entering the winning prize port can be varied easily without requiring a complex structure as in the prior art.

In addition, since the first slits SL1 and the second slits SL2 are formed along the peripheral edge of the disk-shaped bottom portion 35*a* and arranged in the shape of an arc, the entrance angle when a medal M has reached the slits is less severe as compared with the slits of a flat plate of the prior art. As a result, the degree of difficulty of medal passage through the slits is not excessively high for a player and a suitable probability of winning is ensured, thereby maintaining the level of interest in the game. In other words, in addition to simplifying the configuration of the medal game device 1 while reducing the scale of the device, the difficulty of medal passage can be easily adjusted by suitably switching between the first slits SL1 and the second slits SL2 according to the situation of the game.

Moreover, since the opening OP is provided in the central portion of the chuckers 35 and that opening OP communicates with a winning prize port in the form of the opening 33, the winning prize port is substantially integrally provided with the chuckers 35, and a medal M that has passed through the first slits SL1 or the second slits SL2 is immediately guided to the winning prize port. Thus, it is no longer necessary to provide the winning prize port and guide portion leading thereto separately, thereby making it possible to further simplify the configuration of the medal game device 1. Moreover, since the disk-shaped bottom portion 35*a* is formed in the shape of a mortar and the opening OP is formed in the center of that mortar, a medal M that has passed through the first slits SL1 or the second slits SL2 is more easily guided to the winning prize port in the form of the opening 33.

Moreover, since the first slits SL1 are formed by a plurality of the first walls W1 and the second slits SL2 are formed by a plurality of the second walls W2, the first slits SL1 and the second slits SL2 can be formed without forming hole-shaped slits by providing holes in a plate, thereby eliminating the upper walls of the slits and simplifying the configuration of the chuckers 35 and ultimately the medal game device 1. In addition, the first walls W1 and the second walls W2 also serve as guides that guide a medal M that has passed through the first slits SL1 and the second slits SL2, respectively, to the central opening OP, thereby further facilitating the guidance of medals M to the opening 33.

In addition, since the first walls W1 and the second walls W2 are formed to have a prescribed thickness and to be tapered towards the opening OP in the disk-shaped bottom portion 35*a* (or in other words, the central portion thereof), in addition to a medal M that has passed through the first slits SL1 or the second slits SL2 being more easily guided to the opening 33, mold separation becomes easier when fabricating the first walls W1 and the second walls W2 using a mold, thereby enhancing the production efficiency of the chuckers 35.

Moreover, since the grooves Mz extending radially along the radial direction are formed in the disk-shaped bottom portion 35*a*, a medal M that has passed through the first slits SL1 or the second slits SL2 is more easily guided to the winning prize portion in the form of the opening 33.

In addition, since the barrier portions 35*b* having a width larger than the width of the first width and/or second width are provided on both sides of the first region R1, the second region R2 and the third region, respectively, in addition to facilitating well-defined mutual separation of each of the regions R1, R2 and R3, medals M can be prevented from entering from both sides of the first slits SL1 and the second slits SL2 when the chuckers 35 is rotated within a prescribed angular range and the first slits SL1 and the second slits SL2 reciprocated to the left and right in the circumferential direction of the disk-shaped bottom portion 35*a*.

In addition, since the disk-shaped bottom portion 35*a* is provided with the third region R3 not provided with obstructions such as slits or walls, the entry of medals M into the chuckers 35 is not restricted in the case the third region R3 is facing toward the front. Accordingly, the probability of medals entering the winning prize port in the form of the opening 33 is increased considerably, and as a result, a prescribed privilege can be given to a player using the chuckers 35, thereby making it possible to enhance the variety of the game.

Furthermore, the reciprocating (left and right) motion of the chuckers 35 may be interrupted by stopping operation of the rotating mechanism 18 based on a control signal from control means in the form of the CPU 201 when prescribed conditions have been satisfied in a slot machine game. When configured in this manner, since the level of difficulty of the passage of medals M through the slits decreases as compared with the case of rotating the chuckers 35 so as to reciprocate to the left and right, adjustment and control can be carried out in the manner of increasing the probability of a winning medal when the chuckers 35 are rotated by a prescribed angular range under normal conditions.

Moreover, since the guide plate 39 is provided, inserted medals M are released onto the guide plate 39, and the medals M are able to rapidly and smoothly move towards the chuckers 35 due to the incline of the guide member 39, thereby increasing the efficiency reaching the chuckers 35. In addition, since the guide member 39 is inclined, a medal M that has fallen onto the guide plate 39 without rolling is also able to move towards the chuckers 35 and drop onto the medal table 37 there below. Moreover, since the guide plate 39 is fixed to the pusher table 36, the guide plate 39 moves forward and backward with the pusher table 36 enabling the distance between the chuckers 35 and the guide plate 39 to be kept constant. Accordingly, medals M can be prevented from dropping onto the medal table 37 without reaching the chuckers 35.

The following provides an explanation of the flow of processing for launching medals M in the medal launching device 8 of the present embodiment.

First, since the medal launching device 8 is not used during normal game play, the CPU 201 of the satellite units 200 controls the locking mechanism 881 to lock the first operating table portion 86 to prevent the medal launching device 8 from rocking to the left and right. In addition, the operations of the roller drive motor 823 and the medal supply motor 812 are stopped. During normal game play, a player inserts medals M into the medal inserting portion 12 and plays a medal game such as a medal pusher game. Furthermore, during normal game play, the display portion 20 is in the standard position (default position).

In a medal game during normal game play, when a preset condition such as a medal having successfully passed through the chuckers or the virtual reels on a slot machine having aligned has been detected by the CPU 201, a shooting flag is set. The main unit 100 and the satellite units 200 judge the current game mode at an intermediate point of loop processing based on a flag, and when a shooting flag is detected, the game mode is changed from the normal game to the shooting game. In addition, when a shooting flag has been set, the CPU 201 determines the maximum number of medals M that can be launched in the shooting game.

For example, when a medal successfully passes through a prescribed chucker, a slot machine game is executed on the display portion 20, and the number of medals M able to be launched, such as a maximum of 30, is determined corresponding to the contents of the symbols on the slot machine that aligned. In this manner, the normal game and the shooting game are interlinked, and the number of medals M able to be launched is determined corresponding to the results of the games executed on the display portion 20.

When a shooting game is begun, the CPU 201 controls driving of the roller drive motor 823 to start rotation of the rotating roller 822. In addition, the CPU 201 controls driving of the drive motor 214 to move the display portion 20 downward. Moreover, the CPU 201 controls a presentation such as causing the light-emitting device 844 embedded in the launch button 842 to flash and playing BGM for the shooting game from the speaker 26, thereby allowing the player to be aware that a shooting game using the medal launching device 8 will start. In addition, at this time, the CPU 201 determines a launching velocity parameter based on events occurring corresponding to the progress status of the game, and controls launching of medals launched from the medal launching device 8 by adjusting the takeoff force imparted to medals with the medal propelling unit 82 in accordance with the launching velocity parameter.

The details of the processing for controlling medal launch velocity are as described below. First, when game play has changed from the normal game to the shooting game mode, the CPU 201 determines an event corresponding to the progress status of the game. Here, for example, a target to be aimed at by the player is determined. The CPU 201 then recalls the rotating speed of the roller drive motor 823 by referencing the settings table 825 in the memory 202 and begins to drive and rotate the roller drive motor 823 at that rotating speed. During the time a presentation and the like is depicted on the display portion 20 and the like, the rotating speed of the roller drive motor 823 increases and about the time the presentation ends, the roller drive motor 823 is uniformly rotating at the previously recalled rotating speed.

Subsequently, the locked status of the locking mechanism 881 of the supporting unit 88 is released under the control of the CPU 201, and together with the operating table 80 being able to be operated upward, downward, leftward and rightward, the CPU 201 begins accepting operating signals from the trigger sensor enabling medals M to be launched from the medal launching device 8. Thus, preparations are made to be able to immediately launch medals at a prescribed launching velocity once an instruction to launch medals is input from a player.

In the subsequent shooting game, the player determines the launching direction of the medals M by operating the operating table 80 with the lever 23 and rocking the orientation of the launching rail 831 upward, downward, leftward or rightward. The player then pushes the launch button 842 to launch medals M towards a target.

At this time, the CPU 201 begins driving the medal supply motor 812 in response to an operating signal of the launch button 842 emitted from the trigger sensor 843, rotates the rotating disk 815 of the mini-hopper 811, and controls operation of the mini-hopper 811 so that a single medal M is supplied to the medal propelling unit 82 via the medal supply port 814. A medal M interposed between the rotating rollers 821 and 822 of the medal propelling unit 82 is then propelled (imparted with takeoff force) by the rotating force of the rotating rollers 821 and 822, and the medal M travels over the launching rail 831 and is launched from the medal launching port 833. Furthermore, in the case the launch button 842 is depressed continuously, launching is controlled so that medals M are launched continuously at a predetermined time interval.

In the satellite units 200, in the case a detection signal has been supplied from the trigger sensor 843 of the medal launching device 8, and a detection signal is supplied from the medal sensor 837 within a fixed amount of time, the actual launching of a medal M is judged to be valid. This is because there are cases in which a medal M may actually not be launched when the launch button 842 is pressed due to, for example, the medals being jammed. Once a medal has been judged to have actually been shot, a command indicating that a medal has actually been shot is notified to the main unit 100 via the interface circuit 203.

In addition, the CPU 201 also performs control so that medals M are automatically replenished to the medal supply unit 81 of the medal launching device 8 via the medal transport unit 27 in coordination with launching of the medals M by the medal launching device 8. At this time, after having received a launch detection signal from the medal sensor 837 and controlling a payout destination allocation solenoid provided on the transport rail 272 to switch the switching flap 273 to the side of the medal launching device 8 (the first transport path 274), the CPU 201 drives the motor 212 of the satellite hopper 25. As a result of driving the motor 212, medals M are pushed from the bottom to the top of the medal guide 271, pass over the transport rail 272, and a prescribed number of medals M are sent from the outlet of the transport rail 272 to the pool portion of the mini-hopper 811 of the medal launching device 8 via the medal replenishing hole 876 where the medals M are replenished. Furthermore, when processing for paying out medals for a small jackpot to the pusher portion 3 is carried out, the CPU 201 switches the switching flap 273 to the side of the pusher portion 3 (the second transport path 275) with the payout destination allocation solenoid, and then operates the satellite hopper 25 to carry out processing for paying out a prescribed number of medals to the pusher portion 3.

Subsequently, when an event of the shooting game has been completed successfully by satisfying a predetermined condition, a time limit has elapsed, or the maximum number of medals M able to be launched have all been launched, the CPU 201 no longer accepts operating signals from the trigger sensor 843, discontinues driving of the roller drive motor 823, and locks the locking mechanism 881 to prevent the medal launching device 8 from being rocked left and right. Moreover, the display portion 20 is moved upward and returned to its original standard position by controlling the drive motor 214. This completes the shooting game. Furthermore, when an event has been successfully completed, medals may be paid out to the player and a game image and the like corresponding to successful completion of the event may be displayed on the display portion 20.

Furthermore, the present invention is not limited to the embodiment described above, but rather can be altered in various ways provided that the gist thereof is not changed. For example, the chuckers 35 may have another region in which slits having a different slit width are formed. In addition, the slits of the chuckers 35 may be formed by providing holes in a curved plate having a curvature equal to the curvature of the outer periphery of the disk-shaped bottom portion 35*a*.

Figure 32:
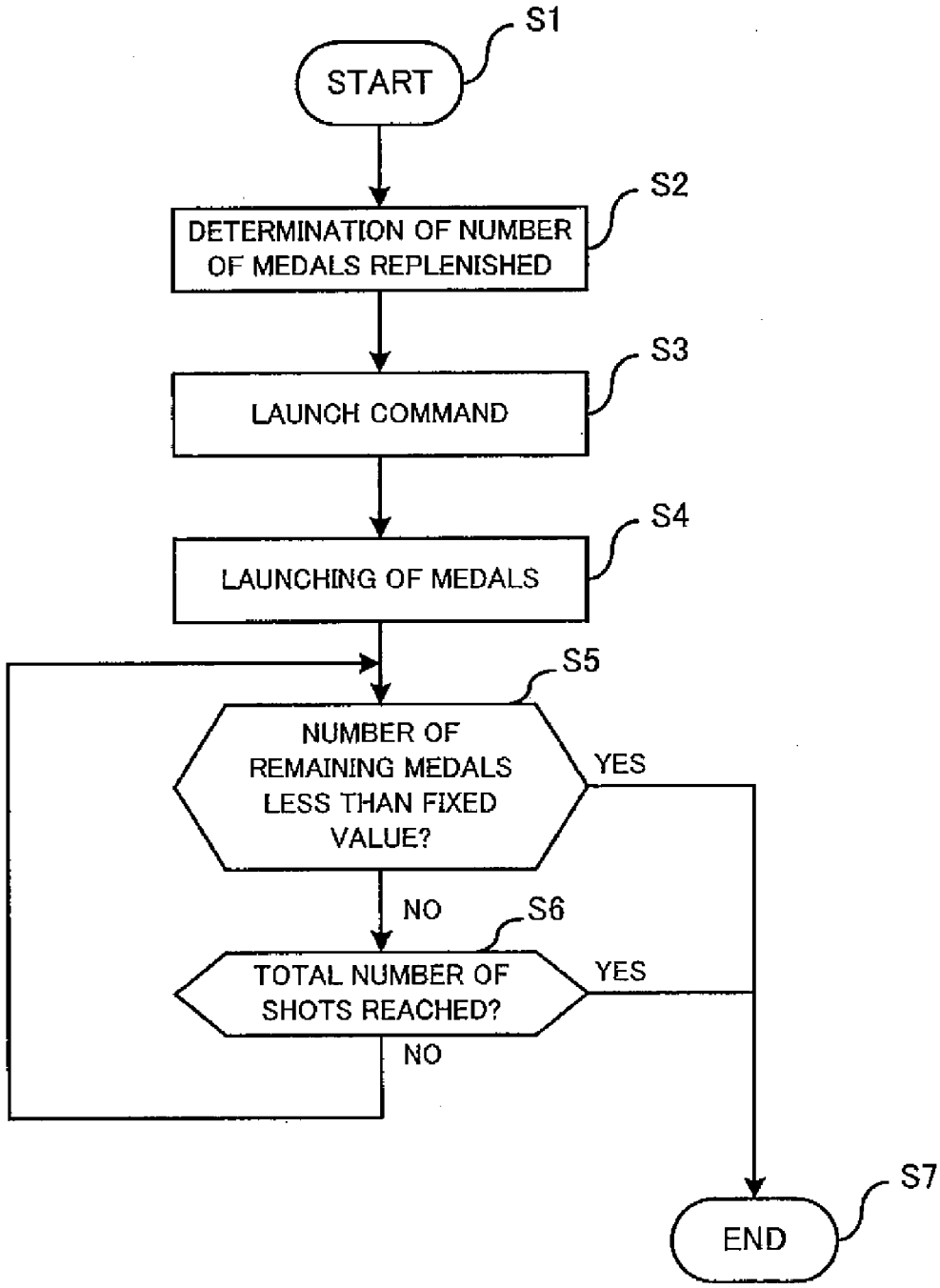
FIG. 32 is a flow chart illustrating the flow of a medal distribution adjustment technique for replenishing medals to a main hopper.

In addition, the following provides an example of the flow for replenishing medals M to the main hopper 531 (see FIG. 32). First, the flow of replenishing medals M to the main hopper 531 begins (Step 1). There are no particular limitations on the time at which replenishment of medals to the main hopper 531 is executed, and in the present embodiment, for example, in the case a super jackpot (SJP), namely a jackpot in which a larger number of medals are paid out than an ordinary jackpot (JP), is won at any of the satellite portions 2, medals M are replenished in advance by executing processing in accordance with this flow at a stage prior to switching to the SJP processing (see FIG. 32).

Once a super jackpot lucky chance begins and the replenishing flow has started, the number of medals to be replenished (total number of shots) is first determined (Step 2). For example, the total number of medals (total number of shots) shot from the medal launching device 8 towards the rotating center unit 6 at each satellite portion 2 can be treated as the number of medals to be replenished as referred to here. As an example thereof, the total number of shots from each satellite portion 2 in this case can be determined from the number of medals supplied from the main hopper 531 to the jackpot portion 4 following the previous replenishment, and the number of medals collected (number of medals stored) either detected or approximated by the previously described medal quantity sensor 531*a*.

Once the number of medals to be replenished has been determined, processing proceeds to shooting (launching of medals) from each satellite portion 2. Here, a launch command is transmitted from the CPU 101 of the main unit 100 to the CPU 201 of the satellite unit 200 so that shooting of medals is executed from the medal launching device 8 of the satellite portion 2 used to shoot medals (Step 3). Furthermore, the satellite portion 2 to be used to shoot medals in the case of the present embodiment refers to all satellite portions 2 except for the satellite portion 2 for which processing has switched to a super jackpot lucky chance. These satellite portions 2 receive a launch command as described above and begin shooting (launching medals) (Step 4).

Once shooting has started, a judgment is made as to whether or not the number of medals remaining in the satellite portions 2 being used for shooting is less than a fixed value for each of the satellite portions 2 (Step 5). In the case the number of remaining medals is less than the fixed value (Yes in Step 5), the number of medals remaining in the satellite portions 2 is judged to be low, further shooting (launching of medals) is denied, and the series of replenishment flow steps in that satellite portion 2 ends (Step 7).

In addition, in the case the remaining number of medals in the satellite portions 2 is judged to not be less than the fixed value (No in Step 5), a judgment is made as to whether or not the number of medals replenished in the medal game device 1 has reached the number of medals to be replenished (total number of shots) determined in Step 2 (Step 6). If it has been judged that the number of medals to be replenished has been reached (Yes in Step 6), shooting at all the satellite portions 2 is terminated and the series of replenishment flow steps ends (Step 7). On the other hand, if the number of medals to be replenished has not been reached, processing loops back to Step 5 and shooting (launching of medals) is continued until the number of medals to be replenished is reached or the number of medals remaining in the satellite portions 2 falls below the constant value (see FIG. 32).

According to the medal game device 1 employing a replenishment flow for medals M to the main hopper 531 in this manner, since processing is carried out that eliminates any unevenness in the distribution of medals in the medal game device 1 by transferring medals M based on the replenishment flow as described above at the start of a super jackpot lucky chance, a situation in which there is a temporary shortage of the number of medals housed in the main hopper (medal collecting container) 531 can be eliminated in advance.

Moreover, since medals can be replenished using an existing device in the form of the medal launching device 8, it is not necessary to separately provide a device for collecting medals. This type of so-called medal allocation adjustment method is particularly effective in the medal game device 1 of the present embodiment installed with a large number of the satellite portions 2. In addition, since adjustment of the allocation of medals is performed while automatically presenting congratulations from other players for the player that has won a super jackpot lucky chance in the present embodiment, this is also characteristic in the sense that the overall atmosphere of the medal game device 1 can be made to be more exciting.

Furthermore, during the flow of medal replenishment (see FIG. 32), after shooting has started (Step 4), a judgment is made as to whether or not the remaining number of medals in the satellite portions 2 is less than a fixed value for each of the satellite portions 2 (Step 5), and more specifically, a so-called near empty sensor is sufficient for judging whether or not the remaining number of medals is equal to or less than a fixed value. In contrast, if a sensor is used that is able to precisely determine the number of medals remaining, a judgment can also be made for each of the satellite portions 2 as to whether the satellite portions 2 are able to shoot (able to launch medals). In such a case, so-called self-management can be carried out in which a judgment as to whether or not each of the satellite portions 2 is able to shoot can be made spontaneously by the satellite portions 2 when processing has switched to a super jackpot lucky chance.

As has been explained above, since a chucker with slits and a medal game device provided therewith are capable of reducing the scale of a device with a simple configuration and allowing the degree of difficulty of medal passage to be adjusted properly and conveniently according to the situation of a game, the chucker with slits and medal game device provided therewith can be widely used in arcade games in the form of medal game machines as well as home use games in the form of game programs in which the device is simulated with video images.

We claim:

1. A medal game device that is provided with a medal inserting portion into which a medal is inserted, and a winning prize port formed to be able to receive the inserted medal, and that is configured so as to give a prescribed privilege to a player at least on a condition that the medal has entered the winning prize port, comprising:

a chucker provided with a disk-shaped bottom portion having in a central portion thereof an opening communicating with the winning prize port and formed to allow insertion of the medal, a first region having a plurality of first slits having a first width larger than a thickness of the medal and formed along a peripheral edge of the disk-shaped bottom portion on a portion of the peripheral edge, and a second region having a plurality of second slits having a second width differing from the first width and formed along the peripheral edge of the disk-shaped bottom portion on another portion of the peripheral edge, a rotating mechanism that rotates the chucker about the opening, and control means for controlling the rotating mechanism so that one of either the first region and the second region is arranged in opposition to a direction of movement of the medal inserted into the medal inserting portion and so that the chucker moves reciprocally within a prescribed angular range about the opening, and controlling the rotating mechanism so that, when a prescribed condition is satisfied, the other region of the first region and the second region is arranged in opposition to the direction of movement of the medal and so that the chucker moves reciprocally within a prescribed angular range about the opening.

2. The medal game device according to claim 1, wherein the chucker is provided with a third region left open so as not to obstruct the medal in still another portion of the peripheral edge of the disk-shaped bottom portion, and the control means controls the rotating mechanism so that so that one of either the first region and the second region is arranged in opposition to the direction of movement of the medal inserted into the medal inserting portion and so that the chucker moves reciprocally within a prescribed angular range about the opening, and rotates the chucker so that the third region opposes the direction of movement of the medal by controlling the rotating mechanism when a prescribed condition is satisfied.

3. The medal game device according to claim 1, wherein the control means stops the reciprocal movement of the chucker by controlling the rotating mechanism when a prescribed condition is satisfied.

4. The medal game device according to claim 1, further comprising a medal table on which a plurality of medals are placed, including the medal inserted into the medal inserting portion, and a pusher table that is reciprocally provided on the medal table along the upper surface of the medal table and that pushes out the plurality of placed medals to the end of the medal table, wherein the chucker is provided on the pusher table.

5. The medal game device according to claim 1, further comprising a plate-like guide member that guides medals inserted into the medal inserting portion towards the chucker, wherein the guide member is arranged in front of the chucker, and supported by the pusher table inclined so that the edge thereof on the side of the medal inserting portion is higher than the edge thereof on the side of the chucker.

6. The medal game device according to claim 1, wherein the first slits are formed by providing a plurality of first walls upright on a portion of the peripheral edge separated by the first width, and the second slits are formed by providing a plurality of second walls upright on another portion of the peripheral edge separated by the second width.

7. The medal game device according to claim 1, wherein the first walls and/or the second walls are formed to have a prescribed thickness and to be tapered towards the opening in the disk-shaped bottom portion.

8. The medal game device according to claim 1, wherein the first slits and the second slits have a prescribed thickness along a radial direction of the disk-shaped bottom portion.

9. The medal game device according to claim 1, wherein the disk-shaped bottom portion is provided with a groove extending radially along a radial direction.

10. The medal game device according to claim 1, further comprising barriers having a width larger than the first width and/or the second width on both sides of the first region and/or the second region, respectively.

11. The medal game device according to claim 1, wherein a third region left open so as not to obstruct the medal is provided in still another portion of the peripheral edge of the disk-shaped bottom portion.

* * * * *

UNITED STATES PATENT AND TRADEMARK OFFICE

CERTIFICATE OF CORRECTION

PATENT NO. : 7,845,640 B2
APPLICATION NO. : 12/300268
DATED : December 7, 2010
INVENTOR(S) : Motegi et al.

It is certified that error appears in the above-identified patent and that said Letters Patent is hereby corrected as shown below:

ON THE TITLE PAGE:

In (73) Assignee:, change "Kabushiki Kaisha Sega, Tokyo (JP)" to --Kabushiki Kaisha Sega d/b/a Sega Corporation, Tokyo (JP)--

IN THE CLAIMS:

In Claim 2, Column 41, lines 11-12, replace "the control means controls the rotating mechanism so that so that one of either the first region" with --the control means controls the rotating mechanism so that one of either the first region--

Signed and Sealed this
Twenty-second Day of February, 2011

David J. Kappos

David J. Kappos
*Director of the United States Patent and Trademark Office*